US007938527B2

(12) United States Patent
Ohshima et al.

(10) Patent No.: US 7,938,527 B2
(45) Date of Patent: May 10, 2011

(54) INK, INK CARTRIDGE, INK JET RECORDING APPARATUS, AND INK JET RECORDING METHOD

(75) Inventors: Tohru Ohshima, Atsugi (JP); Naoya Morohoshi, Numazu (JP); Kiyofumi Nagai, Machida (JP); Hiroyuki Kiyoi, Sagamihara (JP); Masanori Hirano, Atsugi (JP); Shigetaka Sakakibara, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 411 days.

(21) Appl. No.: 12/095,614

(22) PCT Filed: Sep. 18, 2007

(86) PCT No.: PCT/JP2007/068597

§ 371 (c)(1),
(2), (4) Date: May 30, 2008

(87) PCT Pub. No.: WO2008/035797

PCT Pub. Date: Mar. 27, 2008

(65) Prior Publication Data

US 2010/0265292 A1 Oct. 21, 2010

(30) Foreign Application Priority Data

Sep. 19, 2006 (JP) ..... 2006-253012

(51) Int. Cl.
*B41J 2/01* (2006.01)

(52) U.S. Cl. ..... 347/102; 347/16; 347/106

(58) Field of Classification Search ..... 347/16, 347/102, 106
See application file for complete search history.

(56) References Cited

U.S. PATENT DOCUMENTS 5,471,234 A * 11/1995 Katano et al. ..... 347/171
6,764,804 B2 * 7/2004 Bourdelais et al. ..... 430/201
2007/0189295 A1 8/2007 Hamamoto et al.

FOREIGN PATENT DOCUMENTS

EP 1 284 186 2/2003

(Continued)

OTHER PUBLICATIONS

Office Action issued Dec. 20, 2010, in Korean Application No. 10-2008-7015915 (with English translation), 11 pages.

*Primary Examiner* — Matthew Luu
*Assistant Examiner* — Brian J Goldberg
(74) *Attorney, Agent, or Firm* — Oblon, Spivak, McClelland, Maier & Neustadt, L.L.P.

(57) ABSTRACT

To provide an ink jet recording method including: performing image recording on a recording medium to obtain an ink adhesion quantity of 15 g/m$^2$ or less of an ink containing at least a colorant, the recording medium having at least one coating layer on at least one surface of a substrate including cellulose pulp; and dry-to-touch drying the recorded image and bringing a heat source into direct contact with the recording medium for image fixing, wherein the recording medium is formed such that a transfer quantity of pure water into the recording medium in a contact interval of 100 ms that is measured with a dynamic scanning liquid absorptometer is 1 mL/m$^2$ or more to 30 mL/m$^2$ or less and a transfer quantity of pure water into the recording medium in a contact interval of 400 ms is 2 mL/m$^2$ or more to 35 mL/m$^2$ or less.

13 Claims, 32 Drawing Sheets

FOREIGN PATENT DOCUMENTS

| | | | |
|---|---|---|---|
| EP | 1 473 338 | | 11/2004 |
| JP | 8 92513 | | 4/1996 |
| JP | 2590822 | | 12/1996 |
| JP | 2860123 | | 12/1998 |
| JP | 11 78225 | | 3/1999 |
| JP | 2000-238414 | | 9/2000 |
| JP | 2001 150650 | | 6/2001 |
| JP | 2001 347749 | | 12/2001 |
| JP | 2003 211836 | | 7/2003 |
| JP | 2004 209799 | | 7/2004 |
| JP | 2005 212327 | | 8/2005 |
| JP | 2005 325328 | | 11/2005 |
| JP | 2006 36907 | | 2/2006 |
| JP | 2007 144975 | | 6/2007 |
| KR | 2003-0065347 | | 8/2003 |
| WO | 2006 006682 | | 1/2006 |
| WO | 2006/006683 | A1 | 1/2006 |
| WO | 2006 030930 | | 3/2006 |

* cited by examiner

FIG. 30

| | Pattern 1 | | | | Pattern 2 | | | | Pattern 3 | | | |
|---|---|---|---|---|---|---|---|---|---|---|---|---|
| Gray scale Level | Upper left | Upper right | Lower left | Lower right | Upper left | Upper right | Lower left | Lower right | Upper left | Upper right | Lower left | Lower right |
| 0 | 0 | 0 | 0 | 0 | 0 | 0 | 0 | 0 | 0 | 0 | 0 | 0 |
| 1 | 1 | 0 | 0 | 0 | 0 | 1 | 0 | 0 | 0 | 0 | 1 | 0 |
| 2 | 2 | 0 | 0 | 0 | 0 | 2 | 0 | 0 | 0 | 0 | 2 | 0 |
| 3 | 3 | 0 | 0 | 0 | 0 | 3 | 0 | 0 | 0 | 0 | 3 | 0 |
| 4 | 4 | 0 | 0 | 0 | 0 | 4 | 0 | 0 | 0 | 0 | 4 | 0 |
| 5 | 5 | 0 | 0 | 0 | 0 | 5 | 0 | 0 | 0 | 0 | 5 | 0 |
| 6 | 6 | 0 | 0 | 0 | 0 | 6 | 0 | 0 | 0 | 0 | 6 | 0 |
| 7 | 7 | 0 | 0 | 0 | 0 | 7 | 0 | 0 | 0 | 0 | 7 | 0 |
| 8 | 8 | 0 | 0 | 0 | 0 | 8 | 0 | 0 | 0 | 0 | 8 | 0 |
| 9 | 8 | 1 | 0 | 0 | 1 | 8 | 1 | 0 | 0 | 0 | 8 | 1 |
| 10 | 8 | 1 | 1 | 0 | 1 | 8 | 1 | 0 | 1 | 0 | 8 | 1 |
| 11 | 8 | 2 | 1 | 0 | 2 | 8 | 1 | 0 | 1 | 0 | 8 | 2 |
| 12 | 8 | 2 | 2 | 0 | 2 | 8 | 2 | 0 | 2 | 0 | 8 | 2 |
| 13 | 8 | 2 | 2 | 1 | 2 | 8 | 2 | 1 | 2 | 1 | 8 | 2 |
| 14 | 8 | 2 | 2 | 2 | 2 | 8 | 2 | 2 | 2 | 2 | 8 | 2 |
| 15 | 8 | 3 | 3 | 2 | 3 | 8 | 3 | 2 | 3 | 2 | 8 | 3 |
| | | | | | | | | | | | | |
| | | | | | | | | | | | | |
| | Pattern 4 | | | | | | | | Pattern 5 | | | |
| Gray scale Level | Upper left | Upper right | Lower left | Lower right | | | | | Upper left | Upper right | Lower left | Lower right |
| 0 | 0 | 0 | 0 | 0 | | | | | 0 | 0 | 0 | 0 |
| 1 | 0 | 0 | 0 | 1 | | | | | 1 | 0 | 0 | 0 |
| 2 | 0 | 0 | 0 | 2 | | | | | 1 | 0 | 0 | 1 |
| 3 | 0 | 0 | 0 | 3 | | | | | 1 | 1 | 0 | 1 |
| 4 | 0 | 0 | 0 | 4 | | | | | 1 | 1 | 1 | 1 |
| 5 | 0 | 0 | 0 | 5 | | | | | 2 | 1 | 1 | 1 |
| 6 | 0 | 0 | 0 | 6 | | | | | 2 | 1 | 1 | 2 |
| 7 | 0 | 0 | 0 | 7 | | | | | 2 | 2 | 1 | 2 |
| 8 | 0 | 0 | 0 | 8 | | | | | 2 | 2 | 2 | 2 |
| 9 | 0 | 0 | 1 | 8 | | | | | 3 | 2 | 2 | 2 |
| 10 | 0 | 1 | 1 | 8 | | | | | 3 | 2 | 2 | 3 |
| 11 | 0 | 1 | 2 | 8 | | | | | 3 | 3 | 2 | 3 |
| 12 | 0 | 2 | 2 | 8 | | | | | 3 | 3 | 3 | 3 |
| 13 | 1 | 2 | 2 | 8 | | | | | 4 | 3 | 3 | 3 |
| 14 | 2 | 2 | 2 | 8 | | | | | 4 | 3 | 3 | 4 |
| 15 | 3 | 3 | 3 | 8 | | | | | 4 | 4 | 4 | 4 |

FIG. 33

| Gray scale level | Density gradient Info. | No. | a-1 -1 L | a-1 -1 R | a-2 -1 L | a-2 -1 R | a-3 -1 L | a-3 -1 R | a-4 -1 L | a-4 -1 R | b-1 -1 L | b-1 -1 R | b-2 -1 L | b-2 -1 R | b-3 -1 L | b-3 -1 R | b-4 -1 L | b-4 -1 R |
|---|---|---|---|---|---|---|---|---|---|---|---|---|---|---|---|---|---|---|
| 1 | LU | 1 | 1 | 0 | 0 | 0 | 0 | 0 | 0 | 0 | 0 | 0 | 0 | 0 | 0 | 0 | 0 | 0 |
| 1 | | 2 | 0 | 0 | 1 | 0 | 0 | 0 | 0 | 0 | 0 | 0 | 0 | 0 | 0 | 0 | 0 | 0 |
| 1 | | 3 | 0 | 0 | 0 | 0 | 0 | 0 | 0 | 0 | 0 | 0 | 0 | 0 | 0 | 0 | 0 | 0 |
| 1 | | 4 | 0 | 0 | 0 | 0 | 0 | 0 | 0 | 0 | 0 | 0 | 0 | 0 | 0 | 0 | 0 | 0 |
| 1 | RU | 5 | 0 | 1 | 0 | 0 | 0 | 0 | 0 | 0 | 0 | 0 | 0 | 0 | 0 | 0 | 0 | 0 |
| 1 | | 6 | 0 | 0 | 0 | 1 | 0 | 0 | 0 | 0 | 0 | 0 | 0 | 0 | 0 | 0 | 0 | 0 |
| 1 | | 7 | 0 | 0 | 0 | 0 | 0 | 1 | 0 | 0 | 0 | 0 | 0 | 0 | 0 | 0 | 0 | 0 |
| 1 | | 8 | 0 | 0 | 0 | 0 | 0 | 0 | 0 | 1 | 0 | 0 | 0 | 0 | 0 | 0 | 0 | 0 |
| 1 | LL | 9 | 0 | 0 | 0 | 0 | 0 | 0 | 0 | 0 | 1 | 0 | 0 | 0 | 0 | 0 | 0 | 0 |
| 1 | | 10 | 0 | 0 | 0 | 0 | 0 | 0 | 0 | 0 | 0 | 0 | 1 | 0 | 0 | 0 | 0 | 0 |
| 1 | | 11 | 0 | 0 | 0 | 0 | 0 | 0 | 0 | 0 | 0 | 0 | 0 | 0 | 1 | 0 | 0 | 0 |
| 1 | | 12 | 0 | 0 | 0 | 0 | 0 | 0 | 0 | 0 | 0 | 0 | 0 | 0 | 0 | 0 | 1 | 0 |
| 1 | RL | 13 | 0 | 0 | 0 | 0 | 0 | 0 | 0 | 0 | 0 | 1 | 0 | 0 | 0 | 0 | 0 | 0 |
| 1 | | 14 | 0 | 0 | 0 | 0 | 0 | 0 | 0 | 0 | 0 | 0 | 0 | 1 | 0 | 0 | 0 | 0 |
| 1 | | 15 | 0 | 0 | 0 | 0 | 0 | 0 | 0 | 0 | 0 | 0 | 0 | 0 | 0 | 1 | 0 | 0 |
| 1 | | 16 | 0 | 0 | 0 | 0 | 0 | 0 | 0 | 0 | 0 | 0 | 0 | 0 | 0 | 0 | 0 | 1 |
| | | | | | | | | | | | | | | | | | | |
| 2 | LU | 17 | 1 | 0 | 1 | 0 | 0 | 0 | 0 | 0 | 0 | 0 | 0 | 0 | 0 | 0 | 0 | 0 |
| 2 | | 18 | 0 | 0 | 1 | 0 | 1 | 0 | 0 | 0 | 0 | 0 | 0 | 0 | 0 | 0 | 0 | 0 |
| 2 | | 19 | 0 | 0 | 0 | 0 | 1 | 0 | 1 | 0 | 0 | 0 | 0 | 0 | 0 | 0 | 0 | 0 |
| 2 | | 20 | 1 | 0 | 0 | 0 | 0 | 0 | 1 | 0 | 0 | 0 | 0 | 0 | 0 | 0 | 0 | 0 |
| 2 | RU | 21 | 0 | 1 | 0 | 1 | 0 | 0 | 0 | 0 | 0 | 0 | 0 | 0 | 0 | 0 | 0 | 0 |
| 2 | | 22 | 0 | 0 | 0 | 1 | 0 | 1 | 0 | 0 | 0 | 0 | 0 | 0 | 0 | 0 | 0 | 0 |
| 2 | | 23 | 0 | 0 | 0 | 0 | 0 | 1 | 0 | 1 | 0 | 0 | 0 | 0 | 0 | 0 | 0 | 0 |
| 2 | | 24 | 0 | 1 | 0 | 0 | 0 | 0 | 0 | 1 | 0 | 0 | 0 | 0 | 0 | 0 | 0 | 0 |
| 2 | LL | 25 | 0 | 0 | 0 | 0 | 0 | 0 | 0 | 0 | 1 | 0 | 1 | 0 | 0 | 0 | 0 | 0 |
| 2 | | 26 | 0 | 0 | 0 | 0 | 0 | 0 | 0 | 0 | 0 | 0 | 1 | 0 | 1 | 0 | 0 | 0 |
| 2 | | 27 | 0 | 0 | 0 | 0 | 0 | 0 | 0 | 0 | 0 | 0 | 0 | 0 | 1 | 0 | 1 | 0 |
| 2 | | 28 | 0 | 0 | 0 | 0 | 0 | 0 | 0 | 0 | 1 | 0 | 0 | 0 | 0 | 0 | 1 | 0 |
| 2 | RL | 29 | 0 | 0 | 0 | 0 | 0 | 0 | 0 | 0 | 0 | 1 | 0 | 1 | 0 | 0 | 0 | 0 |
| 2 | | 30 | 0 | 0 | 0 | 0 | 0 | 0 | 0 | 0 | 0 | 0 | 0 | 1 | 0 | 1 | 0 | 0 |
| 2 | | 31 | 0 | 0 | 0 | 0 | 0 | 0 | 0 | 0 | 0 | 0 | 0 | 0 | 0 | 1 | 0 | 1 |
| 2 | | 32 | 0 | 0 | 0 | 0 | 0 | 0 | 0 | 0 | 0 | 1 | 0 | 0 | 0 | 0 | 0 | 1 |
| 2 | AVE | 33 | 1 | 0 | 0 | 0 | 0 | 0 | 0 | 0 | 0 | 1 | 0 | 0 | 0 | 0 | 0 | 0 |
| 2 | | 34 | 1 | 0 | 0 | 0 | 0 | 0 | 0 | 0 | 0 | 0 | 0 | 1 | 0 | 1 | 0 | 0 |
| 2 | | 35 | 1 | 0 | 0 | 0 | 0 | 0 | 0 | 0 | 0 | 0 | 0 | 0 | 0 | 1 | 0 | 0 |
| 2 | | 36 | 1 | 0 | 0 | 0 | 0 | 0 | 0 | 0 | 0 | 0 | 0 | 0 | 0 | 0 | 0 | 1 |
| 2 | | 37 | 0 | 0 | 1 | 0 | 0 | 0 | 0 | 0 | 0 | 1 | 0 | 0 | 0 | 0 | 0 | 0 |
| 2 | | 38 | 0 | 0 | 1 | 0 | 0 | 0 | 0 | 0 | 0 | 0 | 0 | 1 | 0 | 0 | 0 | 0 |
| 2 | | 39 | 0 | 0 | 1 | 0 | 0 | 0 | 0 | 0 | 0 | 0 | 0 | 0 | 0 | 1 | 0 | 0 |
| 2 | | 40 | 0 | 0 | 1 | 0 | 0 | 0 | 0 | 0 | 0 | 0 | 0 | 0 | 0 | 0 | 0 | 1 |
| | | | | | | | | | | | | | | | | | | |
| 3 | LU | 41 | 1 | 0 | 1 | 0 | 0 | 0 | 0 | 0 | 0 | 1 | 0 | 0 | 0 | 0 | 0 | 0 |
| 3 | | 42 | 0 | 0 | 1 | 0 | 1 | 0 | 0 | 0 | 0 | 0 | 0 | 1 | 0 | 0 | 0 | 0 |
| 3 | | 43 | 0 | 0 | 0 | 0 | 1 | 0 | 1 | 0 | 0 | 0 | 0 | 0 | 0 | 1 | 0 | 0 |
| 3 | | 44 | 1 | 0 | 0 | 0 | 0 | 0 | 1 | 0 | 0 | 0 | 0 | 0 | 0 | 0 | 0 | 1 |
| 3 | RU | 45 | 0 | 1 | 0 | 1 | 0 | 0 | 0 | 0 | 1 | 0 | 0 | 0 | 0 | 0 | 0 | 0 |
| 3 | | 46 | 0 | 0 | 0 | 1 | 0 | 1 | 0 | 0 | 0 | 0 | 1 | 0 | 0 | 0 | 0 | 0 |
| 3 | | 47 | 0 | 0 | 0 | 0 | 0 | 1 | 0 | 1 | 0 | 0 | 0 | 0 | 1 | 0 | 0 | 0 |
| 3 | | 48 | 0 | 1 | 0 | 0 | 0 | 0 | 0 | 1 | 0 | 0 | 0 | 0 | 0 | 0 | 1 | 0 |
| 3 | LL | 49 | 0 | 1 | 0 | 0 | 0 | 0 | 0 | 0 | 1 | 0 | 1 | 0 | 0 | 0 | 0 | 0 |
| 3 | | 50 | 0 | 0 | 0 | 1 | 0 | 0 | 0 | 0 | 0 | 0 | 1 | 0 | 1 | 0 | 0 | 0 |
| 3 | | 51 | 0 | 0 | 0 | 0 | 0 | 1 | 0 | 0 | 0 | 0 | 0 | 0 | 1 | 0 | 1 | 0 |
| 3 | | 52 | 0 | 0 | 0 | 0 | 0 | 0 | 0 | 1 | 1 | 0 | 0 | 1 | 0 | 0 | 1 | 0 |
| 3 | RL | 53 | 1 | 0 | 0 | 0 | 0 | 0 | 0 | 0 | 0 | 1 | 0 | 1 | 0 | 0 | 0 | 0 |
| 3 | | 54 | 0 | 0 | 1 | 0 | 0 | 0 | 0 | 0 | 0 | 0 | 0 | 0 | 0 | 1 | 0 | 0 |
| 3 | | 55 | 0 | 0 | 0 | 0 | 1 | 0 | 0 | 0 | 0 | 0 | 0 | 0 | 0 | 1 | 0 | 1 |
| 3 | | 56 | 0 | 0 | 0 | 0 | 0 | 0 | 1 | 0 | 0 | 1 | 0 | 0 | 0 | 0 | 0 | 1 |
| 3 | AVE | 41 | 1 | 0 | 0 | 1 | 0 | 0 | 0 | 0 | 0 | 0 | 0 | 0 | 0 | 0 | 0 | 0 |
| 3 | | 42 | 0 | 0 | 1 | 0 | 1 | 1 | 0 | 0 | 0 | 0 | 1 | 0 | 0 | 0 | 0 | 0 |
| 3 | | 43 | 0 | 0 | 0 | 0 | 0 | 0 | 0 | 1 | 0 | 0 | 0 | 0 | 1 | 0 | 0 | 0 |
| 3 | | 44 | 0 | 1 | 0 | 0 | 0 | 0 | 1 | 0 | 0 | 0 | 0 | 0 | 0 | 0 | 1 | 0 |

FIG. 34

| Gray scale level | Density gradient Info. | No. | a-1-1 L | a-1-1 R | a-2-1 L | a-2-1 R | a-3-1 L | a-3-1 R | a-4-1 L | a-4-1 R | b-1-1 L | b-1-1 R | b-2-1 L | b-2-1 R | b-3-1 L | b-3-1 R | b-4-1 L | b-4-1 R |
|---|---|---|---|---|---|---|---|---|---|---|---|---|---|---|---|---|---|---|
| 4 | LU | 45 | 1 | 0 | 1 | 0 | 1 | 0 | 0 | 0 | 0 | 1 | 0 | 0 | 0 | 0 | 0 | 0 |
| 4 | | 46 | 0 | 0 | 1 | 0 | 1 | 0 | 1 | 0 | 0 | 0 | 0 | 1 | 0 | 0 | 0 | 0 |
| 4 | | 47 | 1 | 0 | 0 | 0 | 1 | 0 | 1 | 0 | 0 | 0 | 0 | 0 | 0 | 1 | 0 | 0 |
| 4 | | 48 | 1 | 0 | 1 | 0 | 0 | 0 | 1 | 0 | 0 | 0 | 0 | 0 | 0 | 0 | 0 | 1 |
| 4 | RU | 49 | 0 | 1 | 0 | 1 | 0 | 1 | 0 | 0 | 1 | 0 | 0 | 0 | 0 | 0 | 0 | 0 |
| 4 | | 50 | 0 | 0 | 0 | 1 | 0 | 1 | 0 | 1 | 0 | 0 | 1 | 0 | 0 | 0 | 0 | 0 |
| 4 | | 51 | 0 | 1 | 0 | 0 | 0 | 1 | 0 | 1 | 0 | 0 | 0 | 0 | 1 | 0 | 0 | 0 |
| 4 | | 52 | 0 | 1 | 0 | 1 | 0 | 0 | 0 | 1 | 0 | 0 | 0 | 0 | 0 | 0 | 1 | 0 |
| 4 | LL | 53 | 0 | 1 | 0 | 0 | 0 | 0 | 0 | 0 | 1 | 0 | 1 | 0 | 1 | 0 | 0 | 0 |
| 4 | | 54 | 0 | 0 | 0 | 1 | 0 | 0 | 0 | 0 | 0 | 0 | 1 | 0 | 1 | 0 | 1 | 0 |
| 4 | | 55 | 0 | 0 | 0 | 0 | 0 | 1 | 0 | 0 | 1 | 0 | 0 | 0 | 1 | 0 | 1 | 0 |
| 4 | | 56 | 0 | 0 | 0 | 0 | 0 | 0 | 0 | 1 | 1 | 0 | 1 | 0 | 0 | 0 | 1 | 0 |
| 4 | RL | 57 | 1 | 0 | 0 | 0 | 0 | 0 | 0 | 0 | 0 | 1 | 0 | 1 | 0 | 1 | 0 | 0 |
| 4 | | 58 | 0 | 0 | 1 | 0 | 0 | 0 | 0 | 0 | 0 | 0 | 0 | 1 | 0 | 1 | 0 | 1 |
| 4 | | 59 | 0 | 0 | 0 | 0 | 1 | 0 | 1 | 0 | 0 | 1 | 0 | 0 | 0 | 1 | 0 | 1 |
| 4 | | 60 | 0 | 0 | 0 | 0 | 0 | 0 | 0 | 0 | 0 | 1 | 0 | 1 | 0 | 0 | 0 | 1 |
| 4 | AVE | 61 | 1 | 0 | 0 | 1 | 0 | 0 | 0 | 0 | 0 | 1 | 0 | 0 | 1 | 0 | 0 | 0 |
| 4 | | 62 | 0 | 0 | 1 | 0 | 0 | 1 | 0 | 0 | 0 | 0 | 0 | 1 | 0 | 0 | 1 | 0 |
| 4 | | 63 | 0 | 0 | 0 | 0 | 1 | 0 | 0 | 1 | 0 | 0 | 1 | 0 | 0 | 1 | 0 | 0 |
| 4 | | 64 | 0 | 1 | 0 | 0 | 0 | 0 | 0 | 0 | 0 | 0 | 0 | 0 | 1 | 0 | 0 | 1 |
| | | | | | | | | | | | | | | | | | | |
| 5 | LU | 65 | 1 | 0 | 1 | 0 | 1 | 0 | 0 | 1 | 0 | 1 | 0 | 0 | 0 | 0 | 0 | 0 |
| 5 | | 66 | 0 | 1 | 1 | 0 | 1 | 0 | 1 | 0 | 0 | 0 | 0 | 1 | 0 | 0 | 0 | 0 |
| 5 | | 67 | 1 | 0 | 0 | 1 | 1 | 0 | 1 | 0 | 0 | 0 | 0 | 0 | 0 | 1 | 0 | 0 |
| 5 | | 68 | 1 | 0 | 1 | 0 | 0 | 1 | 1 | 0 | 0 | 0 | 0 | 0 | 0 | 0 | 0 | 1 |
| 5 | RU | 69 | 0 | 1 | 0 | 1 | 0 | 1 | 1 | 0 | 1 | 0 | 0 | 0 | 0 | 0 | 0 | 0 |
| 5 | | 70 | 1 | 0 | 0 | 1 | 0 | 1 | 0 | 1 | 0 | 0 | 1 | 0 | 0 | 0 | 0 | 0 |
| 5 | | 71 | 0 | 1 | 1 | 0 | 0 | 1 | 0 | 1 | 0 | 0 | 0 | 0 | 1 | 0 | 0 | 0 |
| 5 | | 72 | 0 | 1 | 0 | 1 | 1 | 0 | 0 | 0 | 0 | 0 | 0 | 0 | 0 | 0 | 1 | 0 |
| 5 | LL | 73 | 0 | 1 | 0 | 0 | 0 | 0 | 0 | 0 | 1 | 0 | 1 | 0 | 1 | 0 | 0 | 1 |
| 5 | | 74 | 0 | 0 | 0 | 1 | 0 | 0 | 0 | 0 | 0 | 1 | 1 | 0 | 1 | 0 | 1 | 0 |
| 5 | | 75 | 0 | 0 | 0 | 0 | 0 | 1 | 0 | 0 | 1 | 0 | 0 | 1 | 1 | 0 | 1 | 0 |
| 5 | | 76 | 0 | 0 | 0 | 0 | 0 | 0 | 0 | 1 | 1 | 0 | 1 | 0 | 0 | 1 | 1 | 0 |
| 5 | RL | 77 | 0 | 0 | 0 | 0 | 0 | 0 | 0 | 0 | 0 | 1 | 0 | 1 | 0 | 1 | 1 | 0 |
| 5 | | 78 | 0 | 0 | 1 | 0 | 0 | 0 | 0 | 0 | 1 | 0 | 0 | 1 | 0 | 1 | 0 | 1 |
| 5 | | 79 | 0 | 0 | 0 | 0 | 0 | 0 | 0 | 0 | 0 | 1 | 1 | 0 | 0 | 1 | 0 | 1 |
| 5 | | 80 | 0 | 0 | 0 | 0 | 0 | 0 | 1 | 0 | 0 | 1 | 0 | 1 | 1 | 0 | 0 | 1 |
| 5 | AVE | 81 | 0 | 0 | 0 | 1 | 1 | 0 | 0 | 0 | 0 | 1 | 0 | 0 | 1 | 0 | 0 | 0 |
| 5 | | 82 | 0 | 0 | 0 | 0 | 0 | 1 | 1 | 0 | 0 | 0 | 0 | 1 | 0 | 0 | 1 | 0 |
| 5 | | 83 | 0 | 0 | 0 | 1 | 1 | 0 | 0 | 1 | 0 | 0 | 1 | 0 | 0 | 1 | 0 | 0 |
| 5 | | 84 | 0 | 1 | 1 | 0 | 0 | 0 | 1 | 0 | 0 | 0 | 0 | 0 | 1 | 0 | 0 | 1 |
| | | | | | | | | | | | | | | | | | | |
| 6 | LU | 85 | 1 | 0 | 1 | 0 | 1 | 0 | 0 | 1 | 0 | 1 | 1 | 0 | 0 | 0 | 0 | 0 |
| 6 | | 86 | 0 | 1 | 1 | 0 | 1 | 0 | 1 | 0 | 0 | 0 | 0 | 1 | 1 | 0 | 0 | 0 |
| 6 | | 87 | 1 | 0 | 0 | 1 | 1 | 0 | 1 | 0 | 0 | 0 | 0 | 0 | 0 | 1 | 1 | 0 |
| 6 | | 88 | 1 | 0 | 1 | 0 | 0 | 1 | 1 | 0 | 1 | 0 | 0 | 0 | 0 | 0 | 0 | 1 |
| 6 | RU | 89 | 0 | 1 | 0 | 1 | 0 | 1 | 1 | 0 | 1 | 1 | 0 | 0 | 0 | 0 | 0 | 0 |
| 6 | | 90 | 0 | 0 | 0 | 1 | 0 | 1 | 0 | 1 | 0 | 0 | 1 | 1 | 0 | 0 | 0 | 0 |
| 6 | | 91 | 0 | 1 | 1 | 0 | 0 | 1 | 0 | 1 | 0 | 0 | 0 | 0 | 1 | 1 | 0 | 0 |
| 6 | | 92 | 0 | 1 | 0 | 1 | 1 | 0 | 0 | 1 | 0 | 0 | 0 | 0 | 0 | 0 | 1 | 1 |
| 6 | LL | 93 | 0 | 1 | 1 | 0 | 0 | 0 | 0 | 0 | 1 | 0 | 1 | 0 | 1 | 0 | 0 | 1 |
| 6 | | 94 | 0 | 0 | 0 | 1 | 1 | 0 | 0 | 0 | 0 | 1 | 1 | 0 | 1 | 0 | 1 | 0 |
| 6 | | 95 | 0 | 0 | 0 | 0 | 0 | 1 | 1 | 0 | 1 | 0 | 0 | 1 | 1 | 0 | 1 | 0 |
| 6 | | 96 | 1 | 0 | 0 | 0 | 0 | 0 | 0 | 1 | 1 | 0 | 1 | 0 | 0 | 1 | 1 | 0 |
| 6 | RL | 97 | 1 | 1 | 0 | 0 | 0 | 0 | 0 | 0 | 0 | 1 | 0 | 1 | 0 | 1 | 1 | 0 |
| 6 | | 98 | 0 | 0 | 1 | 1 | 0 | 0 | 0 | 0 | 1 | 0 | 0 | 1 | 0 | 1 | 0 | 1 |
| 6 | | 99 | 0 | 0 | 0 | 0 | 1 | 1 | 0 | 0 | 0 | 1 | 1 | 0 | 0 | 1 | 0 | 1 |
| 6 | | 100 | 0 | 0 | 0 | 0 | 0 | 0 | 1 | 1 | 0 | 1 | 0 | 1 | 1 | 0 | 0 | 1 |
| 6 | AVE | 101 | 1 | 0 | 0 | 1 | 1 | 0 | 0 | 0 | 0 | 1 | 0 | 0 | 1 | 0 | 0 | 1 |
| 6 | | 102 | 0 | 0 | 1 | 0 | 0 | 1 | 1 | 0 | 0 | 1 | 0 | 1 | 0 | 0 | 1 | 0 |
| 6 | | 103 | 1 | 0 | 0 | 0 | 1 | 0 | 0 | 1 | 1 | 0 | 1 | 0 | 0 | 1 | 0 | 0 |
| 6 | | 104 | 0 | 1 | 1 | 0 | 0 | 0 | 1 | 0 | 0 | 1 | 0 | 0 | 1 | 0 | 0 | 1 |

FIG. 35

| Gray scale level | Density gradient Info. | No. | a-1-1 L | a-1-1 R | a-2-1 L | a-2-1 R | a-3-1 L | a-3-1 R | a-4-1 L | a-4-1 R | b-1-1 L | b-1-1 R | b-2-1 L | b-2-1 R | b-3-1 L | b-3-1 R | b-4-1 L | b-4-1 R |
|---|---|---|---|---|---|---|---|---|---|---|---|---|---|---|---|---|---|---|
| 7 | LU | 105 | 1 | 0 | 1 | 0 | 1 | 0 | 1 | 1 | 0 | 1 | 1 | 0 | 0 | 0 | 0 | 0 |
| 7 | | 106 | 1 | 1 | 1 | 0 | 1 | 0 | 1 | 0 | 0 | 0 | 0 | 1 | 1 | 0 | 0 | 0 |
| 7 | | 107 | 1 | 0 | 1 | 1 | 1 | 0 | 1 | 0 | 0 | 0 | 0 | 0 | 0 | 1 | 1 | 0 |
| 7 | | 108 | 1 | 0 | 1 | 0 | 1 | 1 | 1 | 0 | 1 | 0 | 0 | 0 | 0 | 0 | 0 | 1 |
| 7 | RU | 109 | 0 | 1 | 0 | 1 | 0 | 1 | 1 | 1 | 1 | 1 | 0 | 0 | 0 | 0 | 0 | 0 |
| 7 | | 110 | 1 | 1 | 0 | 1 | 0 | 1 | 0 | 1 | 0 | 0 | 1 | 1 | 0 | 0 | 0 | 0 |
| 7 | | 111 | 0 | 1 | 1 | 1 | 0 | 1 | 0 | 1 | 0 | 0 | 0 | 0 | 1 | 1 | 0 | 0 |
| 7 | | 112 | 0 | 1 | 0 | 1 | 1 | 1 | 0 | 1 | 0 | 0 | 0 | 0 | 0 | 0 | 1 | 1 |
| 7 | LL | 113 | 0 | 1 | 1 | 0 | 0 | 0 | 0 | 0 | 1 | 0 | 1 | 0 | 1 | 0 | 1 | 1 |
| 7 | | 114 | 0 | 0 | 0 | 1 | 1 | 0 | 0 | 0 | 1 | 1 | 1 | 0 | 1 | 0 | 1 | 0 |
| 7 | | 115 | 0 | 0 | 0 | 0 | 0 | 1 | 1 | 0 | 1 | 0 | 1 | 1 | 1 | 0 | 1 | 0 |
| 7 | | 116 | 1 | 0 | 0 | 0 | 0 | 0 | 0 | 1 | 1 | 0 | 1 | 0 | 1 | 1 | 1 | 0 |
| 7 | RL | 117 | 1 | 1 | 0 | 0 | 0 | 0 | 0 | 0 | 0 | 1 | 0 | 1 | 0 | 1 | 1 | 1 |
| 7 | | 118 | 0 | 0 | 1 | 1 | 0 | 0 | 0 | 0 | 1 | 1 | 0 | 1 | 0 | 1 | 0 | 1 |
| 7 | | 119 | 0 | 0 | 0 | 0 | 1 | 1 | 0 | 0 | 0 | 1 | 1 | 1 | 0 | 1 | 0 | 1 |
| 7 | | 120 | 0 | 0 | 0 | 0 | 0 | 0 | 1 | 1 | 0 | 1 | 0 | 1 | 1 | 0 | 0 | 1 |
| 7 | AVE | 121 | 1 | 0 | 0 | 1 | 1 | 0 | 0 | 1 | 0 | 1 | 0 | 0 | 1 | 1 | 0 | 1 |
| 7 | | 122 | 0 | 1 | 1 | 0 | 0 | 1 | 1 | 0 | 0 | 1 | 0 | 1 | 0 | 0 | 1 | 0 |
| 7 | | 123 | 1 | 0 | 0 | 1 | 1 | 0 | 0 | 1 | 1 | 0 | 1 | 0 | 0 | 1 | 0 | 0 |
| 7 | | 124 | 0 | 1 | 1 | 0 | 0 | 1 | 1 | 0 | 0 | 1 | 0 | 0 | 1 | 0 | 0 | 1 |
| | | | | | | | | | | | | | | | | | | |
| 8 | LU | 125 | 1 | 0 | 1 | 0 | 1 | 0 | 1 | 1 | 0 | 1 | 1 | 0 | 1 | 0 | 0 | 0 |
| 8 | | 126 | 1 | 1 | 1 | 0 | 1 | 0 | 1 | 0 | 0 | 0 | 0 | 1 | 1 | 0 | 1 | 0 |
| 8 | | 127 | 1 | 0 | 1 | 1 | 1 | 0 | 1 | 0 | 1 | 0 | 0 | 0 | 0 | 1 | 0 | 0 |
| 8 | | 128 | 1 | 0 | 1 | 0 | 1 | 1 | 1 | 0 | 1 | 0 | 1 | 0 | 0 | 0 | 0 | 1 |
| 8 | RU | 129 | 0 | 1 | 0 | 1 | 0 | 1 | 1 | 1 | 1 | 1 | 0 | 1 | 0 | 0 | 0 | 0 |
| 8 | | 130 | 1 | 1 | 0 | 1 | 0 | 1 | 0 | 1 | 0 | 0 | 1 | 1 | 0 | 1 | 0 | 0 |
| 8 | | 131 | 0 | 1 | 1 | 1 | 0 | 1 | 0 | 1 | 0 | 0 | 0 | 0 | 1 | 1 | 0 | 1 |
| 8 | | 132 | 0 | 1 | 0 | 1 | 1 | 1 | 0 | 1 | 0 | 1 | 0 | 0 | 0 | 0 | 1 | 1 |
| 8 | LL | 133 | 0 | 1 | 1 | 0 | 1 | 0 | 0 | 0 | 1 | 0 | 1 | 0 | 1 | 0 | 1 | 1 |
| 8 | | 134 | 0 | 0 | 0 | 1 | 1 | 0 | 1 | 0 | 1 | 1 | 1 | 0 | 1 | 0 | 1 | 0 |
| 8 | | 135 | 1 | 0 | 0 | 0 | 0 | 1 | 1 | 0 | 1 | 0 | 1 | 1 | 1 | 0 | 1 | 0 |
| 8 | | 136 | 1 | 0 | 1 | 0 | 0 | 0 | 0 | 1 | 1 | 0 | 1 | 0 | 1 | 1 | 1 | 0 |
| 8 | RL | 137 | 1 | 1 | 0 | 1 | 0 | 0 | 0 | 0 | 0 | 1 | 0 | 1 | 0 | 1 | 1 | 1 |
| 8 | | 138 | 0 | 0 | 1 | 1 | 0 | 1 | 0 | 0 | 1 | 1 | 0 | 1 | 0 | 1 | 0 | 1 |
| 8 | | 139 | 0 | 0 | 0 | 0 | 1 | 1 | 0 | 1 | 0 | 1 | 1 | 1 | 0 | 1 | 0 | 1 |
| 8 | | 140 | 0 | 1 | 0 | 0 | 0 | 0 | 1 | 1 | 0 | 1 | 0 | 1 | 1 | 1 | 0 | 1 |
| 8 | AVE | 141 | 1 | 0 | 0 | 1 | 1 | 0 | 0 | 1 | 0 | 1 | 1 | 0 | 1 | 0 | 0 | 1 |
| 8 | | 142 | 0 | 1 | 1 | 0 | 0 | 1 | 1 | 0 | 1 | 1 | 0 | 1 | 0 | 0 | 1 | 0 |
| 8 | | 143 | 1 | 0 | 0 | 1 | 1 | 0 | 0 | 1 | 1 | 0 | 1 | 0 | 0 | 1 | 0 | 1 |
| 8 | | 144 | 0 | 1 | 1 | 0 | 0 | 1 | 1 | 0 | 0 | 1 | 0 | 0 | 1 | 0 | 1 | 1 |
| | | | | | | | | | | | | | | | | | | |
| | | | | | | | | | | | | | | | | | | |
| | | | | | | | | | | | | | | | | | | |
| | | | | | | | | | | | | | | | | | | |

INK, INK CARTRIDGE, INK JET RECORDING APPARATUS, AND INK JET RECORDING METHOD

CROSS-REFERENCE TO RELATED APPLICATIONS

This application is a U.S. national stage application of PCT/JP2007/068597 filed on Sep. 18, 2007, and is based upon and claims the benefit of priority from the prior Japanese Patent Application No. 2006-253012, filed Sep. 19, 2006.

TECHNICAL FIELD

The present invention relates to an ink suitable for recording images of high quality close to those obtained by commercial printing such as offset printing by an ink jet system, and also to an ink cartridge, ink jet recording method, and ink jet recording apparatus.

BACKGROUND ART

Ink jet recording is known as an excellent recording method suitable for a comparatively wide range of recording media, and recording apparatuses, recording methods, and recording media based on the ink jet approach have been widely researched and developed.

In recent years, performance improvement of printers, inks, and recording media made it possible to obtain easily a high quality on par with that of halide photography. In this respect, the advancement of recording media is remarkable, and presently available recording media that were developed to realize high gloss, while increasing the absorption rate of ink and the amount of absorbed ink are at a level surpassing that of the conventional commercial printing in terms of gloss and quality feel. Such recording media can be generally classified into swellable and porous, but in recent years porous recording media are mainly used because they excel in ink drying rate.

Examples of such porous recording media are disclosed in Patent Literature 1 and Patent Literature 2. In these media, an ink absorption layer containing silica and alumina hydrate and having pores for taking in the ink is provided on a support body, and a porous glossy layer containing colloidal silica is provided, if necessary, on the ink absorption layer. With such configuration, excellent ink absorption ability and very fine output are obtained. Therefore, such recording media are suitable for photographic output applications for consumers. However, because starting materials for the recording media of this type are very expensive and the manufacturing process is complex, the media are much more expensive that the general commercial-grade and publication-grade coated paper. As a result, despite high quality of images, such media have not yet been widely used in the field of commercial printing where low cost and high output are required, e.g. for flyers, catalogs, and pamphlets. Accordingly, a great deal of efforts went heretofore into cost reduction of recording media, but because a filler constituting an ink absorbing layer of recording media is required to use a material that can maintain high transparency of ink absorbing layer and has high oil absorption quantity (specific surface area), it is necessary to use a large amount of a special expensive filler such as silica, alumina hydroxide, and colloidal silica, thereby greatly hindering cost reduction.

Further, where inexpensively produced coated paper in which a large amount of inexpensive fillers having high hiding ability and a comparatively low oil absorption quantity, such as calcium carbonate and kaolin, is added to a coating layer material, as the commercial-grade and publication-grade coated paper, is used as a recoding medium, the images blur significantly and density is not developed. This result can be explained as follows. Because commercial-grade coated paper is not designed to be capable of absorbing a large quantity of ink within a short period, as ink jet paper, ink absorption is insufficient and blurring occurs, and even if the ink permeates into the coating layer, the colorant is hidden by a filler with a high hiding ability such as kaolin present in the coating layer. Further, in commercial-grade and publication grade coated paper using fillers with high hiding ability, when printing is performed in an ink jet printer using dye inks, density is demonstrated only by the colorant present close to the surface layer, even if the amount of ink is increased. Therefore, an image that as a whole has low density and no contrast is obtained. Accordingly, commercial-grade and publication grade coated paper has not been suitable for ink jet recording.

In recent years, ink-jet inks using pigments rather than dyes as colorants have attracted much attention. Because pigments are insoluble in water, a dispersion is usually used in which pigment fine particles are dispersed in a solvent. Due to safety considerations, pigment inks for ink jet printing are mainly aqueous dispersions. Aggregation or precipitation of pigment particles in aqueous pigment inks generally occurs easier than in the dye inks. Accordingly, dispersion conditions and additives have to be appropriately selected to obtain long-term storage life on par with that of dye inks. Another drawback is that dispersion stabilizers cause cohesion and they are difficult to use with thermal heads. Moreover, a color range of colorants is inferior to that of dyes. On the other hand, pigment inks are very attractive because of high density and excellent stability in storage and resistance to water after recording. In ink jet printer using such pigment inks, ink colorants are sometimes close to colorants of general inks for commercial printing, and the appearance of prints can be brought close to commercial prints, but where printing is actually performed with the conventional ink jet printers using pigment inks on commercial-grade and publication-grade coated paper, ink absorption is insufficient, the images blur, pigments are not fixed completely after drying, and gloss cannot be obtained, that is, such printing is presently adapted only to printing on media with a high ink absorption ability such as usual paper and special paper for ink jet printing, as with the conventional dye inks. This is because the concept and design relating to ink jet image printing is the same as in the case of using dye inks, and pigments are used as if they are dyes with a high light resistance. In other words, specific features of pigment inks are not taken into account at all.

Recording media adapted to pigment inks have also been widely researched and developed, but the point of development is how to promote image gloss, while accelerating ink absorption, as described in Patent Literature 3, and the research of methods for developing gloss, while increasing the porosity of recording media surface is still pursued along the line of conventional technology using expensive filler materials.

In order to resolve the above-mentioned problems, Patent Literature 4 suggests a low-cost method for recording images on commercial-grade paper by combining a pigment ink with high permeability and a recording medium that, by contrast with the conventional media, has low ink absorption ability. With this method, only a solvent (water or an organic solvent) forming the ink is selectively caused to infiltrate into the substrate by recording using a small amount of pigment ink with ultrahigh permeability on a recording medium having provided thereon a coating layer for inhibiting ink absorption (permeation) so that the pigment contained in the ink does not infiltrate intensively into the medium, and the pigment contained in the ink can be caused to remain on the medium surface with good efficiency, without using any special material such as cation fixing agent. As a result, both a sufficient density and drying ability can be realized with a small amount of ink. Moreover, because the pigment contained in the ink, is caused to remain effectively on the medium surface, high transparency of the layer that was a necessary function in the conventional recording media becomes unnecessary. Therefore, the degree of freedom relating to material configuration of the coating layer can be greatly increased. By applying this method, it is possible to perform ink jet recording even on paper with low ink absorption ability such as commercial-grade or publication-grade paper.

When commercial printing and publication printing is performed, it is often necessary to output several hundreds to several thousands copies at one time even in small-lot printing, and the printer is required to produce stable images without image loss in a continuous mode. When an ink jet printer is used for such applications, image streaks occur because dried ink clogs the nozzles and the discharge trajectory is curved by the dried ink fixed to the periphery of the nozzle. Various means have been used to prevent this phenomenon, but the most effective among them, for both the dye inks and the pigment inks, is the addition of a wetting agent with a high boiling point to the ink with the object of obtaining a mild drying ability of the ink.

However, although the method described in Patent Literature 4 is very effective for recording on paper with poor ink absorption, when a recording medium with extremely poor ink absorption, such as commercial-grade ink, is combined with an ink additionally containing a wetting agent with a high boiling point for preventing the printer head from drying (nozzle clogging), the drying ability of image does not change significantly, but an extremely long time is required for "fixing", that is to reach a state, in which the dried image is not blurred even by rubbing. This is because the colorant remaining in the surface layer contains microamounts of the wetting agent and remains in a wetted state for a long time. This phenomenon is similar to that observed when offset printing ink using soybean oil requires a long time for fixing after printing. In terms of such fixing delay, pigment inks appear to be especially disadvantageous by comparison with dye inks. With the dry-type inks that are presently mainly used as ink-jet inks, the colorant itself easily diffuses into a medium. As a result, a wetting agent (in most cases, a solvent with a high boiling point) also diffuses within a relatively short period. As a result, when recording is performed by using commercial-grade paper in a printer using ink that contains a wetting agent with a high boiling point in order to improve reliability against image streaks on the basis of the method described in Patent Literature 4 that is designed for the use of pigment inks, the method demonstrates poor convenience in most cases. Thus, the fixing time is long and the method cannot be adapted to distribution, e.g. of flyers and catalogs, immediately after recording.

Various attempts have been made to improve drying ability and fixing ability of ink prints immediately after recording. In particular, when application of ink jet technology to consumer-oriented products was started, thermal drying was considered to be effective for improving drying ability of inks and recording media. For example, Patent Literature 5 suggests that the image be heated and fixed after recording is performed using colored resin particles dispersed in the form of fine particles. However, this suggestion is mainly aimed at the reduction of blurring in paper that runs easily such as recycled paper and copy paper, and the object of fixing is also paper with comparatively rapid absorption of ink such as recycled paper and copy paper.

Further, Patent Literature 6 describes using a heating roller as a drying aid means for ink prints, but the attention is mainly focused on dye-based oily inks, and application to aqueous pigment inks and commercial-grade paper is not disclosed.

Patent Literature 7 suggests a method for heating a recording media on which ink jet recording has been completed from a rear surface in order to enhance drying and thereby improve fixing ability. This document describes that drying and fixing are enabled by heating from the rear surface. However, with the suggested method, because the image is not heated directly, thermal efficiency is extremely poor in many cases, and although the method is effective in the case of drying a large amount of moisture contained in the entire recording medium after recording, in most cases practically no effect is demonstrated with respect to a wetting agent (solvent with a high boiling point) contained in the image. Further, in order to dry solvents with a high boiling point, heating at a high temperature of hundred and several tens of degrees is generally required, the specific temperature depending on the solvent type. Accordingly, damage to the recording media, such as paper yellowing and deformation and, in the worst case, inflammation cannot be ignored and such method is absolutely unsuitable for practical use.

In the past, products using the aforementioned technique to enhance drying on the usual paper in ink jet printers using aqueous inks have been marketed. However, in the case of ink jet recording, by contrast with electrophotography, a large amount of moisture contained in the ink is converted into water vapor that fills the inside of the apparatus, easily causing condensation and corrosion. Further, in recording on usual paper and special paper for ink jet recording, drying enhancement means becomes unnecessary. For these reasons, such products are presently not used, with the exception of very few commercial printers that require extremely high-speed recording on the usual paper.

Further, a problem arising when drying of an ink print is performed using a drying method represented by the method described in Patent Literature 7 is that a surface is locally melted and an image is burnt at special paper for ink jet printing.

Patent Literature 8 suggests a method for heating image-receiving paper containing a thermoplastic resin in the outer surface layer to make it transparent and smooth, thereby imparting gloss to the ink print, and also suggests that chemical substances that react under heating be added to the ink and recording media and the reaction be induced by heating after recording to improve the image hold-out. However, these suggestions relate to a special paper for ink jet recording that implies heat treatment after recording and are not applicable to general commercial-grade paper.

Thus, ink jet printing technology including inks and recording media that can be employed for ink jet printing and fixing on a commercial-grade paper with aqueous pigment inks and enable the use of the print immediately after the printing has not yet been realized.

(Patent Literature 1)

Japanese Patent Applications Laid-Open (JP-A) No. 2005-212327

(Patent Literature 2)

Japanese Patent Applications Laid-Open (JP-A) No. 11-078225

(Patent Literature 3)
Japanese Patent Applications Laid-Open (JP-A) No. 2001-347749
(Patent Literature 4)
Japanese Patent Applications Laid-Open (JP-A) No. 2007-144975
(Patent Literature 5)
Japanese Patent Applications Laid-Open (JP-A) No. 08-92513
(Patent Literature 6)
Japanese Patent (JP-B) No. 2860123
(Patent Literature 7)
Japanese Patent (JP-B) No. 2590822
(Patent. Literature 8)
Japanese Patent Applications Laid-Open (JP-A) No. 2004-209799

DISCLOSURE OF THE INVENTION

It is an object of the present invention to provide an ideal ink that enables full-color recording on a wide variety of paper grades, in particular on commercial-grade paper, has low cost, can be used in a simple manner for high-speed recording of high-quality prints that are close in texture to commercial prints, and excels in abrasion resistance on ink prints, and also to provide an ink cartridge, an ink jet recording method, and an ink jet recording apparatus.

In order to attain the above-described object, the inventors have conducted a comprehensive research of less expensive high-speed ink jet recording methods and have invented a low-cost ink jet recording method with excellent on-demand capability that is based on a novel design idea by combining a pigment ink with high permeability and a medium with low ink permeability, that is, a commercial-grade medium or a publication-grade medium coated with a white pigment and using an after-processing technology.

Thus, the inventors have found that sufficient handleability can be realized immediately after ink jet recording by combining a method capable of producing high-quality images even with a small amount of ink, while suppressing the amount of ink used, with a recording medium such that a solvent contained in an ink with ultrahigh permeability soaks thereinto within a certain rate range, but the colorant particles themselves do not permeate into the medium, forming an image, then ensuring a carrier absorption time (preliminary drying) in a contactless state, then bringing into direct contact with a heat source, and drying and fixing only the colorant forming the image, without damaging the substrate.

The present invention is based on the aforementioned finding made by the inventors, and means for resolving the above-described problems are described below.

<1> An ink jet recording method including: performing image recording on a recording medium to obtain an ink adhesion quantity of 15 g/m$^2$ or less of an ink containing at least a colorant, the recording medium having at least one coating layer on at least one surface of a substrate including cellulose pulp; and dry-to-touch drying the recorded image and bringing a heat source into direct contact with the recording medium for image fixing, wherein the recording medium is formed such that a transfer quantity of pure water into the recording medium in a contact interval of 100 ms that is measured with a dynamic scanning liquid absorptometer is 1 mL/m$^2$ or more to 30 mL/m$^2$ or less and a transfer quantity of pure water into the recording medium in a contact interval of 400 ms is 2 mL/m$^2$ or more to 35 mL/m$^2$ or less.

<2> The ink jet recording method according to <1>, wherein the heat source is a heat roller.

<3> The ink jet recording method according to one of <1> and <2>, wherein image recording is performed with an ink with a content of solids of 3% by mass or more on a recording medium such that a transfer quantity of pure water into the recording medium in a contact interval of 100 ms that is measured with a dynamic scanning liquid absorptometer is 1 mL/m$^2$ or more to 10 mL/m$^2$ or less and a transfer quantity of pure water into the recording medium in a contact interval of 400 ms is 2 mL/m$^2$ or more to 11 mL/m$^2$ or less.

<4> The ink jet recording method according to any one of <1> to <3>, wherein the fixing temperature is 100° C. or higher.

<5> The ink jet recording method according to any one of <1> to <4>, wherein the nip time of a fixing roller is 0.3 sec or more.

<6> The ink jet recording method according to any one <1> to <5>, wherein the dry-to-touch drying is performed using contactless drying unit.

<7> The ink jet recording method according to any one of <1> to <6>, including: performing image recording by spraying ink droplets onto a recording medium surface by use of an ink head having nozzles for spraying colored inks for performing color printing onto the recording medium surface; and controlling the ink adhesion quantity to within a regulation value by total quantity regulation processing.

<8> The ink jet recording method according to any one of <1> to <7>, wherein the recording medium has a substrate and a coating layer on the substrate, and the adhesion quantity of solids of the coating layer is 0.5 g/m$^2$ to 20.0 g/m$^2$.

<9> The ink jet recording method according to any one of <1> to <8>, wherein a basis weight of the recording medium is 50 g/m$^2$ to 250 g/m$^2$.

<10> The ink jet recording method according to any one of <1> to <9>, wherein the coating layer of the recording medium comprises a pigment, and the pigment is kaolin.

<11> The ink jet recording method according to any one of <1> to <9>, wherein the coating layer of the recording medium comprises a pigment, and the pigment is calcium bicarbonate.

<12> The ink jet recording method according to any one of <1> to <11>, wherein the coating layer of the recording medium comprises an aqueous resin.

<13> The ink jet recording method according to <12>, wherein the aqueous resin is a water-soluble resin or a water-dispersible resin.

<14> The ink jet recording method according to any one of <1> to <13>, wherein the ink is of at least one kind selected from cyan ink, magenta ink, yellow ink, and black ink.

<15> The ink jet recording method according to any one of <1> to <14>, including performing image recording on the recording medium by applying a stimulus to the ink and causing the ink to fly.

<16> The ink jet recording method according to <15>, wherein the stimulus is at least one selected from heat, pressure, vibrations, and light.

<17> The ink jet recording method according to any one of <1> to <16>, wherein an ink repellant layer is formed on a surface where an opening of ink ejection of the ink head is formed.

<18> The ink jet recording method according to <17>, wherein the ink repellant layer comprises any one of a fluorine-containing material and a silicone-based material.

<19> The ink jet recording method according to one of <17> and <18>, wherein a surface roughness Ra of the ink repellant layer is 0.2 μm or less.

<20> The ink jet recording method according to any one of <17> to <19>, wherein a cross section area in a plane perpendicular to a central line of an opening of the ink repellant layer in the vicinity of the opening is so formed as to increase successively with the distance from the base material surface.

<21> The ink jet recording method according to any one of <17> to <20>, wherein a thickness of the ink repellant layer is 1 Å or more.

<22> The ink jet recording method according to any one of <17> to <21>, wherein a critical surface tension γc of the ink repellant layer is 5 mN/m to 40 mN/m.

<23> The ink jet recording method according to any one of <1> to <22>, wherein the ink comprises at least water, a wetting agent, and a powdered colorant.

<24> An ink for use in the ink jet recording method according to any one of <1> to <23>, the ink including water, a wetting agent, and a powdered colorant.

<25> The ink according to <24>, wherein the colorant is a pigment or colored fine particles, and the volume-average particle size of the colorant is 0.01 μm to 0.16 μm.

<26> The ink according to one of <24> and <25>, wherein the ink has a viscosity at 25° C. of 1 cps or more to 30 cps or less.

<27> The ink according to any one of <24> to <26>, wherein the ink has a surface tension at 25° C. of 30 mN/m or less.

<28> The ink according to any one of <24> to <27>, including a penetrating agent, wherein the penetrating agent is any one of a polyol compound comprising eight or more carbon atoms and a glycol ether compound.

<29> The ink according to <28>, wherein the polyol compound comprising eight or more carbon atoms is at least one of 2-ethyl-1,3-hexanediol and 2,2,4-trimethyl-1,3-pentanediol.

<30> The ink according to any one of <24> to <29>, further including a surfactant, and the surfactant is at lest one selected from compounds represented by General Formulas (I), (II), (III), (IV), (V), and (VI) below:

$$R^1—O—(CH_2CH_2O)_hCH_2COOM \qquad \text{General Formula (I)}$$

where, $R^1$ represents an alkyl group; h represents an integer of 3 to 12; M represents at least one base selected from an alkali metal ion, quaternary ammonium, quaternary phosphonium, and alkanolamine;

General Formula (II)

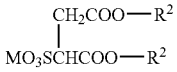

where, $R^2$ represents an alkyl group; M represents a base selected from an alkali metal ion, quaternary ammonium, quaternary phosphonium, and alkanolamine;

General Formula (III)

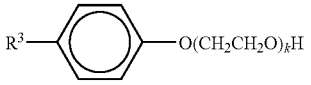

where, $R^3$ represents a hydrocarbon group; k is an integer of 5 to 20;

$$R^4—(OCH_2CH_2)_jOH \qquad \text{General Formula (IV)}$$

where, $R^4$ represents a hydrocarbon group; j is an integer of 5 to 20;

General Formula (V)

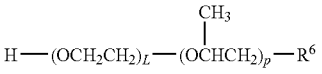

where, $R^6$ represents a hydrocarbon group; L and p are integers of 1 to 20; and General Formula (VI)

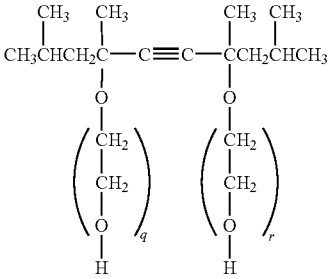

where, q and r are integers of 0 to 40.

<31> The ink according to any one of <24> to <30>, wherein the wetting agent is at least one selected from a polyol compound, a lactam compound, a urea compound, and a saccharide.

<32> The ink according to <31>, wherein the polyol compound is at least one selected from glycerin, ethylene glycol, diethylene glycol, triethylene glycol, tetraethylene glycol, polyethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,4-butanediol, 1,5-pentanediol, 1,6-hexanediol, 2-methyl-2,4-pentanediol, 1,2,4-butanetriol, 1,2,6-hexanetriol, thiodiglycol, pentaerythritol, trimethylolethane, and trimethylolpropane.

<33> The ink according to one of <31> and <32>, wherein the lactam compound is of at least one kind selected from 2-pyrrolidone, N-

<34> The ink according to any one of <31> to <33>, wherein the urea compound is at least one selected from urea, thiourea, ethylene urea, and 1,3-dimethyl-2-imidazolidinone.

<35> The ink according to any one of <31> to <34>, wherein the saccharide is at least one selected from maltitose, sorbitose, gluconolactone, and maltose.

<36> The ink according to any of <31> to <35>, wherein a content of the wetting agent in the ink is 10% by mass to 50% by mass.

<37> An ink cartridge including a container, and the ink according to any one of <24> to <36> stored in the container.

<38> An ink jet recording apparatus including: an ink head that ejects ink and performs image recording on a recording medium at an ink adhesion quantity of 15 g/m$^2$ or less; a drying unit configured to dry-to-touch dries the image on the recording medium; and a fixing unit configured to fix the image, wherein the recording medium has at least one coating layer on at least one surface of a substrate comprising cellulose pulp and is formed such that a transfer quantity of pure water into the recording medium in a contact interval of 100 ms that is measured with a dynamic scanning liquid absorptometer is 1 mL/m$^2$ or more to 30 mL/m$^2$ or less and a transfer quantity of pure water into the recording medium in a contact interval of 400 ms is 2 mL/m$^2$ or more to 35 mL/m$^2$ or less, and wherein the ink comprises at least a powdered colorant; and the fixing unit has a fixing roller for which a heat source is a heat roller.

<39> The ink jet recording apparatus according to <38>, wherein the fixing unit is a fixing apparatus equipped with a temperature control device which has a heater that can be selectively switched between a full-length heat generation state in which heat is generated over the entire length of at least one roller of a pair of rollers that are pressed against each other and a partial heat generation state in which only a predetermined portion generates heat, and which performs fixing by controlling the roller temperature by detecting the roller surface temperature with one temperature sensor and turning the heater on and off and squeezing and conveying the recording medium carrying an unfixed image with the pair of rollers, and wherein when the fixing apparatus equipped with a temperature control device is started or in a standby state, the heater is in the full-length heat generation state and controlled by the temperature control device by detecting the roller surface temperature with the temperature sensor, and when paper is passed to the pair of rollers, the heater is controlled by detecting the roller surface temperature with the temperature sensor and switching between the full-length heat generation state and partial heat generation state for each predetermined interval in a range in which the heater can be conductive, and the predetermined interval is set according to the size of the paper.

<40> The ink jet recording apparatus according to one of <38> and <39>, wherein an ink repellant layer is formed on a surface where an opening of ink ejection of the ink head is formed.

<41> A fixing temperature control device for use in the ink jet recording apparatus according to any of <38> to <40>, that is for an fixing apparatus which has a heater that can be selectively switched between a full-length heat generation state in which heat is generated over the entire length of at least one roller of a pair of rollers that are pressed against each other and a partial heat generation state in which only a predetermined portion generates heat, and which performs fixing by controlling the roller temperature by detecting the roller surface temperature with one temperature sensor and turning the heater on and off and squeezing and conveying the recording medium carrying an unfixed image with the pair of rollers, wherein in a start-up state or a standby state, the heater is in the full-length heat generation state and controlled by detecting the roller surface temperature with the temperature sensor, and when paper is passed to the pair of rollers, the heater is controlled by detecting the roller surface temperature with the temperature sensor and switching between the full-length heat generation state and partial heat generation state for each predetermined interval in a range in which the heater can be conductive, and the predetermined interval is set according to the size of the paper.

BRIEF DESCRIPTION OF DRAWINGS

FIG. 30 is a an example of a recording ink combination table (first table);

FIG. 33 is a recording ink combination table (second table) used in accordance with the present invention;

FIG. 34 is a recording ink combination table (second table) used in accordance with the present invention;

FIG. 35 is a recording ink combination table (second table) used in accordance with the present invention;

BEST MODE FOR CARRYING OUT THE INVENTION

Ink Jet Recording Method

Figure 1:
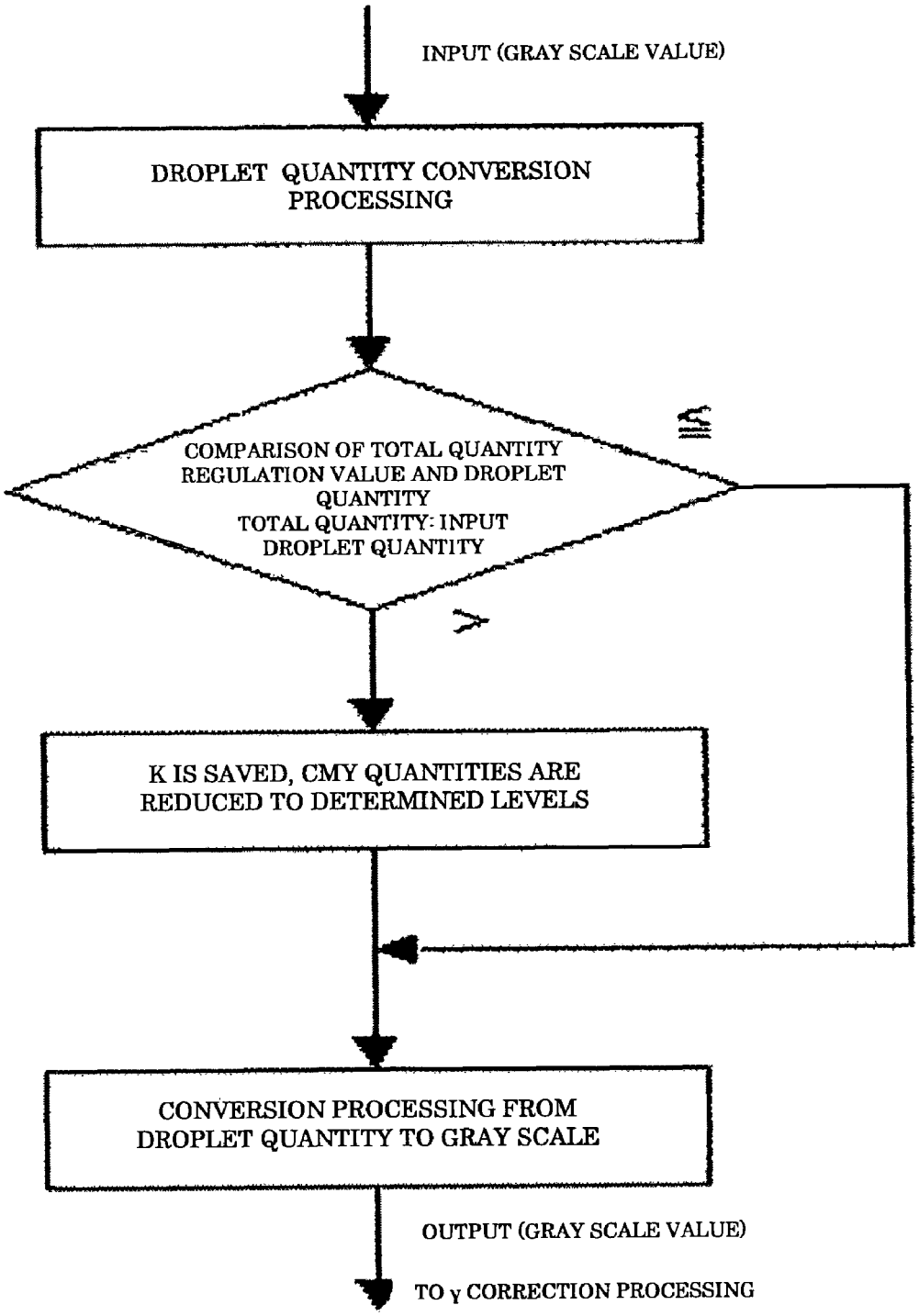
FIG. 1 is a flowchart illustrating the flow of total regulation processing in accordance with the present invention.

The ink jet recording method in accordance with the present invention comprises at least an image recording step of performing image recording on a recording medium having at least one coating layer on at least one surface of a substrate comprising cellulose pulp to obtain an ink adhesion quantity of 15 g/m$^2$ or less of an ink containing at least a colorant, and a fixing step of dry-to-touch drying the recorded image and then fixing by bringing a heat source into direct contact with the recording medium, and optionally including other steps.

When high-speed formation of images by ink jet recording is desired to be performed without cost increase, the most effective conventional approach involves increasing the size of ink droplets used and decreasing resolution. Thus, images that have been produced at 1200 dpi are reduced in resolution to 600 dpi. An ink droplet weight to be set to obtain 600 dpi in this process is usually determined assuming that recording will be performed on a recording medium that absorbs ink. When a two-fold dot diameter is wished to be reproduced when forming a dot with a droplet, a droplet with approximately two-fold diameter is ejected. In this process, images are formed so that the adjacent dots slightly overlap to improve the embedding of ink. Assuming that an ink droplet is a sphere, increasing the droplet diameter by a factor of two means that the droplet weight increases by a factor of about 2.8. Therefore, decreasing resolution by half is very disadvantageous from the standpoint of ink absorption. When such a method is applied to a recording medium with slow ink absorption, such as offset printing paper that is coated with ink having low viscosity and permeability and easily miscible with other colors, the adjacent dots are simply fused together, causing beading and bleeding of color boundaries. Where a gap is provided between the adjacent dots to prevent them from fusing together, image quality is greatly reduced because no ink embeds into the medium between the dots and image density decreases or graininess becomes visible. Further, when secondary and tertiary colors are produced, control is performed to avoid, as effectively as possible, placing the dots to the same address on the produced image, but because of a problem associated with dot position accuracy, the dots land to apparently the same address. Moreover, when a high-density image is desired, ink dots have to be placed to the same address, whereby bleeding and beading are gradually intensified.

The ink used in accordance with the present invention was created with consideration for these issues. This ink is superior to the usual ink jet inks in wetting ability because it has a lower surface tension, demonstrates strong permeation ability of carrier even into a recording medium with few pores, and demonstrates significant increase in ink viscosity even upon permeation of a microamount of carrier. As a result, the adjacent dots have high resistance to fusion after landing on a medium, and stable dot formation is enabled even on a recording medium with a significantly degraded permeability on which the adjacent dots conventionally were easily fused into one. Further, because the colorant remains on the surface, practically without any penetration into the recording medium, it is hardly necessary to place the droplets one on top another at the same address and sufficient coloration and image density can be obtained even with very small total amount of ink.

The image can thus be formed with a total amount of ink that is greatly reduced by comparison with the conventional one. As a result, the amount of carrier that has to penetrate into the recording medium is reduced, curling and cockling are presented, and the rigidity of paper after recording is practically the same as that before the recording. Therefore, recording without damaging a substrate can be performed even on a recording medium for which ink absorption is not taken into account, such as commercial-grade paper.

Where carrier absorption is completed after the ink droplets have been placed on the medium surface, the colorant is set in a state in which it contains a microamount of a wetting agent. This state is identical to that immediately after offset printing using ink containing soybean oil. In this state the image is not smeared when lightly touched, but rubbing or application of high pressure causes image transfer. In accordance with the present invention, a temperature of 100° C. or higher is applied to the image (colorant) by direct contact with a heat source in this state, whereby only the wetting agent contained in the colorant diffuses effectively into the medium and fixing is completed within a very short period, without offsetting the colorant. When such a technique is used with respect to the conventional pigment ink, the application is difficult because of intensive colorant transfer to the heating member, but because the ink used in accordance with the present invention has a small surface tension in addition to a high cohesion force, colorant transfer onto the contact member hardly occurs and the heating-induced fixing can be performed with the contact member.

Heating by direct contact is most effective as a heating-induced fixing method because heat efficiency is high and only the wetting agent present in the colorant is heated. Further, because only the colorant may be heated and there is absolutely no need to dry the entire recording medium, problems associated with substrate damage or condensation of water vapor can be also prevented.

Whether a recording medium is adequate as a recording medium for use in accordance with the present invention can be judged by using as an indicator a transfer quantity of pure water determined by dynamic scanning liquid absorptometer. Thus, a transfer quantity of pure water into the recording medium in a contact interval of 100 ms that is measured with a dynamic scanning liquid absorptometer is 1 mL/m$^2$ or more to 30 mL/m$^2$ or less and a transfer quantity of pure water into the recording medium in a contact interval of 400 ms is 2 mL/m$^2$ or more to 35 mL/m$^2$ or less. The coating layer of the recording medium satisfying this condition apparently has a function of the coating layer in accordance with the present invention, and combining such coating layer with the ink in accordance with the present invention makes it possible to obtain a recording medium with a high optical density (OD) that has the so-called "contour" of good quality and has no blurring, feathering, or bleeding in the circumferential portions of letters or images. Where the amount of absorbed water is higher than the aforementioned level, colorant soaking into the layer or substrate occurs, the colorant is hidden by the coating layer pigment, and high-density image is not obtained.

The coating layer of such recording medium contains a binder resin and a pigment as the main components, and the composition thereof can be adjusted in the direction of reducing the transfer quantity by increasing the compounded quantity of resin or in the direction of increasing the transfer quantity by increasing the compounded quantity of the pigment. Further, the transfer quantity can be also increased by increasing the specific surface ratio of pigment particles constituting the coating layer, for example, by decreasing the particle size or using a pigment of a kind having a large specific surface area.

A function necessary for the coating layer of the recording medium and ink jet image recording method in accordance with the present invention is the ability to separate the pigment and solvent contained in the ink and cause the permeation of solvent alone into the substrate. Accordingly, it is preferred that the coating layer have a fine structure having pores. Where absolutely no fine structure is present in the coating layer, permeation of the solvent component contained in the ink is delayed and the ink can easily remain non-dried. On the other hand, if the amount of fine structure is too large, a function of separating the colorant pigment contained in the ink is degraded and image density is decreased or the pigment present on the surface of the recording medium surface after recording migrates into the recording medium with time, thereby causing discoloration. If such conditions are satisfied, the so-called commercial-grade paper and publication-grade paper can be also used.

In the recording medium, the transfer quantity of the ink in accordance with the present invention to the recording medium within a contact interval of 100 ms that is measured with a dynamic scanning absorptometer is 2 mL/m$^2$ to 40 mL/m$^2$, preferably 3 mL/m$^2$ to 30 mL/m$^2$. Further, the transfer quantity of pure water to the recording medium is preferably 1 mL/m$^2$ to 30 mL/m$^2$, more preferably 1 mL/m$^2$ to 10 mL/m$^2$.

Where the transfer quantities of the ink and pure water within a contact interval of 100 ms is too small, beading easily occurs, and if the transfer quantities are too larger, the diameter of ink dots after recording is sometimes too small by comparison with the desired diameter.

The transfer quantity of the ink in accordance with the present invention to the recording medium within a contact interval of 400 ms that is measured with a dynamic scanning absorptometer is 3 mL/m$^2$ to 50 mL/m$^2$, preferably 4 mL/m$^2$ to 40 mL/m$^2$.

Further, the transfer quantity of pure water to the recording medium is preferably 2 mL/m$^2$ to 35 mL/m$^2$, more preferably 2 mL/m$^2$ to 11 mL/m$^2$.

Where the transfer quantity within the contact interval of 400 ms is too small, drying ability is insufficient and spur tracks sometimes easily occur. Where the transfer quantity is too large, bleeding easily occurs and gloss of the image portion after drying sometimes easily decreases.

The aforementioned dynamic scanning absorptometer (DSA, Shipa Gikyoshi, Vol. 48, May 1994, pp. 88-92, Shigenori KUGA) is a device that can accurately measure the quantity of liquid absorbed within a short interval. The dynamic scanning absorptometer performs automated measurements by a method according to which the speed of absorbed liquid is directly read from the transfer of meniscus in a capillary tube, a round disk-like sample is used, and a liquid absorption head is spirally scanned thereabove, the scanning rate is changed automatically according to the preset pattern, and measurements are performed for a necessary number of points in one sample. The head for feeding liquid to the paper sample is connected to a capillary tube via a Teflon® tube, and the position of meniscus in the capillary tube is read automatically with an optical sensor. More specifically, the transfer quantity of pure water and ink are measured using a dynamic scanning absorptometer (K350 Series D, manufactured by Kyowa Seiko KK). The transfer quantity at a contact time of 100 ms and a contact time of 400 ms can be found by interpolation from the measured values of transfer quantities relating to contact times close to these contact times. The measurements are conducted at 23° C. and 50% RH.

In accordance with the present invention, the total quantity of ink has to be strictly limited in order to prevent the colorant present in the ink from permeating and ensure effectively the segregation of the colorant in the vicinity of the recording medium surface and, at the same time, the sufficient drying ability of the ink. The total quantity of ink is an important parameter in image formation and indicates the quantity of ink per unit surface area when a solid image with the highest concentration is formed. In accordance with the present invention, by regulating the total quantity of ink it is possible to form uniform images with small beading or bleeding even on a medium with poor ink absorption. Conversely, when this upper limit is exceeded, and a large quantity of ink is used, as in the conventional ink jet recording, the colorant pigment of the ink permeates into paper together with the ink solvent of permeation of solvent component of the ink is insufficient, thereby hindering image formation and making it impossible to obtain images of good quality.

More specifically, when the ink in accordance with the present invention is used, the maximum ink adhesion quantity during image recording (in total quantity regulated value) is 15 g/m$^2$ or less. By forming images at an ink adhesion quantity of 15 g/m$^2$ or less, it is possible to obtain images of extremely high quality that are free from beading or bleeding. An ink adhesion quantity of 12 g/m$^2$ or less is even more preferred.

This can be explained as follows. By contrast with the conventional combinations of dye inks and special media for ink jet printing, in the case of the pigment ink and medium of the present invention, the colorant is present in a state of accumulation in the medium surface, and where the colorant is present in an amount necessary to cover the surface of the recording medium, not only no additional colorant is needed, but with the high-permeation ink in accordance with the present invention, the extra ink solvent will interfere with the adjacent dots, causing beading and bleeding.

Even with the ink in accordance with the present invention, if the regulation value of the total ink quantity is set high as in the conventional ink jet recording, a large quantity of ink is used in the solid portions and shadow portions, colorant separation capability of the recording medium is exceeded, the image blurs, and drying ability is greatly decreased.

The total ink quantity for use in image formation in accordance with the present invention is extremely small by comparison with that of the conventional ink jet recording method even when image density is necessary, and it is easier for the colorant to spread uniformly in the medium surface when the ink absorption ability of the medium itself is low, by contrast with the conventional ink jet media. In other words, the ink spreads thinly on the medium surface and, therefore, drying can be performed despite a low ink absorption performance, and beading and bleeding hardly occur.

The carrier permeation quantity can be easily adjusted by the quantity of penetrating agent (EHD) and the amount of fluorine-containing surfactant (for example, FS-300; manufactured by Du Pont Corp.) added. Further, by decreasing the total quantity of ink necessary for recording, it is possible to reduce the capacity of ink cartridge by comparison with the conventional ink cartridge and to increase the compactness of the apparatus. When the cartridge of a conventional size is used, the ink cartridge replacement frequency can be reduced and recording can be performed at a lower cost.

Basically the smaller is the total amount of ink, the better pigment separation ability is demonstrated by the coating layer, but if the total ink quantity is too small, there is a side effect of the diameter of image dots after recording being too small. Therefore, the total ink quantity is preferably set within the suitable range according to the target image.

The "total quantity regulation" processing will be explained below.

The total quantity regulation processing is a processing shown in FIG. 1. The total quantity regulation value as referred to herein is an ink droplet quantity determined based on evaluation results so as to prevent phenomena caused by excess adhesion of ink, for example, ink beading, rubbing caused by decrease in cockling resistance, transfer, and paper clogging.

As for the method for determining the total quantity regulation value, it can be represented, for example, by a droplet quantity (units; pL) in a mask size of 100×100 at 600×600 dpi.

Tests performed by the inventors demonstrated that a droplet quantity almost identical to the total quantity regulation value for the usual paper and about 55% the total quantity regulation value in the matter gloss paper is appropriate as a total quantity regulation value in the case of performing printing on the recording medium in accordance with the present invention. Further, the total quantity regulation processing is actually performed, for example, when the droplet quantity obtained, from the input value is larger than the total quantity regulation value, and in this case, the droplet quantity of Bk ink is saved, and processing inhibiting the droplet quantity to the total quantity regulation value or below it is performed by reducing the droplet quantity of inks of CMY colors.

In the present invention, the total ink quantity is measured by a mass method. More specifically, a rectangular solid image of 5 cm×20 cm is recorded with the highest density on a SuperFine Special paper (manufactured by Epson Co., Ltd.) that is paper specially designed for ink jet recording, a mass is measured immediately after the recording, a mass before the recording is subtracted from the measurement result, and the value obtained is multiplied by 100 to obtain a total ink quantity.

<Heat Treatment>

Figure 2:
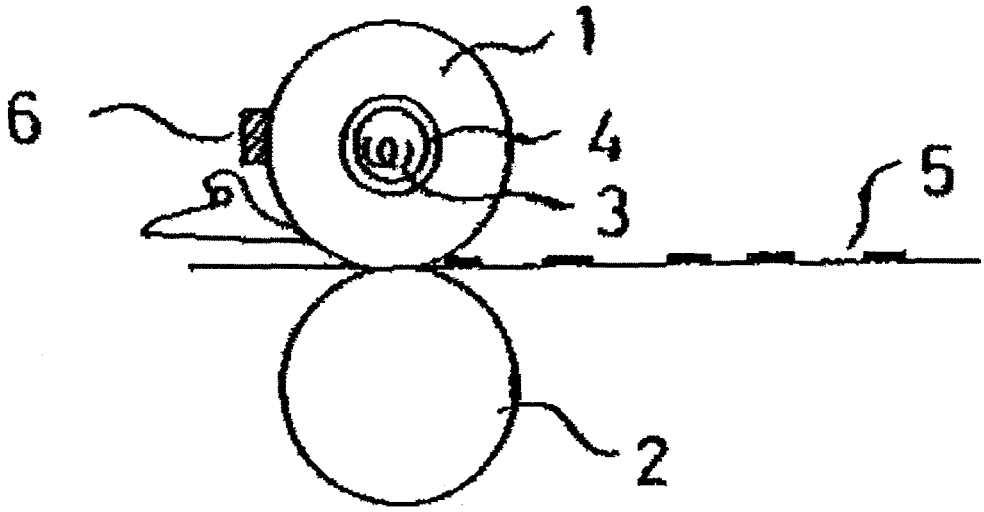
FIG. 2 illustrates a conventional fixing apparatus of a heat fixing system.

A conventional unit can be used as a fixing device that performs heating in direct contact with the image. In particular, a heat roller fixing device shown in FIG. 2 is especially effective. In this device paper 5 carrying a non-fixed image is supported and conveyed by a pair of rollers of which at least one incorporates a heater 4 having a heat-generating filament 3 along the entire length of the roller, these two rollers 1, 2 being pressed against each other, and the image is fixed to the paper. A heating and fixing method using a heating roller is most widely used in copiers and the like because of high thermal efficiency and safety. With this method, an image is heated and fixed to a support by pressing two rollers against each other, heating at least one of the rollers, and passing a support carrying the image (recording paper) into a contact portion (nip portion) of the two rollers. When one of the two rollers is heated, the heated roller is called a fixing roller, and the other roller is called a pressure roller. Inside the fixing roller, a heat source such as a halogen lamp or an electric heater is installed in the axial direction of the fixing roller. A temperature sensor is attached to the external surface of the fixing roller, and the power supplied to the heat source is controlled to maintain the nip portion temperature at a level suitable for fixing.

Figure 3:
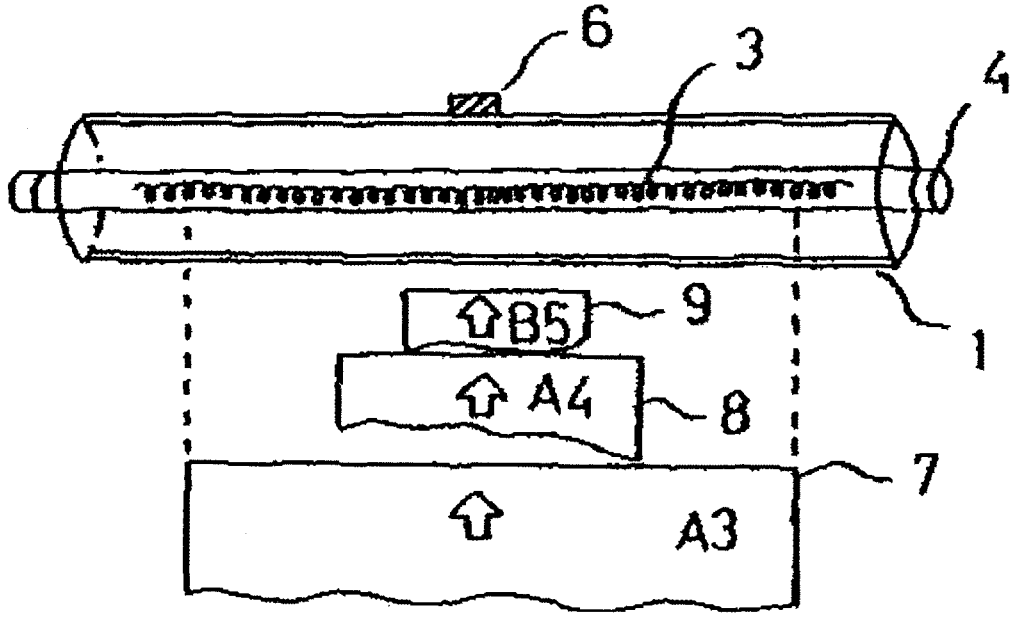
FIG. 3 illustrates a heater of the conventional heat roller fixing apparatus.

In the heater, the surface temperature of the roller is detected by a temperature detection unit 6 such as a thermistor brought into contact with the peripheral surface of the roller incorporating the heater, and the heater is ON/OFF controlled to maintain the predetermined temperature. In this case, in the heater of the heat roller fixing device, as shown in FIG. 3, the heater 4 having one heat-generating filament 3 along the entire length is contained inside the fixing roller 1, and the heat-generating filament 3 is ON/OFF controlled by signals of the temperature detection unit 6 that is brought into contact with the peripheral surface of the roller in the vicinity of the center in the lengthwise direction of the fixing roller.

In the conventional fixing devices of such heating and fixing system, it is difficult to maintain uniform temperature distribution in the axial direction. In a region through which a small-size material such as recording paper of B5 size or A4 size passes (paper passage region), heat is consumed on heating the material to be heated, but in a no-passage region, the heat is not consumed on heating the material and is, therefore, accumulated. The temperature of the nip portion in the no-passage region becomes higher than the temperature of the nip portion of the passage region that is maintained and controlled for a predetermined level.

For this reason, in the case where a large-size material to be heated is passed after small-size material has been passed in a continuous mode (for example, when A3-size paper is passed after A4-size paper has been passed in a continuous mode), uneven fixing or wrinkles sometimes appear on the large-size material. Other problems include adhesion of the colorant to the fixing roller and contamination of the material surface (this phenomenon is called "hot offset").

Figure 4A:
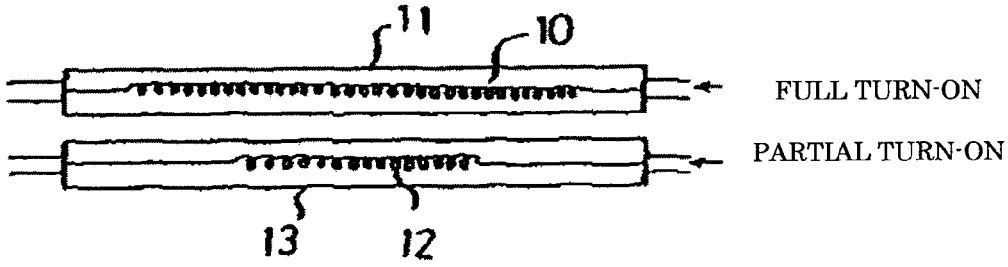
FIG. 4A illustrates an example of a heater of a two-heater system of a heat roller fixing apparatus.
Figure 4B:
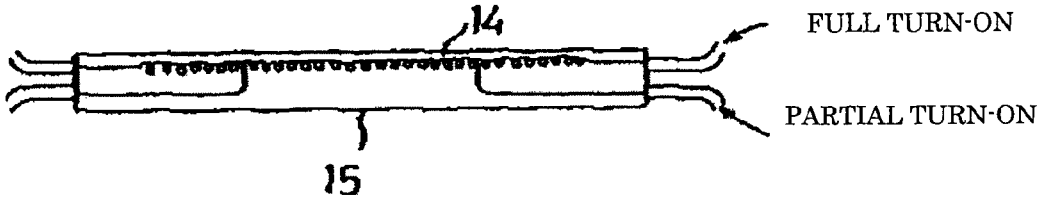
FIG. 4B illustrates another example of a heater of a two-heater system of a heat roller fixing apparatus.
Figure 5:
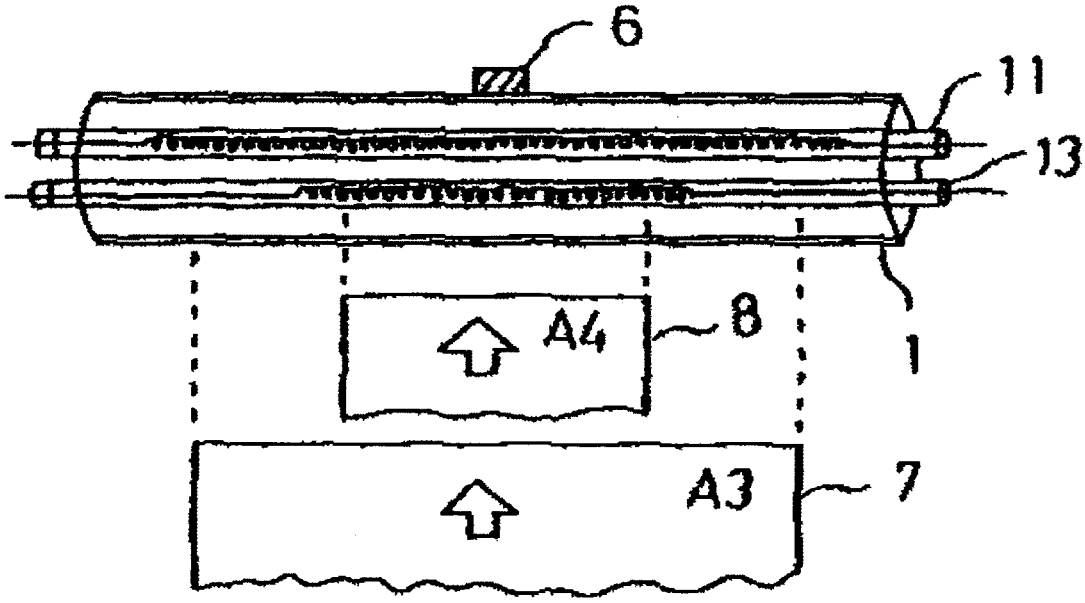
FIG. 5 shows the relationship between the paper passage width and a heater of a two-heater system.

With the object of resolving the above-described problems, a heater in which the heat generation length can be switched according to the paper width and a roller using such a heater can be employed. FIG. 4A and FIG. 4B show the configuration of such heater and roller. Referring to FIG. 4A, two heaters, namely, a heater 11 in which the length of a heat-generating filament 10 is longer than the width of the largest-size paper and a heater 13 in which the heat-generating filament 12 has a short length and located only in the central portion are provided inside the fixing roller 1, as shown in FIG. 5, and a full turn-on mode and partial turn-on mode are switched by switching the heaters used. An example shown in FIG. 4B illustrates a dual-filament heater 15 in which branch circuits are provided at both end portions of a segment of predetermined length in the central portion of the heat-generating filament 14 and switching from the full turn-on mode to the partial turn-on mode is performed using the same filament. In this case, the heat generation length in a full turn-on mode is also set larger than the width of the maximum-size paper. The heat generation length in the partial turn-on mode is somewhat longer than the width of the small-size paper.

FIG. 5 shows the relationship between the heater of a dual-heater system and the paper width. With this system as well as with the dual-filament system, ON/OFF control is carried out with the temperature detection unit 6, for example a thermistor provided in contact with the central portion of the roller, so that a full turn-on circuit is turned on when large-size paper 7 is passed and so that a partial turn-on circuit is turned on when small-size paper 8 is passed.

No specific limitation is placed on a material of the fixing roller surface, provided that this material has ink repellency and thermal stability, and this material can be appropriately selected according to the object. Examples of suitable materials include silicone, silicone, rubber, fluororesins such as Teflon®, urethane rubber, natural rubber, and silicone resins and fluororesins having excellent parting ability with the metal roller. These materials are coated on the roller.

Such thermal fixing device can be integrated with a printer or be provided as a separate unit that can be connected to the printer for use, when necessary.

After an image has been recorded with the printer and before the image is fixed with the thermal fixing device, the carrier contained in the ink has to permeate to a certain degree into the paper. Thus, water or low-viscosity solvent container in the ink has to be caused to permeate into the paper, thereby increasing viscosity to obtain a state in which the colorant present on the medium is not transferred to the heating member. For this purpose, a dry-to-touch drying time of several seconds has to be ensured immediately after the recording.

When the recording medium for use in accordance with the present invention is employed, the dry-to-touch drying time is preferably ensured to be 5 sec or more, more preferably 15 sec or more (at 25° C. and 50% RH) after the ink is placed on the recording medium. A longer time can be selected, but because this time affects productivity, a shorter time is preferred. In order to shorten this time, it is effective to add heat from the outside. Well-known contactless heating such as that provided by a hot-air drier, a hair drier, or microwaves can be used. A commercial hot-air generator (manufactured by Tsunashima Seisakusho KK) may be used, and a hair drier can be also used.

When hot air is used, no effect can be expected at a temperature of 40° C. or less. On the other hand, when the air temperature is too high, the recording medium is damaged. Therefore, the preferred temperature is 180° C. or less.

As a condition for the ink used in accordance with the present invention, it is preferred that the ink contain a resin component that enhances the fixing of pigment. A resin component that enhances the fixing is a component that ensures a bonding strength between the pigment and the recording medium surface or between the particles of colorant pigment that is equal to or higher than a predetermined level. Where no such resin component is present, the colorant pigment easily peels off. Therefore, when a high image reliability is necessary, a fixing agent has to be used. A fixing component may be present in the ink independently, or may be adsorbed and chemically bonded to the surface of colorant particles. A low-molecular component may be used as the fixing agent, but a resin, a resin emulsion, or a UV-curable resin is preferred.

A very high permeation ability is a mandatory condition for the pigment ink in accordance with the present invention, and this condition was determined to be represented by a surface tension of 30 mN/m or less. Where the surface tension is more than 30 mN/m, ink permeation is delayed and image blurring phenomenon occurs. As a result, high-quality image cannot be obtained. Because separation ability of pigment and solvent increases with the decrease in surface tension, a lower surface tension is preferred. Surface tension of the ink can be easily adjusted by varying the amount of the penetrating agent and the amount of fluorine-containing surfactant that is added (for example, FS-300; Du Pont Corp.).

The ink used in accordance with the present invention can be also employed for recording on the conventional porous media designed for ink jet recording. However, because the ink absorption rate is higher than that in the case of recoding on the recording medium in accordance with the present invention, after an ink droplet lands on the recording medium surface, the solvent permeates into the medium and dot diameter decreases before the dot wets the medium and spreads. As a result, decrease in density or increase in graininess easily occur. For this reason, in order to produce high-quality images, it is necessary to performed recording with a resolution higher than that required for the recording medium in accordance with the present invention. As a result the recording rate decreases and ink consumption rises. Therefore, it is preferred that the recording medium in accordance with the present invention be used.

The ink preferably has a surface tension of 30 mN/m or less, more preferably 15 mN/m to 30 mN/m, and even more preferably 15 mN/m to 25 mN/m at 25° C. Where the surface tension is less than 15 mN/m, the ink does not wet the nozzle plate in accordance with the present invention, and ink droplets (particle formation) is not effective, oozing at the recording medium becomes significant, and stable ink ejection cannot be obtained. On the other hand, where the mN/m exceeds 30 mN/m, sufficient ink permeation into the recording medium does not occur, beading can occurs, and drying time is sometimes extended.

Here, the surface tension can be measured, for example, using a surface tension measurement device (CBVP-Z, manufactured by Kyowa Interface Science Co., Ltd.) and a platinum plate at a temperature of 25° C.

The content of solids in the ink in accordance with the present invention is preferably 3% by mass or more, more preferably 5% by mass to 15% by mass. Where the concentration of solids is below this range, viscosity increase during drying is slowed and the image tends to blur easily. The higher is the concentration of solids, the better, but where it is too high, nozzle clogging becomes significant and blanks zones easily occur in the image.

<Recording Medium>

The recording medium has at least one coating layer on at least one surface of a substrate comprising cellulose pulp and, if necessary, other layers.

-Substrate-

No specific limitation is placed on the substrate and it can be appropriately selected according to the object. Examples of suitable materials include paper based on wood fibers and sheet substances such as non-woven fabric comprising wood fibers and synthetic fibers as the main component.

No specific limitation is placed on the paper and it can be appropriately selected from well-known paper according to the object. For example, wood pump or old paper pulp can be used. Examples of wood pulp include Broad Leaf Tree Bleached Kraft Pulp (LBKP), Needle Leaf Tree Bleached Kraft Pulp (NBKP), NBSP, LBSP, GP, and TMP.

Source materials for waste paper pulp are indicated in a Waste Paper Standard Quality Regulation List compiled by Waste Paper Recycling Promotion Center. Examples of the source materials include high-grade white paper, crude white paper, cream white paper, card paper, special white paper, medium white paper, simulation paper, color white paper, Kent paper, white art paper, special top cuttings, separated top cuttings, newspapers, and magazines. Special examples include information-related paper such as non-coated computer paper and printer paper such as thermosensitive paper or pressure-sensitive paper; office appliance waste paper such as PPC paper; coated paper such as art paper, coat paper, fine coat paper, and matted paper; waste paper or boards, for example, non-coated paper such as wood-free paper, color wood-free paper, notebook paper, letter paper, packaging paper, fancy paper, intermediate quality paper, newspapers, ground wood paper, super calender paper, simulated paper, pure white roll paper or milk cartoons, chemical pulp paper, or ground wood pulp-containing paper. These kinds of paper may be used individually or in combination of two or more thereof.

Waste paper pulp is generally manufactured by a combination of four following steps.

(1) Defiberization in which waste paper is treated into pulp and separated into fibers by mechanical force and reagents and printing ink is peeled off from the fibers.

(2) Foreign matter removal in which foreign matter (plastics and the like) and dust contained in the waste paper are removed with a screen or a cleaner.

(3). Ink removal in which printing ink that was peeled off from the fibers using a surfactant is removed from the system by a flotation method or a washing method.

(4) Bleaching in which whiteness of the fibers is increased using catalytic action or reduction action.

From the standpoint of avoiding curling after printing, it is preferred that when waste paper is mixed, the mixing ratio of waste paper pulp in the entire pulp be 40% or less.

For example, well-known conventional pigments can be used as white pigments serving as an internal additive in the substrate. Examples of white pigments include white inorganic pigments such as lightweight calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithopone, zeolites, magnesium carbonate, and magnesium hydroxide, and organic pigments such as a styrene-type plastic pigment, an acrylic plastic pigment, polyethylene, microcapsules, a urea resin, and a melamine resin. These pigments may be used individually or in combination of two or more thereof.

Examples of sizing agents of use in the papermaking process of manufacturing the substrate include neutral rosin-type agents, alkenyl succinic anhydrides (ASA), alkyl ketene dimers (AKD), and petroleum resin-based sizing agents that are used in the manufacture of neutral paper. Among them, neutral rosin sizing agents and alkenyl succinic anhydrides are especially preferred. The alkyl ketene dimers demonstrate a strong sizing effect and, therefore, can be used in a small amount, but because they easily decrease the friction coefficient of recording paper (medium) surface and increase the sliding ability of the paper, they are sometimes undesirable from the standpoint of conveying the paper during ink jet recording.

-Coating Layer-

The coating layer includes a pigment and a binder and, if necessary, a surfactant and other components.

Inorganic pigments and combinations of inorganic pigments and organic pigments can be used as the aforementioned pigments.

Examples of inorganic pigments include kaolin, talc, heavy calcium carbonate, lightweight calcium carbonate, calcium sulfite, amorphous silica, titanium white, magnesium carbonate, titanium dioxide, aluminum hydroxide, calcium hydroxide, magnesium hydroxide, zinc hydroxide, and chlorite. Among them, kaolin is especially preferred because it has excellent gloss demonstration ability and can provide appearance close to that of paper for offset printing.

Examples of kaolin include delaminated kaolin, calcined kaolin, and engineered kaolin produced by surface modification. Where gloss demonstration ability is taken into account, it is preferred that kaolin having a particle size distribution in which a ratio of particles with a diameter of 2 μm or less is 80% by mass or more take 50% by mass or more of the entire kaolin.

The amount of kaolin added is preferably 50 parts by mass or more based on 100 parts by mass of the binder. Where the amount added is less than 50 parts by mass, a sufficient effect in terms of gloss cannot be obtained. No specific restriction is placed on the upper limit of the amount added, but taking into account flowability of kaolin, in particular increase in viscosity under a high shear force, the amount of 90 parts by mass or less is more preferred from the standpoint of suitability for coating.

Examples of suitable organic pigments include aqueous dispersions of styrene-acrylic copolymer particles, styrene-butadiene copolymer particles, polystyrene particles, and polyethylene particles. The organic pigments of two or more kinds may be mixed.

The amount of organic pigment added is preferably 2 parts by mass to 20 parts with respect to 100 parts by mass of the pigment in the coating layer. The organic pigments excel in gloss demonstration ability, the specific gravity thereof is less than that of inorganic pigments, they have high bulk and gloss, and make it possible to obtain a coating layer with good surface coverability. Where the amount added is less than 2 parts by mass, no effect is attained, and where the amount added is more than 20 parts by mass, flowability of the coating liquid is degraded, causing deterioration of coating operability, and the addition is cost inefficient.

The organic pigment can be in a solid form, hollow form, or donut-like form, but in order to attain good balance of gloss demonstration ability, surface coverability, and coating liquid flowability, a hollow organic pigment with an average particle size of 0.2 μm to 3.0 μm is preferred and a hollow organic pigment with a porosity of 40% or more is even more preferred.

An aqueous resin is preferably used as the binder.

At least one resin from among water-soluble resins and water-dispersible resins can be advantageously used as the aqueous resin. No specific limitation is placed on the water-soluble resin, and it can be appropriately selected according to the object. Examples of suitable resins include polyvinyl alcohol and modification products of polyvinyl alcohol, such as anion-modified polyvinyl alcohol, cation-modified polyvinyl alcohol, and acetal-modified polyvinyl alcohol; polyurethanes; polyvinyl pyrrolidone modification products of polyvinyl pyrrolidone, such as a copolymer of polyvinyl pyrrolidone and vinyl acetate, a copolymer of vinyl pyrrolidone with dimethylaminoethyl and methacrylic acid, a copolymer of quaternized vinyl pyrrolidone and dimethylaminoethyl and methacrylic acid, and a copolymer of vinyl pyrrolidone and methacrylamidopropyl chloride trimethyl ammonium; cellulose such as carboxymethyl cellulose, hydroxyethyl cellulose, and hydroxypropyl cellulose; cellulose modification products such as cationized hydroxyethyl cellulose; synthetic resins such as polyesters, polyacrylic acid (esters), melamine resins, modification products thereof, and copolymers of polyesters and polyurethanes; poly(meth)acrylic acid, poly (meth)acrylamide, oxidized starch, phosphated starch, self-modified starch, cationized starch, various kinds of modified starch, polyethylene oxide, sodium polyacrylate, and sodium alginate. The aforementioned compound may be used individually or in combinations of two or more thereof.

From the standpoint of ink absorptivity, the especially preferred among them are polyvinyl alcohol, cation-modified polyvinyl alcohol, acetal-modified polyvinyl alcohol, polyesters, polyurethanes, and copolymers of polyesters and polyurethanes.

No specific limitation is placed on the water-dispersible resin, and it can be appropriately selected according to the object. Examples of suitable resins include, polyvinyl acetate, ethylene-vinyl acetate copolymer, polystyrene, styrene-(meth)acrylic acid ester copolymer, (meth)acrylic acid ester copolymers, vinyl acetate-(meth)acrylic acid (ester) copolymer, styrene-butadiene copolymer, ethylene-propylene copolymer, polyvinyl ether, and silicone-acrylic copolymer. The water-dispersible resin may contain a crosslinking agent such as methylolated melamine, methylolated urea, methylolated hydroxypropylene urea, and isocyanates, or may have self-crosslinking ability in the case of copolymers comprising N-methylolacrylamide units or the like. A plurality of such aqueous resins can be also used at the same time.

The added amount of the aqueous resin is preferably 2 parts by mass to 100 parts by mass, more preferably 3 parts by mass to 50 parts by mass per 100 parts by mass of the pigment. The added amount of the aqueous resin is determined so that the liquid absorption characteristic of the recording medium enter the desired range.

When a water-dispersible colorant is used as the colorant, it is not necessary that a cationic organic compound be contained, but no specific limitation is placed on the colorant, and it can be appropriately selected according to the object. For example, primary to tertiary amines, quaternary ammonium salt monomers, oligomers, and polymers that form insoluble salts by reactions with sulfonic acid groups, carboxyl groups, and amino groups contained in the acidic dyes or direct dies contained in the water-soluble ink can be used. Among them, oligomers and polymers are preferred.

Examples of cationic organic compounds include dimethylamine-epichlorohydrin polycondensate, dimethylamine-ammonia-epichlorohydrin condensate, poly(methacrylic acid trimethylaminoethyl-methyl sulfate), diallylamine, hydrochloride-acrylamide copolymer, poly(diallylamine hydrochloride-sulfur dioxide), polyallylamine hydrochloride, poly(allylamine hydrochloride-diallylamine hydrochloride), acrylamide-diallylamine copolymer, polyvinylamine copolymer, dicyandiamide, dicyandiamide-ammonium chloride-urea-formaldehyde condensate, polyalkylenepolyamine-dicyandiamidoammonium salt condensate, dimethyldiallylammonium chloride, polydiallylmethylamine hydrochloride, poly(diallyldimethylammonium chloride), poly(diallyldimethylammonium chloride-sulfur dioxide), poly(diallyldimethylammonium chloride-diallylamine hydrochloride derivative), acrylamide-diallyldimethylammonium chloride copolymer, acrylic acid salt-acrylamide-diallylamine hydrochloride copolymer, polyethyleneimine, acrylamide polymer and other ethylenimine derivatives, polyethylene imine alkylene oxide modification products and the like. These compounds may be used individually or in combination of two or more thereof.

It is preferred that from among these compounds, cationic organic compounds with a low molecular weight such as dimethylamine-epichlorohydrin polycondensate and polyallylamine hydrochloride be used in combination with cationic organic compounds with a comparatively high molecular weight, for example, poly(diallyldimethylammonium chloride). With such combined use, image density can be increased and feathering can be further decreased with respect to those attained with individual use.

A cation equivalent of the cationic organic compound determined by a colloid titration method (potassium polyvinyl sulfate and toluidine blue are used) is preferably 3 meq/g to 8 meq/g. Where the cation equivalent is within this range, good results can be obtained within the above-described range of dry adhesion quantity.

Here, when the cation equivalent is measured by the colloid titration method it is assumed that the cationic organic compound is diluted with distilled water to obtain the content of solids of 0.1% by mass and that pH adjustment is not performed.

The dry adhesion quantity of the cationic organic compound is preferably 0.3 $g/m^2$ to 2.0 $g/m^2$. Where the dry adhesion quantity of the cationic organic compound is less than 0.3 $g/m^2$, sufficient increase in image density and reduction of feathering sometimes cannot be attained.

No specific limitation is placed on the surfactant, and it can be appropriately selected according to the object. Anionic surfactants, cationic surfactants, amphoteric surfactants, and nonionic surfactants can be used. Among them, nonionic surfactants are especially preferred. By adding the surfactant, it is possible to improve the resistance of image to water, increase image density, and improve bleeding.

Examples of suitable nonionic surfactants include ethylene oxide adducts of higher alcohols, ethylene oxide adducts of alkyl phenols, ethylene oxide adducts of fatty acids, ethylene oxide adducts of polyhydric alcohol fatty acid esters, ethylene oxide adducts of higher aliphatic amines, ethylene oxide adducts of fatty acid amides, ethylene oxide adducts of oils and fats, ethylene oxide adduct of polypropylene glycol, fatty acid esters of glycerol, fatty acid esters of pentaerythritol, fatty acid esters of sorbitol and sorbitan, fatty acid esters of cane sugar, alkyl ethers of polyhydric alcohols, and fatty acid amides of alkanolamines. These compounds may be used individually or in combinations of two or more thereof.

No specific limitation is placed on the polyhydric alcohol, and it can be appropriately selected according to the object. Examples of suitable polyhydric alcohols include glycerol, trimethylolpropane, pentaerythritol, sorbitol, and cane sugar. As for ethylene oxide adducts, the effective compounds have part of ethylene oxide replaced with an alkylene oxide such as propylene oxide or butylene oxide within a range in which solubility in water is maintained. The replacement ratio is preferably 50% or less. The HLB (Hydrophile-Lipophile Balance) is preferably 4-15, more preferably 7-13.

The added amount of the surfactant is preferably 0 part by weight to 10 parts by mass, more preferably 0.1 parts by weight to 1.0 part by weight per 100 parts by mass of the cationic organic compound.

Other components can be added, if necessary, to the coating layer within the ranges in which the object and effect of the present invention are not affected. Examples of such other components include additives such as an alumina powder, a pH adjusting agent, a preservative, and an antioxidant.

No specific limitation is placed on the method for forming the coating layer, and the method can be appropriately selected according to the object. Thus, coating can be performed by a method in which a coating layer liquid is impregnated in or applied to the substrate. No specific limitation is placed on the method for impregnating or applying the coating layer liquid, and it can be appropriately selected according to the object. Thus, the coating can be performed with an appropriate coating apparatus such as a conventional size press, a gate roll size press, a film transfer size press, a blade coater, a rod coater, an air knife coater, and a curtain coater. From the standpoint of cost, impregnation or adhesion can be caused by using a conventional size press, a gate roll size press, a film transfer size press that have been installed in papermaking machines, and finishing may be performed in an on-machine mode.

No specific limitation is placed on the adhesion quantity of the coating layer liquid, and it can be appropriately selected according to the object. The adhesion quantity, measured as solids, is preferably 0.5 $g/m^2$ to 20 $g/m^2$, more preferably 1 $g/m^2$ to 15 $g/m^2$.

If necessary, drying may be performed after the impregnation or coating. No specific limitation is placed on the drying temperature in this case, and it can be appropriately selected according to the object, but the preferred drying temperature is about 100° C. to 250° C.

In the recording medium, a back layer may be formed on the rear surface of the substrate, and another layer may be formed between the substrate and the coating layer, or between the substrate and the back layer. A protective layer can be also provided on the protective layer. These layers can have a monolayer or a multilayer configuration.

The basis weight of the recording medium is preferably 50 $g/m^2$ to 250 $g/m^2$. Where the basis weight is less than 50 $g/m^2$, the recording medium lacks stiffness, and conveying abnormalities such as clogging of the conveying path by the recording medium sometimes easily occur. Where the basis weight is above 250 $g/m^2$, stiffness is too high and the recording medium does not bend in the curved sections of the conveying path, thereby causing conveying abnormalities such as clogging.

In accordance with the present invention, good images can be formed even on the presently available coated paper for printing, provided that the above-described conditions are satisfied.

Examples of the presently available coated paper include coated paper that has been used for commercial and publication printing, such as the so-called art paper (A0 size, A1 size), A2 size coated paper, A3 size coated paper, B2 size coated paper, lightweight coated paper, and microcoated paper that are suitable for offset printing, gravure printing, and the like.

As for specific products, examples of cast coated paper include Mirror Coat Platinum (manufactured by Oji Paper Co, Ltd.) and Esprit Coat C (manufactured by Nippon Paper Industries Co, Ltd.).

Examples of art paper include OK Kanefuji N, OK Kanefuji-R40N, SN Kanefuji N, Satin Kanefuji N, Satin Kanefuji-R40N, Ultra-Satin Kanefuji N, Ultra OK Kanefuji N, Kanefuji One-Side (manufactured by Oji Paper Co, Ltd.), NPi Special Art, NPi Super Art, NPi Super Dull, NPi Dull Art (manufactured by Nippon Paper Industries Co, Ltd.), Utrillo Super Art, Utrillo Super Dull, Utrillo Premium (manufactured by Daio Paper Corp.), High-grade Art A, Special Mitsubishi Art, Super Mat Art A, High-grade Dull Art A (manufactured by Mitsubishi Paper Co, Ltd.), and Raicho Super Art N, Raicho Super Art MN, Raicho Special Art, and Raicho Dull Art N (manufactured by Chuetsu Pulp & Paper Co, Ltd.).

Examples of A2 size coated paper include OK Top Coat + (plus), OK Top Coat S, OK Casablanca, OK Casablanca V, OK Trinity, OK Trinity NaVi, New Age, New Age W, OK Top Coat Matt N, OK Royal Coat, OK Top Coat Dull, Z Coat, OK Takahime, OK Takao, OK Takao Satin, OK Top Coat +, OK Non-wrinkle, OK Coat V, OK Coat N Green 100, OK Matt Coat Green 100, New Age Green 100, Z Coat Green 100 (manufactured by Oji Paper Co, Ltd.), Aurora Coat, Shiraoi matt, Imperial Matt, Silver Die, Recycle Coat 100, Cycle Matt 100 (manufactured by Nippon Paper Industries Co, Ltd.), μ Coat, μ White, μ Matt, White μ Matt (manufactured by Hokuetsu Paper Co, Ltd.), Raicho Coat N, Regina Raicho Coat 100, Raicho Matt Coat. N, Regina Raicho Matt 100 (manufactured by Chuetsu Pulp & Paper Co, Ltd.), Pearl Coat, White Pearl coat N, New V Matt, White New V Matt, Pearl Coat REW, White Pearl Coat NREW, New V Matt REW, and White New V Matt REW (manufactured by Mitsubishi Paper Co, Ltd.).

Examples of A3 size coated (lightweight coated) paper include OK Coat L, Royal Coat L, OK Coat LR, OK White L, OK Royal Coat LR, OK Coat L Green 100, OK Matt Coat L Green 100 (manufactured by Oji Paper Co, Ltd.), Easter DX, Recycle Coat L 100, Aurora L, Recycle matt L100, <SSS> Energy White (manufactured by Nippon Paper Industries Co, Ltd.), Utrillo Coat L, Matisse Coat (manufactured by Daio Paper Corp.), High-Alpha, Alpha Matt, (N) Kinmari L, Kinmari HiL (manufactured by Hokuetsu Paper Co, Ltd.), N Pearl Coat L, N Pearl Coat LREW, Swing Matt REW (manufactured by Mitsubishi Paper Co, Ltd.), Super Emine, Emine, Shaton (manufactured by Chuetsu Pulp & Paper Co, Ltd.).

Examples of B2 size coated (medium-grade coated) paper include OK Medium Grade Coat, (F) MCOP, OK Astro Gloss, OK Astro Dull, OK Astro Matt (manufactured by Oji Paper Co, Ltd.), and King O (manufactured by Nippon Paper Industries Co, Ltd.).

Examples of microcoated paper include OK Royal Light S Green 100, OK Ever Light coat, OK Ever Light R, OK Ever Green, Clean Hit MG, OK Microat Super Eco G, Eco Green Dull, OK Microcoat Matt Eco G100, OK Star Light Coat, OK Soft Royal, OK Bright, Clean Hit G, Yamayuri Bright, Yamayuri Bright G, OK Aqua Light Coat, OK Royal Light S Green 100, OK Bright (Rough Gloss), Snow Matt, Snow Matt DX, OK Takahime, OK Takayuri (manufactured by Oji Paper Co, Ltd.), Pyrenees DX, Pegasus Hyper 8, Aurora S, Andes DX, Super Andes DX, Space DX, Senu DX, Special Gravure DX, Pegasus, Silver Pegasus, Pegasus Harmony, Greenland DX100, Super Greenland DX100, <SSS> Energy Soft, <SSS> Energy Light, EE Henry (manufactured by Nippon Paper Industries Co, Ltd.), Kant Excel, Excel Super B, Excel Super C, Kant Excel Baru, Utrillo Excel, Heine Excel, Dante Excel (manufactured by Daio Paper Corp.), Cosmoes (Daishowa Paper Manufacturing Co, Ltd.), Semi-Ue L, High Solid, High Gamma, Shiromari L, Humming, White Humming, Semi-Ue HiL, Shiromari HiL (manufactured by Hokuetsu Paper Co, Ltd.), Ruby Light HREW, Pearl Soft, Ruby Light H (Mitsubishi Paper Co, Ltd.), Shaton, Ariso, Smash (manufactured by Chuetsu Pulp & Paper Co, Ltd.), Star Cherry, Cherry Super (manufactured by Marusumi Paper Co, Ltd.).

Special coated paper can be employed as the recording medium of the present invention, provided that the conditions set forth in the present patent application are satisfied. For example, some grades of coated paper for electrophotography and coated paper for gravure printing can be used. Specific examples include POD Gloss Coat (manufactured by Oji Paper Co, Ltd.), Space DX (manufactured by Nippon Paper Industries Co, Ltd.), and Earth (manufactured by Nippon Paper Industries Co, Ltd.). These grades of paper have adequate micropore volume of the coated layer and can be used as the recording medium of the present invention.

<Ink>

The ink contains at least water, a colorant, a wetting agent, and a penetrating agent and also contains a surfactant and, if necessary, other components.

-Colorant-

At least a pigment or colored fine particles are preferably used as the colorant. An aqueous dispersion of fine polymer particles containing at least one colorant from among pigments and dyes can be advantageously used as the colored fine particles.

The expression "containing at least one colorant" as used herein means either a state in which a colorant is introduced into fine polymer particles or a state in which a colorant is caused to be adsorbed on the surface of fine polymer particles, or both such states. No specific limitation is placed on the colorant, provided that it is insoluble or poorly soluble in water and can be adsorbed by the polymer, and a colorant can be appropriately selected according to the object. The expression "insoluble or poorly soluble in water" as used herein means that a colorant is not dissolved in an amount of 10 parts or more by mass than in 100 parts by mass of water at a temperature of 20° C. Further, the term "dissolved" as used herein means that separation or precipitation of the colorant in the surface layer or lower layers of aqueous solution cannot be established visually.

A volume-average particle size of fine polymer particles (colored fine particles) containing the colorant is preferably 0.01 μm to 0.16 μm in the ink. Where the volume-average particle size is less than 0.01 μm, the particle diameter comes close to that of a dye and, therefore, light resistance is degraded and feathering is increased. Further, the coating layer is easily permeated, whereby the image density is sometimes decreased. Where the volume-average particle size is more than 0.16 μm, the nozzles are easily clogged and coloration ability is degraded. Further, where the volume-average particle size is 0.30 μm or more, an ejection port or a filter located inside the printer are clogged and stable ejection cannot be attained.

Examples of the aforementioned colorants include dyes such as water-soluble dyes, oil-soluble dies, and dispersible dies, and pigments. From the standpoint of obtaining good adsorption ability and filling ability, oil-soluble dyes and dispersion dyes are preferred, but for the images to be light resistance, it is preferred that pigments be used.

From the standpoint of effectively impregnating fine polymer particles with the dyes, it is preferred that the dyes be soluble to a level of 2 g/L or higher, preferably 20 g/L to 600 g/L in an organic solvent, for example a ketone solvent.

Water-soluble dies are classified based on the color index thereof into acidic dyes, direct dyes, basic dyes, reactive dyes and food dyes, and it is preferred that dyes having high resistance to water and light be used.

Examples of acidic dyes and food dyes include CI Acid Yellow 17, 23, 42, 44, 79, 142; C. I. Acid Red 1, 8, 13, 14, 18, 26, 27, 35, 37, 42, 52, 82, 87, 89, 92, 97, 106, 111, 114, 115, 134, 186, 249, 254, 289; C. I. Acid Blue 9, 29, 45, 92, 249; C. I. Acid Black 1, 2, 7, 24, 26, 94; C. I. Food Yellow 3, 4; C. I. Food Red 7, 9, 14; and C. I. Food black 1, 2.

Examples of direct dyes include C. I. Direct Yellow 1, 12, 24, 26, 33, 44, 50, 86, 120, 132, 142, 144; C. I. Direct Red 1, 4, 9, 13, 17, 20, 28, 31, 39, 80, 81, 83, 89, 225, 227; C. I. Direct Orange 26, 29, 62, 102; C. I. Direct Blue 1, 2, 6, 15, 22, 25, 71, 76, 79, 86, 87, 90, 98, 163, 165, 199, 202; C. I. Direct Black 19, 22, 32, 38, 51, 56, 71, 74, 75, 77, 154, 168, 171.

Examples of basic dyes include C. I. Basic Yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, 91; C. I. Basic Red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, 112; C. I. Basic Blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155; and C. I. Basic Black 2, 8.

Examples of reactive dyes include C. I. Reactive Black 3, 4, 7, 11, 12, 17; C. I. Reactive Yellow 1, 5, 11, 13, 14, 20, 21, 22, 25, 40, 47, 51, 55, 65, 67; C. I. Reactive Red 1, 14, 17, 25, 26, 32, 37, 44, 46, 55, 60, 66, 74, 79, 96, 97; and C. I. Reactive Blue 1, 2, 7, 14, 15, 23, 32, 35, 38, 41, 63, 80, 95.

No specific limitation is placed on pigments, and a pigment can be appropriately selected according to the object. For example, inorganic pigments or organic pigments may be used.

Examples of inorganic pigments include titanium oxide, iron oxide, calcium carbonate, barium sulfate, aluminum hydroxide, barium yellow, cadmium red, chrome yellow, carbon black, Prussian blue, and metal powders. Among them, carbon black is preferred. The carbon black can be manufactured by a well-known method such as a contact method, a furnace method, and a thermal method.

Examples of organic pigments include azo pigments, polycyclic pigments dye chelates, nitro pigments, nitroso pigments, and aniline black. Among them, azo pigments and polycyclic pigments are preferred. Examples of the azo pigments include azo lake, insoluble azo pigments, azo pigment condensates, and chelate azo pigments. Examples of polycyclic pigments include phthalocyanine pigments, perylene pigments, perinone pigments, anthraquinone pigments, quinacridone pigments, dioxazine pigments, indigo pigments, thioindigo pigments, isoindolinone pigments, quinoflarone pigments, azomethine pigments, and rhodamine B lake pigment. Examples of dye chelates include basic dye chelates and acidic dye chelates.

No specific limitation is placed on the pigment color and it can be appropriately selected according to the object. For example black pigments and color pigments can be used. These pigments may be used alone or in combinations of two or more thereof.

Examples of black pigments include carbon black (C. I. Pigment Black 7) such as furnace black, lamp black, acetylene black, and channel black, metals such as copper, iron (C. I. Pigment Black 11), and titanium oxide, and organic pigments such as aniline black (C. I. Pigment Black 1).

Examples of carbon black suitable for a black pigment ink include carbon black manufactured by a furnace method and a channel method. The preferred carbon black has a primary particle diameter of 15 nm to 40 nm, a specific surface area determined by a BET method of 50 $m^2/g$ to 300 $m^2/g$, a DBP oil adsorption quantity of 40 mL/100 g to 150 mL/100 g, a volatile fraction of 0.5% to 10%, and a pH value of 2 to 9.

No specific limitation is placed on carbon black, and it can be appropriately selected according to the object. Examples of suitable carbon black include No. 2300, No. 900, MCF-88, No. 33, No. 40, No. 45, No. 52, MA7, MA8, MA100, No. 2200B (manufactured by Mitsubishi Chemical Co, Ltd.), Raven 700, Raven 5750, Raven 5250, Raven 5000, Raven 3500, Raven 1255 (manufactured by Columbia Inc.), Regal 400R, Regal 330R, Regal 660R, Mogul L, Monarch 700, Monarch 800, Monarch 880, Monarch 900, Monarch 1000, Monarch 1100, Monarch 1300, and Monarch 1400 (manufactured by Cabot Inc.), Color Black FW1, Color Black FW2, Color Black FW2V, Color Black FW18, Color Black FW200, Color Black S150, Color Black S160, Color Black S170, Printex 35, Printex U, Printex V, Printex 140U, Printex 140V, Special Black 6, Special Black 5, Special Black 4A, and Special Black 4 (manufactured by Degussa Inc.).

Examples of pigments suitable for yellow ink include C. I. Pigment Yellow 1 (Fast Yellow G), C. I. Pigment Yellow 2, 3, 12 (Disazo Yellow AAA), C. I. Pigment Yellow 13, 14, 16, 17, 23, 24, 34, 35, 37, 42 (iron oxide yellow), 53, 55, 73, 74, C. I. Pigment Yellow 75, 81, 83 (Disazo Yellow HR), 93, 95, 97, 98, 100, 101, 104, 108, 109, 110, C. I. Pigment Yellow 114, 117, 120, 128, 129, 138, 150, 151, 153, and 154.

Examples of pigments suitable for magenta ink include C. I. Pigment Red 1, 2, 3, 5, 7, 12, 17, 22 (Brilliant Fast Scarlet), 23, 31, 38, 48:2 (Permanent Red 2B (Ba)), 48:2 (Permanent Red 2B (Ca)), 48:3 (Permanent Red 2B (Sr)), 48:4 (Permanent Red 2B (Mn)), 49:1, 52:2, 53:1, 57:1 (Brilliant Carmine 6B), 60:1, 63:1, 63:2, 64;1, 81 (Rhodamine 6G Lake), 83, 88, 92, 101 (iron oxide red), 104, 105, 106, 108 (cadmium red), 112, 114, 122 (dimethylquinacridone), 123, 146, 149, 166, 168, 170, 172, 177, 178, 179, 184, 185, 190, 193, 202, 209, and 219.

Examples of pigments suitable for cyan ink include C. I. Pigment Blue 1, 2, 3, 15 (Copper Phthalocyanine Blue R), 15:1, 15:2, 15:3 (Phthalocyanine Blue G), 15;4, 15:6 (Phthalocyanine Blue E), 15;34, 16, 17:1, 22, 56, 60, 63, C. I. Vat Blue 4, and C. I. Vat Blue 60.

Examples of pigments suitable for intermediate colors, i.e, red, green, and blue, include C. I. Pigment Red 177, 194, 224, C. I. Pigment Orange 43, C. I. Pigment Violet 3, 19, 23, 37, and C. I. Pigment Green 7, 36.

Self-dispersible pigments that have at least one hydrophilic group bonded directly or via another atomic group to the pigment surface and can be dispersed with good stability without using a dispersant can be advantageously used as the aforementioned pigments. As a result, a dispersant for dispersing the pigment, as in the conventional inks, becomes unnecessary. The preferred self-dispersible pigments have ionic properties, and pigments that are anionically charged or cationically charged are preferred.

The volume-average particle size of the self-dispersible pigment in the ink is preferably 0.01 μm to 0.16 μm.

Examples of suitable anionic hydrophilic groups include —COOM, —$SO_3M$, —$PO_3HM$, —$PO_3M_2$, —$SO_2NH_2$, —$SO_2NHCOR$ (where M stands for a hydrogen atom, an alkali metal, ammonium, or an organic ammonium; R represents an alkyl group having 1 to 12 carbon atoms, an optionally substituted phenyl group or optionally substituted naphthyl group). Colorants in which —COOM and —$SO_3M$, from among the aforementioned groups, are bonded to a color pigment surface are preferably used.

Examples of the alkali metal represented by "M" in the hydrophilic group include lithium, sodium, and potassium. Examples of the organic ammonium include mono- to trimethylammonium, mono- to triethylammonium, and mono- to trimethylammonium. Examples of methods for obtaining anionically charged color pigments include methods by which —COONa is introduced to the color pigment surface, such as a method for oxidizing a color pigment with sodium hypochlorite, a sulfonation method, and a method of causing a reaction with a diazonium salt.

Quaternary ammonium groups are preferred as the aforementioned cationic hydrophilic groups, and the below-described quaternary ammonium groups are especially preferred. Colorants in which these groups are bonded to the pigment surface are preferred.

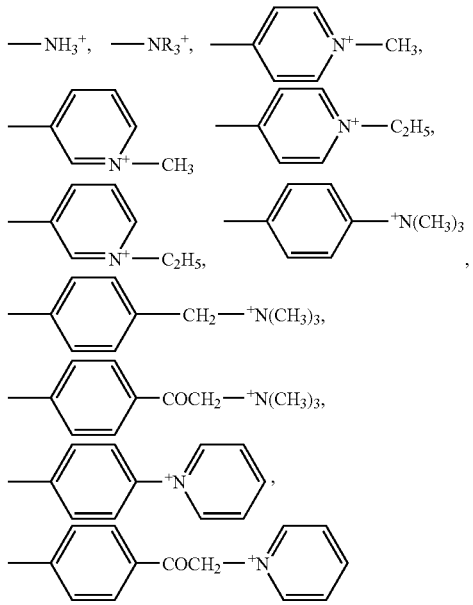

Cationic self-dispersible carbon black having the aforementioned hydrophilic groups bonded thereto can be manufactured, for example, by bonding N-ethylpyridil represented by, the following structural formula, e.g, by treating carbon black with 3-amino-N-ethylpyridium bromide, but it goes without saying that the present invention is not limited to this method.

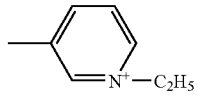

In accordance with the present invention, the hydrophilic group may be bonded to the carbon black surface via another atomic group. Examples of other atomic groups include an alkyl group having 1 to 12 carbon atoms, an optionally substituted phenyl group or optionally substituted naphthyl group. Specific examples representing the case in which the aforementioned hydrophilic group is bonded to the carbon black surface via another atomic group include —$C_2H_4COOM$ (where M represents an alkyl metal or quaternary ammonium), —$PhSO_3M$ (where Ph represents a phenyl group and M represents an alkyl metal or quaternary ammonium), and —$C_5H_{10}NH_3^+$.

In accordance with the present invention, a pigment dispersion using a pigment dispersant can be also used.

Examples of hydrophilic polymer compounds as the pigment dispersants include natural systems, e.g, vegetable polymers such as gum arabic, tragacanth gum, gua gum, karaya gum, locust bean gum, arabinogalacton, pectin, and quins seed starch, seaweed polymers such as alginic acid, carrageenan, and agar-agar, animal polymers such as gelatin, casein, albumin, and collagen, and microorganism-derived polymers such as xanthan gum and dextran. Examples of semi-synthetic systems include fibrous polymers such as methyl cellulose, ethyl cellulose, hydroxyethyl cellulose, hydroxypropyl cellulose, and carboxymethyl cellulose, starch-derived polymers such as starch sodium glycolate, starch sodium phosphoric acid ester, and seaweed-derived polymers such as sodium alginate and propylene glycol alginate. Examples of pure synthetic systems include vinyl polymers such as polyvinyl alcohol, polyvinyl pyrrolidone, and polyvinylmethyl ether, acrylic resins such as non-crosslinked polyacrylamides, polyacrylic acid and alkali metal salts thereof, and water-soluble styrene-acrylic resins, water-soluble styrene-maleic acid resin, water-soluble vinyl naphthalene acrylic resin, water-soluble vinyl naphthalene maleate resin, polyvinyl pyrrolidone, polyvinyl alcohol, β-naphthalenesulfinic acid formalin condensate alkali metal salt, polymer compounds having a salt of a cationic functional group such as quaternary ammonium or amino group in a side chain, and natural polymer compounds such as shellac. Among them, polymers having introduced therein a carboxyl group, such as homopolymers of acrylic acid, methacrylic acid, styrene-acrylic acid, or copolymers with monomers having other hydrophilic groups are especially preferred as the polymer dispersants.

The weight-average molecular weight of the copolymers is preferably 3,000 to 50,000, more preferably 5,000 to 30,000, and even more preferably 7,000 to 15,000. The mixing mass ratio of the pigment and the dispersant is preferably within a range of 1:0.06 to 1:3, more preferably 1:0.125 to 1:3.

Using a polymer dispersant and a self-dispersible pigment at the same time is a preferred combination for obtaining a suitable dot size. Reasons therefor are unclear, but the following can be suggested.

Permeation into recording paper is inhibited by introducing a polymer dispersant. On the other hand, because introducing the polymer dispersant prevents the cohesion of self-dispersible pigment, and self-dispersible pigment can be smoothly spread in the transverse direction. As a result, a wide thin dot is obtained and a perfect dot can be formed.

Further, the pigment can be coated with a resin having a hydrophilic group and microcapsulated to impart dispersion ability thereto.

Any well-known conventional method can be used for covering and microcapsulating a water-insoluble pigment with an organic polymer. Examples of such well-known conventional methods include chemical methods, physical methods, physical-chemical methods, and mechanical methods. Specific examples of such methods are presented below.

Interface polymerization method (a method by which two monomers or two reaction substances are separately dissolved to obtain a dispersed phase and a continuous phase, and a wall membrane is formed by a reaction of the two substances at the interface thereof);

In-situ polymerization method (a method by which a liquid or gaseous monomer and a catalyst, or two kinds of reactable substances are supplied from any one of continuous phase nuclei particles and a reaction is induced to form a wall membrane);

In-liquid curing and coating method (a method by which drops of a polymer solution comprising core substance particles are insolubilized with a curing agent or the like in a liquid to form a wall membrane);

Corecervation (phase separation) method (a method by which a polymer dispersion having core substance particles dispersed therein is separated into a corecervate (concentrated phase) with a high polymer concentration and a dilute phase, and a wall membrane is formed);

In-liquid drying method (a method by which a liquid is prepared in which a core substance is dispersed in a solution of a wall membrane substrate, the dispersion is introduced into a liquid that is not miscible with the continuous phase of the dispersion to obtain a composite emulsion, and a medium in which the wall membrane substance is dissolved is gradually removed to form a wall membrane);

Melting-dispersing-cooling method (a method by which a wall membrane substance is used such that melts and becomes a liquid under heating and solidifies at normal temperature, the substance is heated and liquefied, core substance particles are dispersed therein, very fine particles are obtained and cooled to form a wall membrane);

Gas suspension coating method (a method by which core substance particles are suspended in gas by a fluidized bed method and caused to float in a gas flow, and a coating liquid of the wall membrane substrate is sprayed and mixed therewith to form a wall membrane);

Spray drying method (a method by which an encapsulated starting liquid is sprayed, brought into contact with hot air, and dried by evaporating volatile fraction to form a wall membrane);

Acid precipitation method (a method by which at least some of anionic groups of an organic polymer compound comprising anionic groups are neutralized with a basic compound, thereby imparting solubility in water, the organic polymer compound is kneaded with a colorant in an aqueous medium, and then made neutral or acidic with an acidic compound to precipitate the organic compound and fixedly attach it to the colorant, followed by neutralization and dispersion);

Phase inversion emulsification method (a method by which a mixture comprising a colorant and an anionic organic polymer having a dispersion ability with respect to water is taken as an organic solvent phase, and water is loaded into the organic solvent phase or the organic solvent phase is loaded into water).

Examples of organic polymers (resins) for use as materials constituting a wall membrane substance of microcapsules include polyamides, polyurethanes, polyesters, polyurea, epoxy resins, polycarbonates, urea resin, melamine resin, phenolic resins, polysaccharides, Arabic gum, gelatin, dextran, casein, proteins, natural rubber, carboxypolymethylene, polyvinyl alcohol, polyvinyl pyrrolidone, polyvinyl acetate, polyvinyl chloride, polyvinylidene chloride, cellulose, ethyl cellulose, methyl cellulose, nitrocellulose, hydroxyethyl cellulose, acetate cellulose, polyethylene, polystyrene, polymers or copolymers of (meth)acrylic acid, polymers or copolymers of (meth)acrylic acid esters, (meth)acrylic acid-(meth)acrylic acid esters copolymers, styrene-(meth)acrylic acid copolymers, styrene-maleic acid copolymer, sodium alginate, fatty acids, paraffin, bee wax, water wax, hardened tallow, carnauba wax, and albumin.

Among the aforementioned compounds, organic polymers having anionic groups such as carboxylic acid groups or sulfonic acid groups can be used. Further, examples of non-ionic organic polymers include polyvinyl alcohol, polyethylene glycol monomethacrylate, polypropylene glycol monomethacrylate, methoxypolyethylene glycol monomethacrylate, or (co)polymers thereof, cation ring-opening polymers of 2-oxazoline. Complete saponification products of polyvinyl alcohol are especially preferred because they have low solubility in water, easily dissolve in hot water, but hardly dissolve in cold water.

The amount of the organic polymer used as a material constituting a wall membrane substance of microcapsules is 1% by mass or more to 20% by mass or less based on the a water-insoluble colorant such as organic pigment or carbon black. By setting the amount of the organic polymer within the aforementioned range, it is possible to inhibit the decrease in coloration ability of the pigment caused by covering the pigment surface with the organic polymer because the content ratio of the organic polymer in the capsule is comparatively low. Where the amount of the organic polymer is less than 1% by mass, the effect of capsulation is hardly demonstrated, and when this amount is more than 20% by mass, the decrease in coloration ability of the pigment is significant. With consideration for other properties, the preferred amount of the organic polymer is within a range of 5% by mass to 10% by mass based on the insoluble colorant.

Because part of the colorant is substantially not covered and exposed, the decrease in coloration ability can be inhibited. Conversely, because part of the colorant is substantially covered and not exposed, the effect of covering the pigment is simultaneously demonstrated. From the standpoint of capsule manufacture, it is preferred that the number-average molecular weight of the organic polymers used in accordance with the present invention be 2,000 or higher. The expression "substantially" exposed herein means a state in which the material is intentionally exposed, rather that partial exposure caused by defects, for example, pinholes and cracks.

Where an organic pigment that is a pigment having self-dispersion ability or carbon black having self-dispersion ability is used as a colorant the dispersion ability of the pigment increases even if the content of the organic polymer in the capsule is comparatively low. Therefore, sufficient stability of ink in storage can be ensured, this feature being advantageous for the present invention.

An appropriate organic polymer is preferably selected according to the microcapsulation method. For example, polyesters, polyamides, polyurethanes, polyvinyl pyrrolidone, and epoxy resins are suitable for the interface polymerization method. (Meth)acrylic acid ester polymers or copolymers, (meth)acrylic acid-(meth)acrylic acid ester copolymers, styrene-(meth)acrylic acid copolymers, polyvinyl chloride, polyvinylidene chloride, and polyamides are suitable for the in-situ polymerization method. Sodium alginate, polyvinyl alcohol, gelatin, albumin, and epoxy resins are suitable for the in-liquid curing and coating method. Gelatin, cellulose, and casein are suitable for the corecervation method. It goes without saying that all well-known conventional capsulation methods can be also used to obtain ultrafine homogeneous microcapsulated pigments.

When the phase inversion method or acid precipitation method is selected as the microcapsulation method, anionic organic polymers are used as the organic polymers constituting the wall membrane substrates of microcapsules. With the phase inversion method, a composite substrate or a composite of an anionic organic polymer capable of self dispersing or dissolving in water and a colorant such as self-dispersible organic pigment or self-dispersible carbon black, or a mixture of the self-dispersible organic pigment or self-dispersible carbon black, a curing agent, and an anionic organic polymer is taken as an organic solvent phase, water is loaded into the organic solvent phase or the organic solvent phase is loaded into water, and microcapsulation is performed, while self dispersion (phase inversion emulsification) proceeds. In the phase inversion method, no problems whatsoever arise even if a vehicle or an additive for ink is admixed to the organic solvent phase. In particular, from the standpoint of enabling the direct manufacture of dispersion for ink, admixing a liquid medium of ink is more preferred.

On the other hand, with the acid precipitation method, a water-containing cake is obtained by a manufacturing process comprising a step of neutralizing some or all anionic groups of an anionic group-containing organic polymer with a basic compound and kneading in an aqueous medium with a colorant such as a self-dispersible organic pigment or a self-dispersible carbon black and a step of converting a pH value to a neutral range or to an acidic range with an acidic compound, precipitating the anionic group-containing organic polymer, and bonding it fixedly to the pigment, and this cake is microcapsulated by neutralizing some or all anionic groups by using the basic compound. With any of these methods, it is possible to manufacture an aqueous dispersion containing anionic microcapsulated pigment that contains a large amount of fine pigment.

Examples of solvents that can be used in such microcapsulation include alkyl alcohols such as methanol, ethanol, propanol, and butanol; aromatic hydrocarbons such as benzene, toluol, and xylol; esters such as methyl acetate, ethyl acetate, and butyl acetate; chlorinated hydrocarbons such as chloroform and ethylene dichloride; ketones such as acetone and methyl isobutyl ketone; ethers such as tetrahydrofuran and dioxane; and cellosolves such as methyl cellosolve and butyl cellosolve. An ink that can be used in accordance with the object of the present invention is obtained by separating the microcapsules prepared by the above-described methods from the solvents thereof by centrifugal separation or filtration, and stirring and re-dispersing the separated microcapsules together with water and a necessary solvent. The average particle size of the capsulated pigment obtained by the above-described method is preferably 50 nm to 180 nm.

The content of the colorant in the ink is preferably 2% by mass to 15% by mass, more preferably 8% by mass to 12% by mass. Where the amount added is less than 2% by mass, the coloration capacity is decreased and image density decreases. In addition, feathering and bleeding are made worse due to decrease in viscosity. Where the amount of the colorant added is more than 15% by mass, the nozzles in the ink jet recording apparatus that is in a stand-by mode are easily dried, a no-ejection phenomenon occurs, permeation is decreased due to exceedingly high viscosity, image density decreased because the ink dots do not spread, and thinned image is sometimes obtained.

-Penetrating Agent-

Water-soluble organic solvents such as polyol compounds and glycol ether compound can be used as the penetrating agent. It is especially preferred that at least any one of polyol compounds having eight or more carbon atoms and glycol ether compounds be used.

Where the number of carbon atoms in the polyol compound is less than eight, sufficient permeation ability cannot be obtained, the recording medium is stained during two-side printing, spread of ink on the recording medium is insufficient, and embedding of pixels is degraded. As a result, text quality or image density are sometimes degraded.

Preferred examples of polyol compounds having eight or more carbon atoms include 2-ethyl-1,3-hexanediol (solubility: 4.2% (25° C.)), 2,2,4-trimethyl-1,3-pentanediol (solubility: 2.0% (25° C.)).

No specific limitation is placed on the glycol ether compound, and it can be appropriately selected according to the object. Examples of suitable glycol ether compounds include polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, propylene glycol monoethyl ether, and polyhydric alcohol aryl ethers such as ethylene glycol monophenyl ether and ethylene glycol monobenzyl ether.

No specific limitation is placed on the added amount of the penetrating agent and it can be appropriately selected according to the object. The preferred amount of the penetrating agent is 0.1% by mass to 2.0% by mass, more preferably 0.5% by mass to 10% by mass.

-Wetting Agent-

No specific limitation is placed on the wetting agent and it can be appropriately selected according to the object. Thus, at least one compound selected from among polyol compounds, lactam compounds, amides, amines, sulfur-containing compounds, urea compounds, saccharides, propylene carbonate, and ethylene carbonate can be advantageously used.

Examples of polyol compounds include polyhydric alcohols, polyhydric alcohol alkyl ethers, and polyhydric alcohol aryl ethers. These compounds can be used alone or in combination of two or more thereof.

Examples of polyhydric alcohols include ethylene glycol, diethylene glycol, triethylene glycol, polyethylene glycol, polypropylene glycol, 1,3-butanediol, 1,4-butanediol, 3-methyl-1,3-butanediol, 1,3-propanediol, 1,5-pentanediol, 1,6-hexanediol, glycerin, 1,2,6-hexanetriol, 1,2,4-butanetriol, 1,2,3-butanetriol, and petriol.

Examples of polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, and propylene glycol monoethyl ether.

Examples of polyhydric alcohol aryl ethers include ethylene glycol monophenyl ether and ethylene glycol monobenzyl ether.

Example of lactam compounds include N-methyl-2-pyrrolidone, N-hydroxyethyl-2-pyrrolidone, 2-pyrrolidone, 1,3-dimethylimidazolidinone, and ϵ-caprolactam.

Examples of amides include formamide, N-methylformamide and N,N-dimethylformamide.

Examples of amines include monoethanolamine, diethanolamine, triethanolamine, monoethylamine, diethylamine, and triethylamine.

Examples of sulfur-containing compounds include dimethylsulfoxide, sulfolan, and thiodiethanol.

At least one compound selected from urea, thiourea, ethylene urea, and 1,3-dimethyl-2-imidazolidinone can be used as the urea compound.

Examples of saccharides include monosaccharides, disaccharides, oligosaccharides (including trisaccharides and tetrasaccharides), polysaccharides, or derivatives thereof. Examples of preferred saccharides include glucose, mammose, fructose, ribose, xylose, arabinose, gallactose, maltose, cellobiose, lactose, sucrose, trehalose, and maltotriose. Matitose, sorbitose, glucolactone, and maltose are especially preferred.

Polysaccharides are sugars in a general meaning of the word and are used in the meaning including substances that are widely present in the natural world, such as α-cyclodextrin and cellulose.

Examples of derivatives of saccharides include reducing sugar of the aforementioned saccharides (for example, sugar alcohols (represented by general formula $HOCH_2(CHOH)nCH_2OH$ (where, n represents integer of 2 to 5)), oxidizing sugar (for example, aldonic acid, uronic acid, etc.), amino acids, and thio acids. Among them, sugar alcohols are especially preferred. Examples of sugar alcohols include maltitol and sorbit.

Among them, from the standpoint of demonstrating excellent effect in preventing degradation of ejection characteristic caused by water evaporation and solubility, the preferred compounds are glycerin, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,5-pentadiol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, and N-hydroxyethyl-2-pyrrolidone.

The content of the wetting agent in the ink is preferably 10% by mass to 50% by mass, more preferably 20% by mass to 35% by mass. If the content is too low, the nozzles easily dry up and ejection of droplets is sometimes degraded. If the content of the wetting agent is too high, ink viscosity increases and exceeds the appropriate viscosity range.

-Surfactant-

No specific limitations are placed on the surfactant and it can be appropriately selected according to the object. Examples of suitable surfactants include anionic surfactants, amphoteric surfactant, nonionic surfactants, acetylene glycol surfactants, and fluorine-containing surfactants.

Examples of anionic surfactants include polyoxyethylene alkyl ether acetates, dodecylbenzenesulfonates, laureates, and polyoxyethylene alkyl ether sulfate salts.

Examples of nonionic surfactants include acetylene glycol surfactants, polyoxyethylene alkyl ethers, polyoxyethylene alkyl phenyl ethers, polyoxyethylene sorbitan fatty acid esters, polyoxypropylene polyoxyethylene alkyl ethers, polyoxyethylene alkyl esters, polyoxyethylene sorbitan fatty acid esters, polyoxyethylene alkylamines, and polyoxyethylene alkylamides.

Examples of acetylene glycol surfactants include 2,4,7,9-tetramethyl-5-decyne-4,7-diol, 3,6-dimethyl-4-octine-3,6-diol and 3,5-dimethyl-1-hexyne-3-ol. Examples of commercial products of acetylene glycol surfactants include Surfynol 104, 82, 465, 485, and TG produced by Air Products Co, Ltd. (USA).

Examples of amphoteric surfactants include laurylaminopropionic acid salts, lauryldimethyl betaine, stearyldimethyl betaine, and lauryldihydroxyethyl betaine. Specific examples include lauryldimethylamine oxide, myristyldimethylamine oxide, stearyldimethylamine oxide, dihydroxyethyllaurylamine oxide, polyoxyethylene coconut oil alkyl dimethylamine oxide, dimethylalkyl (coconut) betaine, and dimethyllauryl betaine.

The preferred surfactants among the aforementioned compounds are selected from those represented by General Formulas (I), (II), (III), (IV), (V), and (VI) below.

$$R^1—O—(CH_2CH_2O)hCH_2COOM \qquad \text{General Formula (I)}$$

In the General Formula (I), $R^1$ represents an alkyl group. h represents integer of 3 to 12. M represents any one selected from an alkyl metal ion, quaternary ammonium, quaternary phosphonium, and alkanolamine.

General Formula (II)

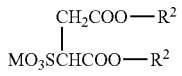

In the General Formula (II), $R^2$ represents an alkyl group. M represents any one selected from an alkali metal ion, quaternary ammonium, quaternary phosphonium, and alkanolamine.

General Formula (III)

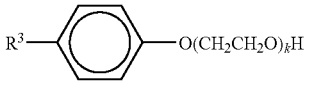

In the General Formula (III), $R^3$ represents a hydrocarbon group. k represents integer of 5 to 20.

$$R^4—(OCH_2CH_2)_jOH$$ General Formula (IV)

In the General Formula (IV), $R^4$ represents a hydrocarbon group. j represents integer of 5 to 20.

General Formula (V)

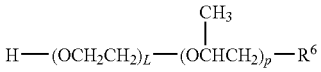

In the General Formula (V), $R^6$ represents a hydrocarbon group. L and p represent integer of 1 to 20.

General Formula (VI)

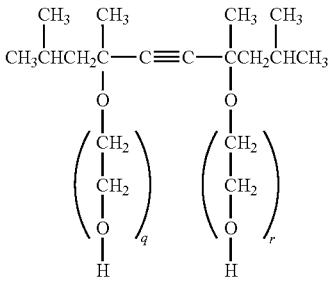

In the General Formula (VI), q and r represent integers of 0 to 40.

Surfactants of structural formulas (I) and (II) above are presented specifically below in a free acid form.

$$CH_3(CH_2)_{12}O(CH_2CH_2O)_3CH_2COOH \quad (I\text{-}1)$$

$$CH_3(CH_2)_{12}O(CH_2CH_2O)_4CH_2COOH \quad (I\text{-}2)$$

$$CH_3(CH_2)_{12}O(CH_2CH_2O)_5CH_2COOH \quad (I\text{-}3)$$

$$CH_3(CH_2)_{12}O(CH_2CH_2O)_6CH_2COOH \quad (I\text{-}4)$$

(I-5): $CH_3(CH_2)_{11}CH(CH_3)O(CH_2CH_2O)_6CH_2COOH$ (I-6): $CH_3(CH_2)_6CH((CH_2)_5CH_3)O(CH_2CH_2O)_3CH_2CH_2COOH$ (II-1):

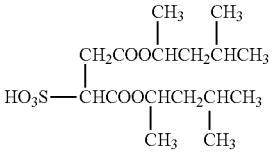

(II-2):

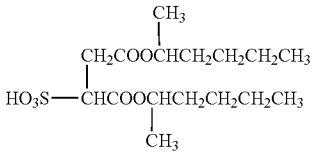

-continued (II-3):

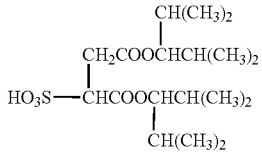

(II-4):

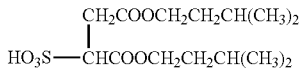

Preferred examples of fluorine-containing surfactants are represented by General Formula (II-5) below.

$$CF_3CF_2(CF_2CF_2)_m—CH_2CH_2O(CH_2CH_2O)_nH \quad (II\text{-}5)$$

In the General Formula (II-5), m represents integer of 0 to 10. n represents integer of 1 to 40.

Specific examples of fluorine-containing surfactants include perfluoroalkylsulfonic acid compounds, perfluoroalkylcarboxylic acid compounds, perfluoroalkylphosphoric acid ester compounds, perfluoroalkylethylene oxide adducts, and polyoxyalkylene ether polymer compounds having a perfluoroalkyl ether group in a side chain. Among them, polyoxyalkylene ether polymer compounds having a perfluoroalkyl ether group in a side chain are especially preferred because they demonstrate low foaming ability, a low level of bioaccumulation, which has become an important issue in recent years, and a high level of safety.

Examples of perfluoroalkylsulfonic acid compounds include perfluoroalkylsulfonic acids and perfluoroalkylsulfonic acid salts.

Examples of perfluoroalkylcarboxylic acid compounds include perfluoroalkylcarboxylic acids and perfluoroalkylcarboxylic acid salts.

Examples of perfluoroalkylphosphoric acid ester compounds include perfluoroalkylphosphoric acid esters and perfluoroalkylphosphoric acid ester salts.

Examples of polyoxyalkylene ether polymer compounds having a perfluoroalkyl ether group in a side chain include polyoxyalkylene ether polymers having a perfluoroalkyl ether group in a side chain, sulfuric acid esters and salts of polyoxyalkylene ether polymers having a perfluoroalkyl ether group in a side chain, and salts of polyoxyalkylene ether polymers having a perfluoroalkyl ether group in a side chain.

Examples of counter ions of salts in the fluorine-containing surfactants include Li, Na, K, $NH_4$, $NH_3CH_2CH_2OH$, $NH_2(CH_2CH_2OH)_2$, and $NH(CH_2CH_2OH)_3$.

Appropriately synthesized compounds or commercial products may be used as the fluorine-containing surfactants.

Examples of commercial products include Surflon S-111, S-112, S-113, S-121, S-131, S-132, S-141, S-145 (all are manufactured by Asahi Glass Co, Ltd.); Fluorad FC-93, FC-95, FC-98, FC-129, FC-135, FC-170C, FC-430, FC-431 (all are manufactured by Sumitomo 3M ко, Ltd.); Megafac F-470, F1405, F474 (all are manufactured by Dainippon Ink and Chemical Co, Ltd.); Zonyl TBS, FSP, FSA, FSN-100, FSN, FSO-100, FSO, FS-300, US (all are manufactured by Du Pont Corp.); FT-110, FT-250, FT-251, FT-400S, FT-150, FT-400SW (all are manufactured by Neos Co, Ltd.); and PF-151N (manufactured by Omnova Co, Ltd.). Among these products, in terms of reliability and coloration improvement, Zonyl FS-300, FSN, FSN-100, FSO (all are manufactured by Du Pont Corp.) are preferred.

-Resin Emulsion-

The resin emulsion can be used as a pigment fixing agent. In the resin emulsion, fine resin particles are dispersed in water serving as a continuous phase. If necessary, the resin emulsion may also contain a dispersant such as a surfactant.

The content of fine resin particles serving as a dispersed phase component (content of fine resin particles in the resin emulsion) is generally preferred to be within a range of 10% by mass to 70% by mass. With consideration for usage in an ink jet printing apparatus, the average particle size of fine resin particles is preferably 10 nm to 1,000 nm, more preferably 20 nm to 300 nm.

No specific limitation is placed on the fine resin particle component of the dispersed phase and it can be appropriately selected according to the object. Examples of suitable resins include acrylic resin, vinyl acetate resin, styrene resin, butadiene resin, styrene-butadiene resin, vinyl chloride resin, acryl-styrene resin, and acryl-silicone resin. Among them, acryl-silicone resin is especially preferred.

Appropriately synthesized emulsions or commercial products may be used as the resin emulsion.

Examples of commercial resin emulsions include Microgel E-1002, E-5002 (styrene-acryl resin emulsion; manufactured by Nippon Paint Co, Ltd.); Voncoat 4001 (acrylic resin emulsion; manufactured by Dainippon Ink and Chemicals Co, Ltd.); Voncoat 5454 (styrene-acryl resin emulsion; manufactured by Dainippon Ink and Chemicals Co, Ltd.); SAE-1014 (styrene-acryl resin emulsion; manufactured by Nippon Zeon Co, Ltd.); Saivinol SK-200 (acrylic resin emulsion; manufactured by Saiden Chemical Co, Ltd.); Primal AC-22, AS-61 (acrylic resin emulsion; manufactured by Rohm and Haus Co, Ltd.); Nanocryl SBCX-2821, 3689 (acryl-silicone resin emulsion; manufactured by Toyo Ink Co, Ltd.), and #3070 (methyl methacrylate polymer resin emulsion; manufactured by Mikuni Color Works, Ltd.).

The amount of the fine resin particles contained in the resin emulsion that is added to the ink is preferably 0.1% by mass to 50% by mass, more preferably 0.5% by mass to 20% by mass, and even more preferably 1% by mass to 10% by mass. Where the amount added is less than 0.1% by mass, improvement of resistance to clogging and ejection stability is sometimes insufficient, and when the amount added exceeds 50% by mass, stability of the ink in storage is sometimes degraded.

If necessary, a UV-curable resin may be used in combination with the above-described resin.

For example, a UV-curable resin can be obtained by polymerization of at least one from among well-known acrylic photopolymerizable monomers and acrylic photopolymerizable oligomers.

Examples of acrylic photopolymerizable monomers include: (1) unsaturated carboxylic acids such as (meth) acrylic acid or esters thereof; (2) acrylamide, methacrylamide, or derivatives thereof; (3) acrylic compounds and other monomers.

Examples of the (1) unsaturated carboxylic acids such as (meth)acrylic acid or esters thereof include alkyl(meth)acrylates, cycloalkyl(meth)acrylates, halogenated alkyl(meth) acrylates, alkoxyalkyl(meth)acrylates, hydroxyalkyl(meth) acrylates, aminoalkyl(meth)acrylates, tetrahydrofurfuryl (meth)acrylate, allyl(meth)acrylates, glycidyl(meth)acrylate, benzyl(meth)acrylate, phenoxy(meth)acrylates; alkylene glycols, polyoxyalkylene glycol mono- or di(meth)acrylates; trimethylol propane tri(meth)acrylate, and pentaerythritol tetra(meth)acrylate.

Examples of (2) acrylamide, methacrylamide, or derivatives thereof include (meth)acrylamide mono- or disubstituted with an alkyl group or a hydroxyalkyl group; and diacetone(meth)acrylamide, N,N'-alkylene bis(meth)acrylamide.

Examples of (3) allyl compounds and other monomers include allyl alcohol, allyl isocyanate, diallyl phthalate, and triallyl isocyanurate.

Examples of other monomers include isobornyl(meth) acrylate, norbornyl(meth)acrylate, dicyclopentenoxyethyl (meth)acrylate, dicyclopentenoxypropyl(meth)acrylate; (meth)acrylic acid ester of diethylene glycol dicyclopentenyl monoether, (meth)acrylic acid ester of polyoxyethylene or polypropylene glycol dioxyclopentenyl monoether; dicyclopentenyl cinnamate, dicyclopentenoxyethyl cinnamate, dicyclopentenoxyethyl monofurmate or diformate; mono, diacrylate or mono, dimethacrylate of 3,9-bis(1,1-bismethyl-2-oxyethyl)spiro[5,5]undecane, 3,9-bis(1,1-bismethyl-2-oxyethyl-2,4,8,10-tetraoxaspiro[5,5]undecane, 3,9-bis(2-oxyethyl)-spiro[5,5]undecane, 3,9-bis(2-oxyethyl)-2,4,8,10-tetraoxaspiro[5,5]undecane, or mono, diacrylate or mono, dimethacrylate of ethylene oxide or propylene oxide adduct polymers of these spyroglycols, or methyl ethers of the monoacrylate or methacrylate; 1-azabiscyclo[2,2,2]-3-octenyl(meth)acrylate, bicycle[2,2,1]-5-heptene-2,3-dicarboxylmnoallyl ester; dicyclopentadienyl(meth)acrylate, dicyclopentadienyl oxy ether(meth)acrylate, and dihydrodicyclopentadienyl(meth)acrylate.

These photopolymerizable monomers may be used individually or in combinations of two or more thereof.

Examples of acrylic photopolymerizable oligomers include acrylic acid esters of epoxy resins, unsaturated polyester prepolymers, polyvinyl alcohol prepolymer, polyacrylic acid or maleic acid copolymer prepolymers, and other oligomers.

Examples of the acrylic acid esters of the epoxy resins include diglycidyl ether diacrylate of bisphenol A, reaction products of epoxy resins, acrylic acid, and methyltetrahydrophthalic anhydride, reaction products of epoxy resins and 2-hydroxyethyl acrylate, and open-chain polymerization ester of glycidyl diacrylate and phthalic anhydride.

Examples of unsaturated polyester prepolymers include esters of methacrylic acid dimer and polyols, polyesters obtained form acrylic acid, phthalic anhydride, and propylene oxide, reaction products of polyvinyl alcohol and N-methylolacrylamide, and reaction produces of polyethylene glycol, maleic anhydride, and glycidyl methacrylate.

Examples of polyvinyl alcohol prepolymers include products obtained by etherifying polyvinyl alcohol with succinic anhydride and then adding a glycidyl methacrylate.

Examples of polyacrylic acid or maleic acid copolymer prepolymers include reaction products of methylvinyl ether-maleic anhydride copolymer and 2-hydroxyethyl acrylate, and such products that are additionally reacted with glycidyl methacrylate.

Examples of other oligomers include urethane prepolymers having acryloyl groups or methacryloyl groups at both ends in which polyoxyalkylene segments or unsaturated polyester segments, or segments of both kinds are joined via urethane bonds.

-Other Components-

No specific limitation is placed on other components and they can be appropriately selected as necessary. Examples of other components include pH adjusting agents, antiseptic/antifungal agents, antirust agents, antioxidants, UV absorbers, oxygen absorbers, and photostabilizers.

Examples of the antiseptic/antifungal agents include 1,2-benzisothiazoline-3-one, sodium dehydroacetate, sodium sorbate, 2-pyridinethiol-1-oxide sodium, sodium benzoate, and pentachlorophenol sodium.

No specific limitation is placed on pH adjusting agents and any substance can be used according to the object, provided that it can adjust pH to 7 or higher, without adversely affecting the ink that will be prepared.

Examples of suitable pH adjusting agents include amines such as diethanolamine and triethanolamine; hydroxides of alkali metal elements such as lithium hydroxide, sodium hydroxide, and potassium hydroxide; ammonium hydroxide, quaternary ammonium hydroxide, quaternary phosphonium hydroxide, and carbonates of alkali metals such as lithium carbonate, sodium carbonate, and potassium carbonate.

Examples of the antirust agents include acidic sulfites, sodium thiosulfate, ammonium thiodiglycolate, diisopropyl ammonium nitrite, pentaerythritol tetranitrate, and dicyclohexylammonium nitrite.

Examples of antioxidants include phenolic antioxidants (including antioxidants based on hindered phenols), amine antioxidants, sulfur-containing antioxidants, and phosphorus-containing antioxidants.

Examples of phenolic antioxidants (including antioxidants based on hindered phenols), include butylhydroxyanisol, 2,6-di-tert-butyl-4-ethylphenol, stearyl-β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 3,9-bis[1,1-dimethyl-2-[β-(3-tert-butyl-4-hydroxy-5-methylphenyl)propionyloxy]ethyl]-2,4,8,10-tetraoxaspiro[5,5]undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis [methylene-3-(3',5'-di-tert-butyl-4'-hydroxyphenyl) propionate]methane.

Examples of amine antioxidants include phenyl-β-naphthylamine, α-naphthylamine, N,N'-di-sec-butyl-p-phenylenediamine, phenothiazine, N,N'-diphenyl-p-phenylenediamine, 2,6-di-tert-butyl-p-cresol, 2,6-di-tert-butylphenol, 2,4-dimethyl-6-tert-butyl-phenol, butylhydroxyanisol, methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene-3-(3,5-di-tert-butyl-4-dihydroxyphenyl)propionate]methane, and 1,1,3-tris(2-methyl)-4-hydroxy-5-tert-butylphenyl)butane.

Examples of sulfur-containing antioxidants include dilauryl 3,3'-thiodipropionate, distearyl thiodipropionate, lauryl stearyl thiodipropionate, dimyristyl-3,3'-thiodipropionate, distearyl-β,β'-thiodipropionate, 2-mercaptobenzimidazole, and dilauryl sulfide.

Examples of phosphorus-containing antioxidants include triphenylphosphite, octadecylphosphite, triisodecylphosphite, trilauryltrithiophosphite, and trinonylphenylphosphite.

Examples of UV absorbers include benzophenone UV absorbers, benzotriazole UV absorbers, salicylate UV absorbers, cyanoacrylate UV absorbers, and nickel complex UV absorbers.

Examples of benzophenone UV absorbers include 2-hydroxy-4-n-octoxybenzophenone, 2-hydroxy-4-n-dodecyloxybenzophenone, 2,4-dihydroxybenzophenone, 2-hydroxy-4-methoxybenzophenone, and 2,2',4,4'-tetrahydroxybenzophenone.

Examples of benzotriazole UV absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, 2-(2'-hydroxy-3'-tert-butyl-5'-methylphenyl)-5-chlorobenzotriazole.

Examples of salicylate UV absorbers include phenyl salicylate, p-tert-butylphenyl salicylate, and p-octylphenyl salicylate.

Examples of cyanoacrylate UV absorbers include ethyl-2-cyano-3,3'-diphenyl acrylate, methyl-2-cyano-3-methyl-3-(p-methoxyphenyl)acrylate, and butyl-2-cyano-3-methyl-3-(p-methoxyphenyl)acrylate.

Examples of nickel complex UV absorbers include nickel bis(octylphenyl)sulfide, 2,2'-thiobis(4-tert-octylphenolate)-n-butylamine nickel (II), 2,2'-thiobis(4-tert-octylphenolate)-2-ethylhexylamine nickel (II), and 2,2'-thiobis(4-tert-octylphenolate) triethanolamine nickel (II).

The ink in accordance with the present invention is manufactured by dispersing or dissolving at least water, a colorant, a wetting agent, a penetrating agent, a surfactant and, if necessary, other components in an aqueous medium and then stirring and mixing, if necessary. The dispersing can be performed, for example, with a sand mill, a homogenizer, a ball mill, a paint shaker, and an ultrasonic dispersing apparatus. Stirring and mixing can be performed with a usual stirring machine using an impeller, a magnetic stirrer, or a high-speed dispersing machine.

Physical properties of the ink, for example, viscosity and pH are preferably within the following ranges.

The ink viscosity is preferably from 1 cps or more to 30 cps or less at 25° C., and a range of 2 cps to 20 cps is more preferred. Where the viscosity exceeds 20 cps, stable ejection of ink is sometimes difficult to ensure. The pH is preferably 7 to 10.

No specific limitation is placed on the ink color, and it can be appropriately selected according to the object. Examples of suitable colors include yellow, magenta, cyan, and black. Where recording is performed by using an ink set employing two or more such colors, a multicolor image can be formed, and when recording is performed using an ink set employing all the colors, a full-color image can be formed.

The ink in accordance with the present invention can be advantageously used in printers employing the following ink jet heads: the so called piezo-type ink jet head in which a piezoelectric element is used as a pressure generating unit that pressurizes ink located in an ink channel, an oscillation plate forming a wall surface of the ink channel is deformed, the internal volume of the ink channel is changed, and an ink droplet is ejected (see Japanese Patent Application Laid-Open (JP-A) No. 02-51734), or the so-called thermal-type ink jet head that uses a heat-generating resistor to heat the ink in an ink channel and generate gas bubbles (see Japanese Patent Application Laid-Open (JP-A) No. 61-59911), and an electrostatic ink jet head in which an oscillation plate forming a wall surface of an ink channel is disposed opposite an electrode and the oscillation plate is deformed by electrostatic forces generated between the oscillation plate and the electrode, whereby the internal volume of the ink channel is changed and an ink droplet is discharged (see JP-A No. 06-71882).

(Ink Cartridge)

In the ink cartridge in accordance with the present invention, the ink in accordance with the present invention is accommodated in a container and, if necessary, the cartridge can contain other appropriately selected components.

No specific limitation is placed on the container, and the shape, structure, size, and material thereof can be appropriately selected according to the object. For example, a container having at least an ink bag formed from an aluminum laminated film or a resin film can be advantageously used.

The ink cartridge will be described below with reference to FIG. 6 and FIG. 7. Here, FIG. 6 shows an example of an ink cartridge in accordance with the present invention, and FIG. 7 shows a configuration also including a case (housing) of the ink cartridge shown in FIG. 6.

Figure 6:
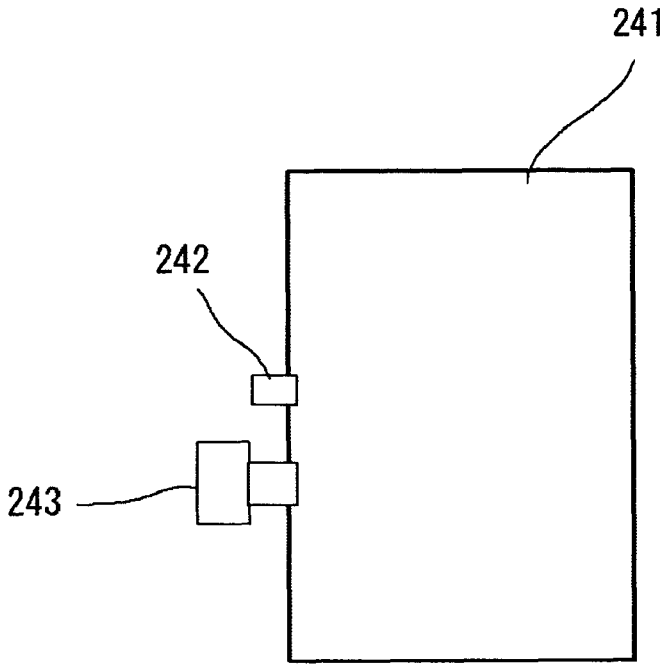
FIG. 6 is a schematic drawing illustrating an example of the ink cartridge in accordance with the present invention.
Figure 7:
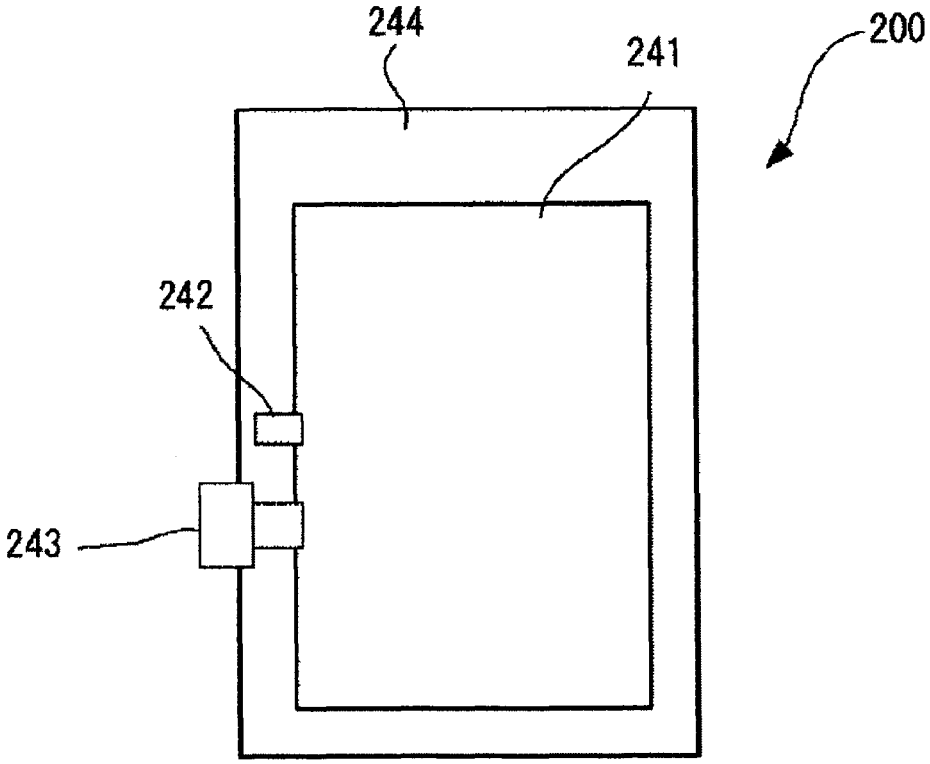
FIG. 7 is a schematic drawing of the ink cartridge of FIG. 6 including a case (housing)

In an ink cartridge 200, as shown in FIG. 6, an ink bag 241 is filled via an ink loading port 242 and evacuated. The ink loading port 242 is then closed by fusing. When the cartridge is used, an ink release port 243 made from a rubber member is pierced with a needle, of the apparatus to enable the supply of ink to the apparatus.

The ink bag 241 is formed from a packaging member such as an air-impermeable aluminum laminated film. The ink bag 241 is usually accommodated, as shown in FIG. 7, inside a plastic cartridge case 244 that can be used by detachably attaching to ink jet apparatuses of various kinds.

The ink cartridge of the present invention stores therein the ink of the present invention and can be used by detachably attaching to the below-described ink jet recording apparatus of the present invention.

(Ink Jet Recording Apparatus and Ink Jet Recording Method)

The ink jet recording apparatus of the present invention contains at least an ink flying unit and, if necessary has appropriately selected other units, for example, a stimulus generating unit and a control unit.

The ink jet recording method of the present invention includes at least an ink flying step and, if necessary, also includes appropriately selected other steps, for example, a stimulus generating step and a control step.

The ink jet recording method of the present invention can be advantageously implemented with the ink jet recording apparatus of the present invention, and the ink flying step can be advantageously performed with the ink flying unit. Other steps can be advantageously performed with respective other units.

-Ink Flying Step and Ink Flying Unit-

The ink flying step is a step in which a stimulus is applied to the ink of the present invention, the ink is caused to fly, and an image is recorded on a recording medium.

The ink flying unit is a unit that applies a stimulus to the ink of the present invention and causes the ink to fly to record an image on a recording medium. No specific limitation is placed on the ink flying unit, and examples of suitable units include various kinds of nozzles for ink ejection.

In accordance with the present invention, it is preferred that at least some components from among a liquid chamber, a fluid resistance portion, an oscillating plate, and a nozzle member of the ink jet head be formed from a material comprising at least one material from among silicon and nickel.

The nozzle diameter of the ink jet nozzle is preferably 30 μm or less, preferably 1 μm to 20 μm.

Further, a configuration is preferred in which a sub-tank for supplying ink is provided above the ink jet head and the ink in the sub-tank be replenished via a supply tube from the ink cartridge.

Further, with the ink jet recording method of the present invention, the maximum ink adhesion quantity is preferably 8 $g/m^2$ to 20 $g/m^2$ at a resolution of 300 dpi or higher.

The stimulus can be generated, for example, with the stimulus generating unit. No specific limitation is placed on the stimulus and it can be appropriately selected according to the object. Examples of suitable stimuli include heat, pressure, vibrations, and light. These stimuli can be used individually or in combinations of two or more thereof. The preferred among them are heat and pressure.

Examples of the stimulus generating unit include a heating device, a pressurizing device, a piezoelectric element, an oscillation generating device, an ultrasound generator, and light. Specific examples include a piezoelectric actuator such as a piezoelectric element, a thermal actuator that uses a thermoelectric conversion element such as heat-generating resistor and employs phase transition caused by film boiling of a liquid, a shape memory alloy actuator that uses a metal phase transition caused by temperature variations, and an electrostatic actuator using electrostatic forces.

No specific limitation is placed on the ink flight mode and it differs depending on the type of the stimulus used. For example, when the stimulus is "heat", thermal energy corresponding to a recording signal is imparted, for example with a thermal head or the like, to the ink located in the recording head, gas bubbles are generated in the ink by the thermal energy, and the ink is ejected as a droplet from a nozzle hole of the recording head by the pressure of the gas bubbles. Further, when the stimulus is "pressure", where a voltage is applied to a piezoelectric element adhesively bonded to a location called a pressure chamber inside the ink channel inside the recording head, the piezoelectric element is deflected, the volume of the pressure chamber is reduced, and the ink is ejected as a droplet from a nozzle hole of the recording head.

The size of the ink droplet that is caused to fly is preferably 1 pl to 40 pl, the ejection velocity is preferably 5 m/s to 20 m/s, the driving frequency is preferably 1 kHz or higher, and the resolution is preferably 300 dpi or higher.

No specific limitation is placed on the control unit, provided that it can control the operation of each of the above-described units, and the control unit can be appropriately selected according to the object. For example, a device such as a sequencer or a computer can be used.

Figure 8:
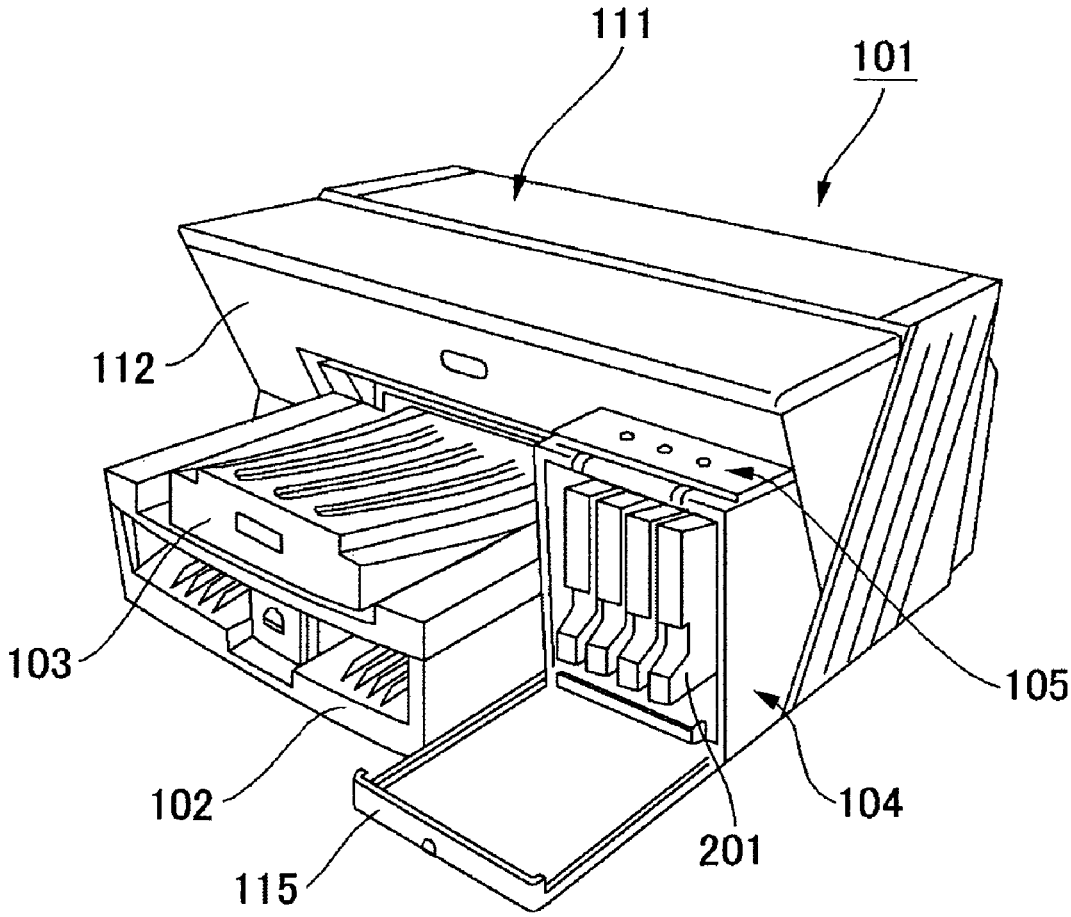
FIG. 8 is a perspective explanatory drawing illustrating a state in which a cover of an ink cartridge loading unit of an ink jet recording apparatus is open.

One mode for implementing the ink jet recording method of the present invention with the ink jet recording apparatus of the present invention will be described below with reference to the appended drawings. The ink jet recording apparatus shown in FIG. 8 has a main apparatus body 101, a paper feed tray 102 mounted on the main apparatus body 101 and serving to load the paper, a paper discharge tray 103 that is mounted on the main apparatus body 101 and serves for stocking the paper on which images have been recorded (formed), and an ink cartridge loading unit 104. A control panel 105 comprising, e.g. control keys and a display, is disposed on the upper surface of the ink cartridge loading unit 104. The ink cartridge loading unit 104 has a front cover 115 that can be opened and closed to install and remove an ink cartridge 201.

Figure 9:
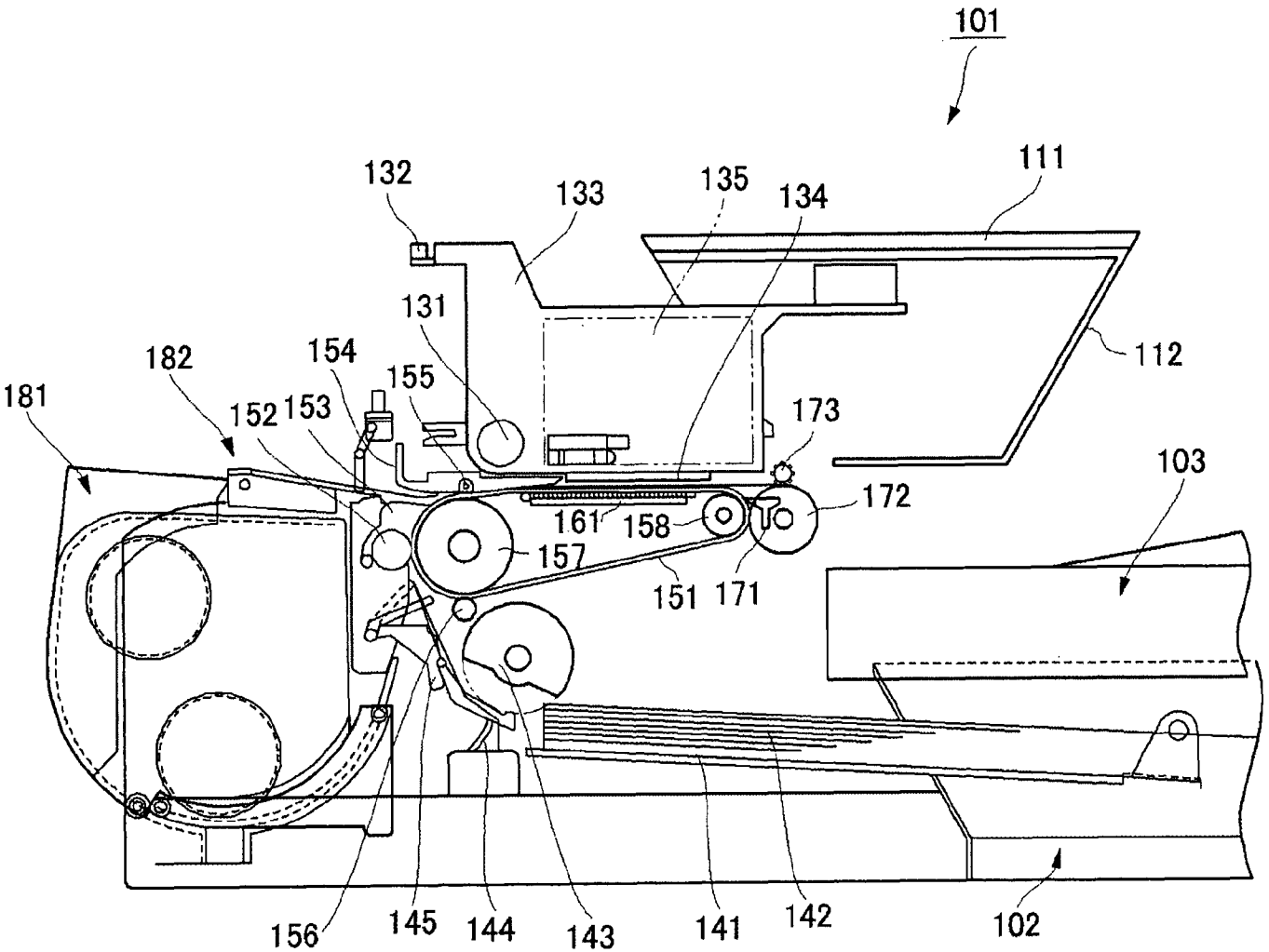
FIG. 9 is a schematic structural drawing illustrating the entire configuration of the ink jet recording apparatus.
Figure 10:
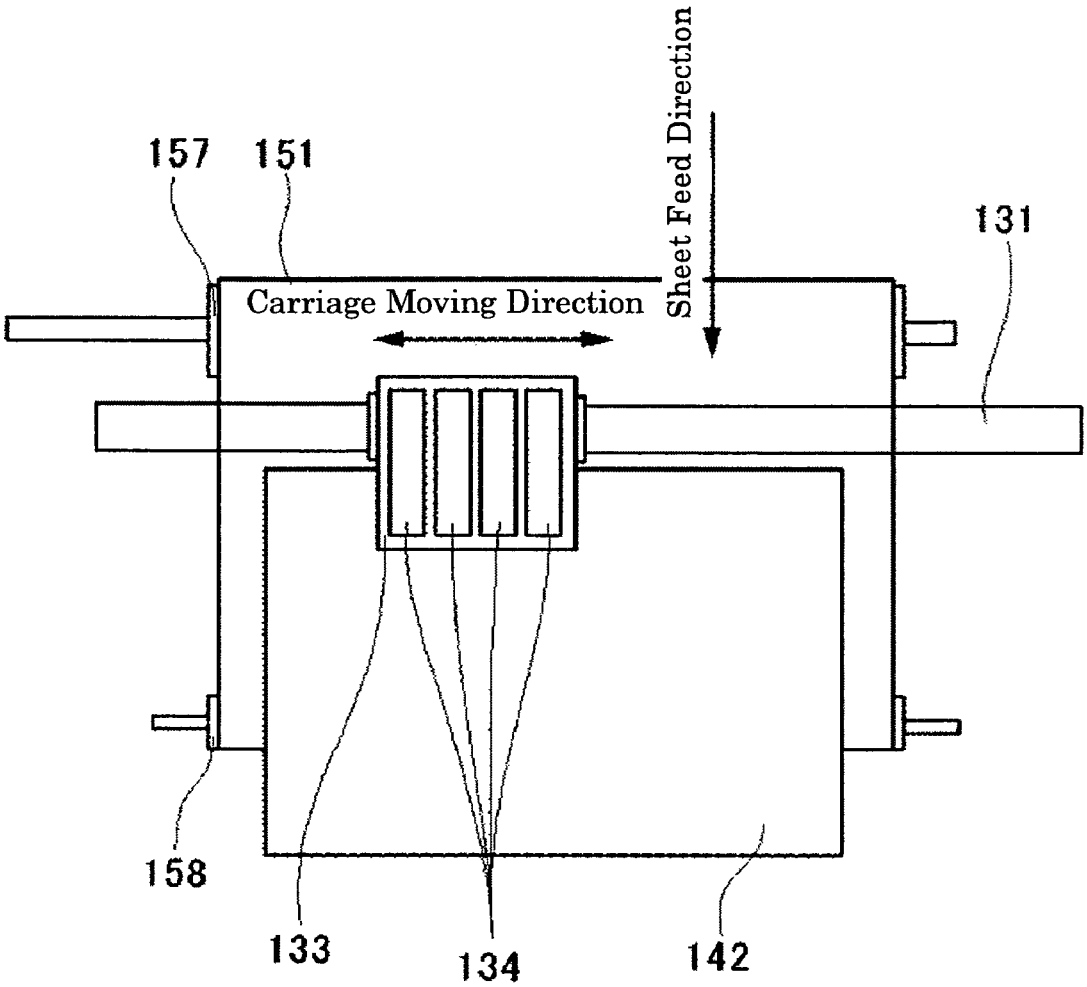
FIG. 10 is a schematic enlarged view illustrating an example of an ink jet head in the ink jet recording apparatus in accordance with the present invention.

Inside the main apparatus body 101, as shown in FIG. 9 and FIG. 10, a cartridge 133 is supported so that it can slide in the main scanning direction by a guide rod 131 and a stay 132 that are guide members extending in the transverse direction between left and right side plates (omitted the figures), and the cartridge can be moved for scanning in the direction shown by an arrow in FIG. 10 by a main scanning motor (not shown in the figure).

In the carriage 133, a recording head 134 composed of four heads for ink jet recording that eject ink droplets of yellow (Y), cyan (C), magenta (M), and black (Bk) colors is attached so that a plurality of ink ejection ports are arranged in the direction perpendicular to the main scanning direction and the ink droplet ejection directions face downward.

Units comprising as an energy generating unit for ejecting the ink a piezoelectric actuator such as a piezoelectric element, a thermal actuator that uses a thermoelectric conversion element such as heat-generating resistor and employs phase transition caused by film boiling of a liquid, a shape memory alloy actuator that uses a metal phase transition caused by temperature variations, or an electrostatic actuator using electrostatic forces can be used as the heads for ink jet recording constituting the recording head 134.

The carriage 133 carries sub-tanks 135 for supplying inks of each color to the recording head 134. The ink of the present invention is supplied via an ink supply tube (not shown in the figure) for replenishment to the sub-tank 135 from the ink cartridge 201 of the present invention that is loaded into the ink cartridge loading unit 105.

On the other hand, a half-moon roller (paper feed roller 143) that can transport paper 142 sheet by sheet from a paper loading unit 141 and a separation pad 144 facing the paper feed roller 143 and made from a material with a high friction coefficient are provided as paper feed unit for feeding paper 142 that was loaded on the paper loading unit (pressure plate) 141 of the paper feed tray 102, and the separation pad 144 is biased toward the paper feed roller 143.

A conveying belt 151 for electrostatically attracting the paper 142 and conveying it, a counter roller 152 for conveying the paper 142 conveyed from the paper feed unit via a guide 145 between the counter roller and the conveying belt 151, a conveying guide 153 that converts the direction of the paper 142 that is fed almost vertically upward by almost 90° to align the paper with the conveying belt 151, and a distal end pressure application roller 155 that is biased toward the conveying belt 151 with a pushing member 154 are provided as a conveying unit for conveying the paper 142 fed from the paper feed unit below the recording head 134. A charging roller 156 is provided as a charging unit for electrically charging the surface of the conveying belt 151.

The conveying belt 151 is an endless belt that is stretched between a conveying roller 157 and a tension roller 158 and can rotate in the belt conveying direction. The conveying belt 151, for example, has a surface layer serving as a paper attraction surface that is formed from a resin material with a thickness of about 40 μm that was not resistance controlled, for example, a copolymer of tetrafluoroethylene and ethylene (ETFE) and a back layer (medium resistance layer, ground layer) that is made from the same material as the resistance layer, but was resistance controlled with carbon. A guide member 161 is disposed opposite a printing region created by the recording head 134 on the rear side of the conveying belt 151. A separation hook 171 for separating the paper 142 from the conveying belt 151, a paper discharge roller 172, and a paper discharge roller 173 are provided as a paper discharge unit for discharging the paper 142 that has been recorded in the recording unit 134. The paper discharge tray 103 is disposed below the paper discharge roller 172.

A two-side paper feed unit 181 is detachably mounted on the rear surface portion of the main apparatus body 101. The two-side paper feed unit 181 takes up the paper 142 returned by the rotation of the conveying belt 151 in the opposite direction, turns the paper over, and feeds the paper again between the counter roller 152 and the conveying belt 151. A manual paper feed unit 182 is provided on the upper surface of the two-side paper feed unit 181.

In the ink jet printing apparatus, the paper 142 is separated and fed sheet by sheet from the paper feed unit, the paper 142 that is fed along an almost vertical direction is guided by the guide 145, and squeezed and conveyed between the conveying belt 151 and the counter roller 152. The distal end of the paper is guided by the conveying guide 153 and pressed against the conveying belt 151 by the distal end pressure application roller 155, to convert the conveying direction thereof by almost 90°.

At this time, the conveying belt 151 is charged by the charging roller 156, and the paper 142 is electrostatically attracted to the conveying belt 151 and conveyed thereby. By driving the recording head 134 according to the image signal, while moving the carriage 133, ink droplets are ejected to record one line on the stopped paper 142, and the next line is recorded after the paper 142 has been conveyed through the predetermined distance. Once a recording end signal or a signal indicating that the rear end of the paper 142 has reached the recording region is received, the recording operation is stopped and the paper 142 is discharged to the paper discharge tray 103.

Where the ink near-end inside the sub-tank 135 is detected, the sub-tank 135 is replenished with the required amount of ink from the ink cartridge 201.

Figure 13:
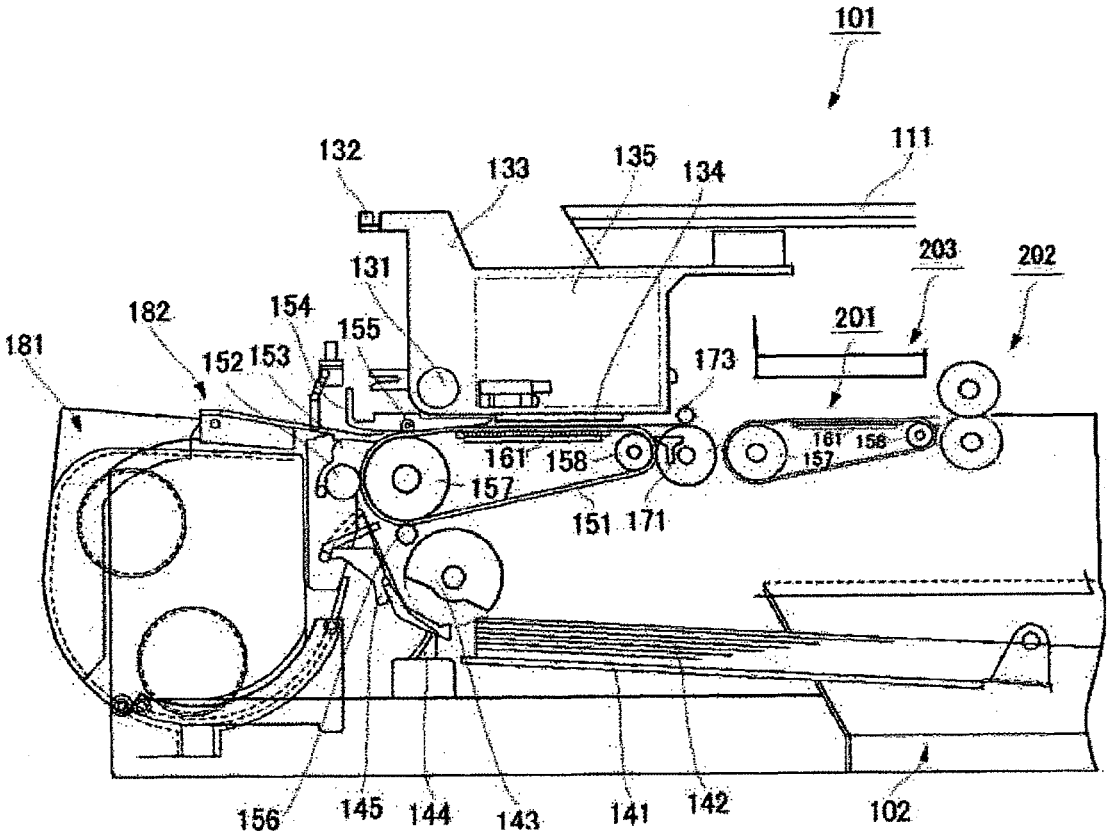
FIG. 13 is a schematic structural drawing illustrating the entire configuration of the ink jet recording apparatus and the fixing apparatus.

In the ink jet recording apparatus shown in FIG. 13, a dry-to-touch drying unit and a thermal fixing unit (drying unit) are installed on the ink jet recording apparatus shown in FIG. 9.

Referring to FIG. 13, the medium transferred from the conveying belt 151 after completion of recording to the conveying belt 151 on the drying unit side via the paper discharge roller 173 is subjected to dry-to-touch drying with a dry-to-touch drying device 203, while exposing the medium, if necessary, to thermal energy or cold air in a contactless state. The recording medium subjected to dry-to-touch drying is successively passed from the distal end thereof via a fixing roller of a fixing device 202, thereby completing the thermal processing.

Figure 14:
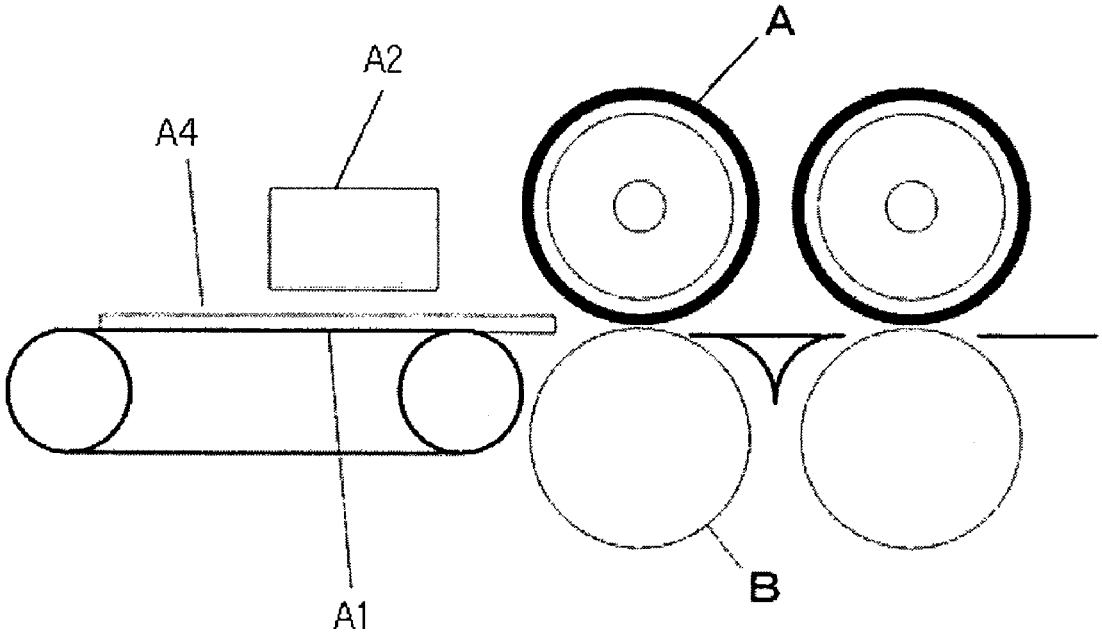
FIG. 14 is a schematic structural drawing illustrating an example of the entire configuration of the externally attached fixing apparatus.
Figure 15:
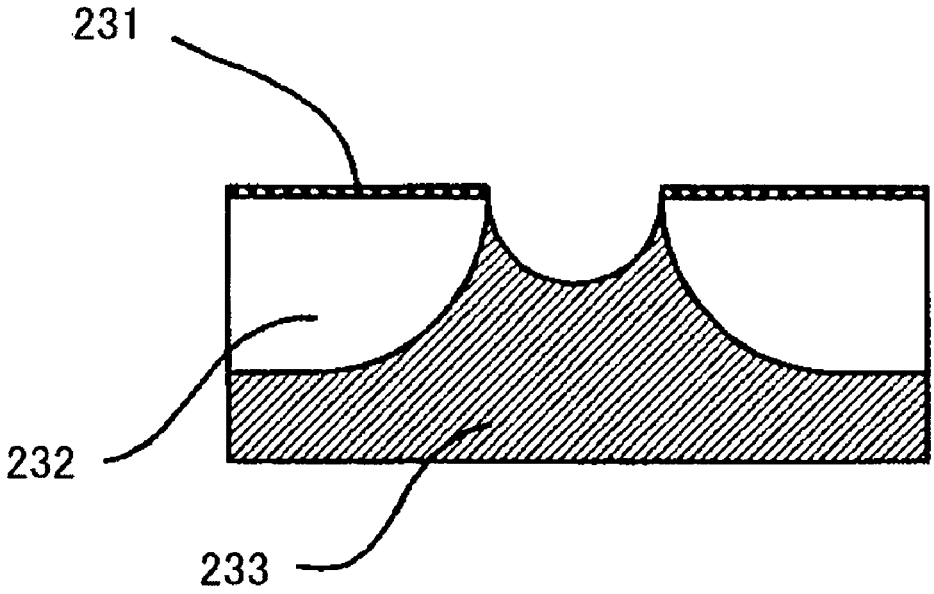
FIG. 15 is a schematic cross-sectional view illustrating an example of a nozzle plate of an ink jet head in the ink jet recording apparatus in accordance with the present invention.

FIG. 14 shows an example of a basic layout in which two fixing rollers of the fixing unit are provided to perform fixing at a higher rate. When a medium A4 is conveyed from a conveying belt A1, dry-to-touch drying is performed with an infrared heater A2. By providing two fixing rollers, a fixing roller A and a fixing roller B, and using the two rollers, the processing can be performed at a rate twice as high as that in the case of one roller. This unit may be provided in a printer as shown in FIG. 13, or may be provided separately as a fixing device.

Such fixing device can be controlled with the fixing temperature control device of the present invention. The configuration of the fixing temperature control device is designed to control the roller temperature by monitoring (detecting) with one temperature sensor the surface temperature of at least one roller of a pair of rollers that are pressed against each other. When a paper sheet passes between the two rollers, control is performed by detecting the roller surface temperature with the temperature sensor and switching between the full-length heat generation state and partial heat generation state for each predetermined interval in a range in which the heater can be conductive. For example, the surface temperature in the partition region of the fixing roller or pressure roller is monitored, and the monitored temperature signal is, for example, feedback returned to the controller. Further, the set temperature can be analogous to the so-called conductive control unit that can be changed (inputted) in advance.

Such fixing device equipped with the fixing temperature control device is described, for example, in JP-B No. 07-82280. A configuration example thereof is shown in FIG. 37 to FIG. 39.

Figure 37:
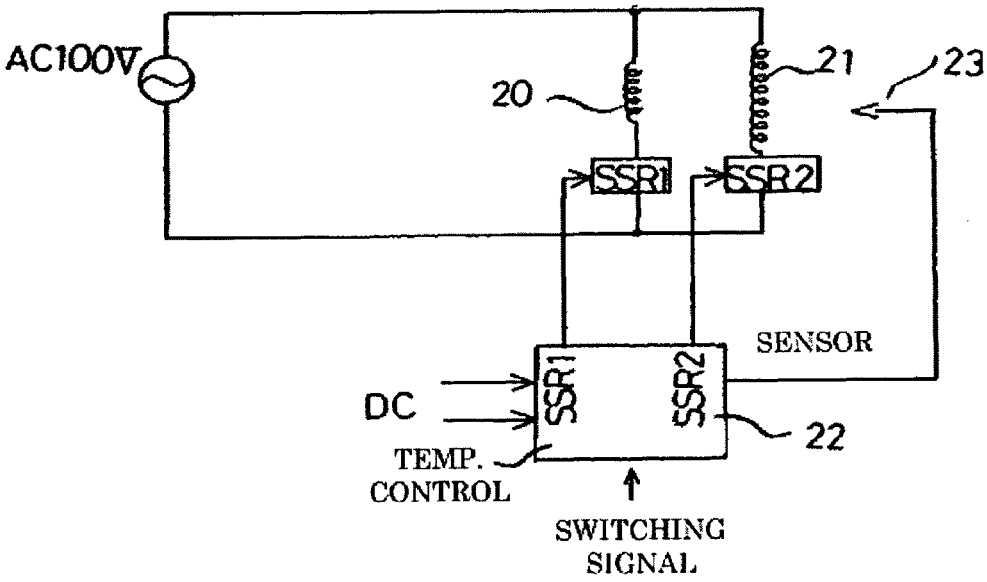
FIG. 37 is a circuit diagram illustrating an example of a circuit of the fixing temperature control device in accordance with the present invention.
Figure 38:
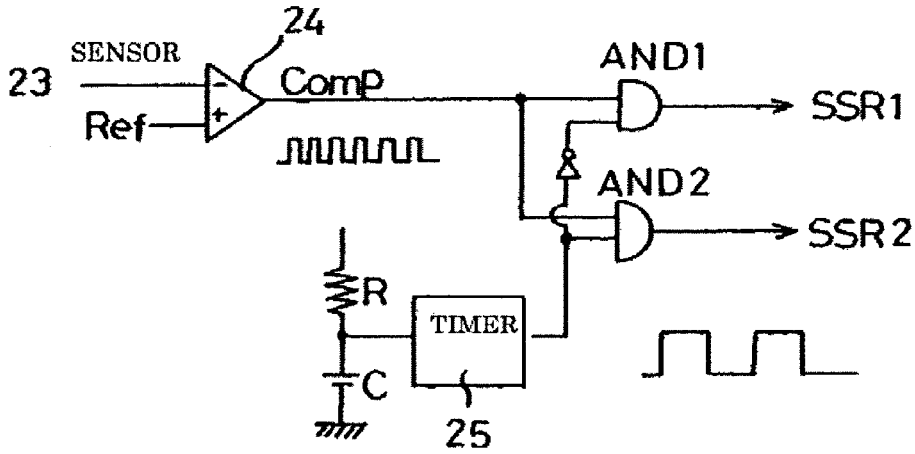
FIG. 38 is a circuit diagram illustrating an example of a temperature control circuit of the fixing temperature control device in accordance with the present invention.

FIG. 37 is a circuit diagram relating to an example in which the present invention is applied to a fixing device having a heater (long heater) 21 disposed inside a fixing roller and having a heat-generating filament along the entire length of the fixing roller and a heater (short heater) 20 having a shorter heat-generating filament. An AC voltage of 100 V can be applied to the short heater 20 and long heater 21 with relays SSR1 and SSR2, respectively, and the relays SSR1 and SSR2 are actuated by signals from a temperature control circuit 22. In the temperature control circuit 22, as shown in detail in FIG. 38, a signal from a temperature sensor 23 provided as a single component for the roller incorporating the short heater 20 and long heater 21 is compared with a signal Ref corresponding to a set temperature with a comparator 24, and when the difference between the two signals becomes equal to or higher than a predetermined value, a temperature control signal is inputted into AND gates AND1 and AND2. In the AND gates AND1 and AND2, signals of a timing in which conduction is possible (set in advance) are alternately inputted from respective timers 25 to the short heater 20 and long heater 21, and when the signal from the comparator 24 and the signal from the timer 25 are superimposed, a signal that actuates the relays SSR1 and SSR2 is outputted. A counter for the number of copies may be used as the timer 25.

Figure 39:
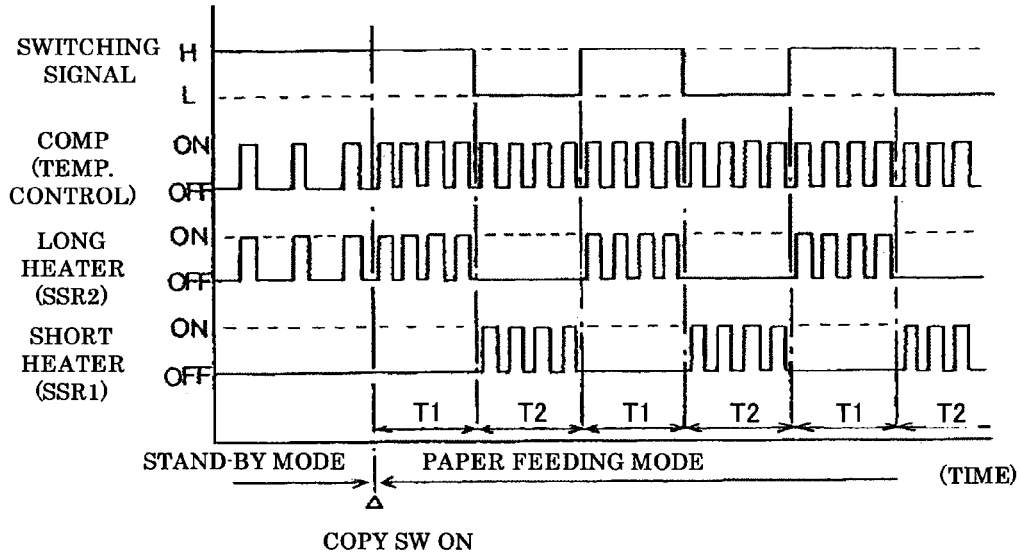
FIG. 39 is a timing chart of the fixing temperature control device in accordance with the present invention.

FIG. 39 is a timing chart of a switching signal of a control heater from the timer 25 of the above-described circuit, a temperature control signal from the comparator 24, and input signals to the relays SSR1 and SSR2 that control the long heater and short heater. In a stand-by state, only the long heater is ON/OFF controlled by the temperature control signal. When paper is passed, the timing in which the conduction of the long heater is possible and the timing in which the conduction of the short heater is possible are switched alternately for T1 and T2 intervals, the respective heater is made conductive at a timing at which the temperature control signal from the comparator and the timing at which the long heater and the short heater can be conducive overlap, and temperature control of the roller is performed.

In such ink jet recording apparatus, when the ink in the ink cartridge 201 in accordance with the present invention is used up, the housing of the ink cartridge 201 can be disassembled and the internal ink bag can be replaced. Further, stable ink supply in the ink cartridge 201 can be performed with a longitudinal front-load configuration. Therefore, the ink cartridge 201 can be easily replaced even when the main apparatus body 101 is disposed so that it cannot be accessed from above, for example, when it is installed in a rack, or when an object is placed on the upper surface of the main apparatus body 101.

Here, an example is explained in which the present invention is applied to a serial-type (shuttle-type) ink jet recording apparatus with a scanning carriage, but the present invention can be similarly applied to the line-type ink jet recording apparatus comprising a line-type head.

Further, the ink jet recording apparatus and ink jet recording method of the present invention can be applied to various recording systems based on the ink jet recording principle, and can be especially advantageously applied to ink jet recording printers, facsimile machines, copiers, and printer-fax-copier all-in-one machines.

An ink jet head employing the present invention will be described below.

Figure 11:
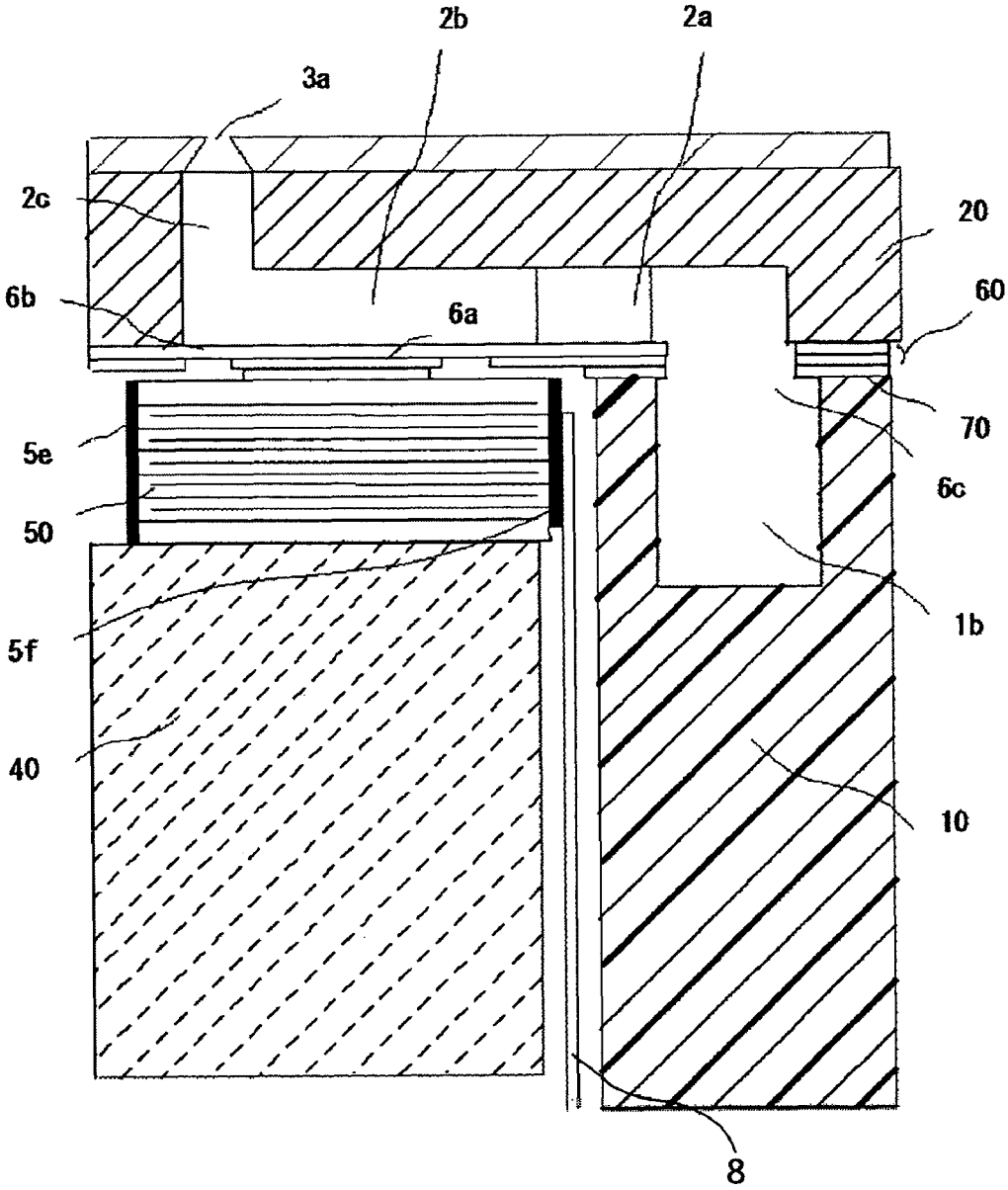
FIG. 11 is an elemental enlarged view illustrating an example of an ink jet head in the ink jet recording apparatus in accordance with the present invention.
Figure 12:
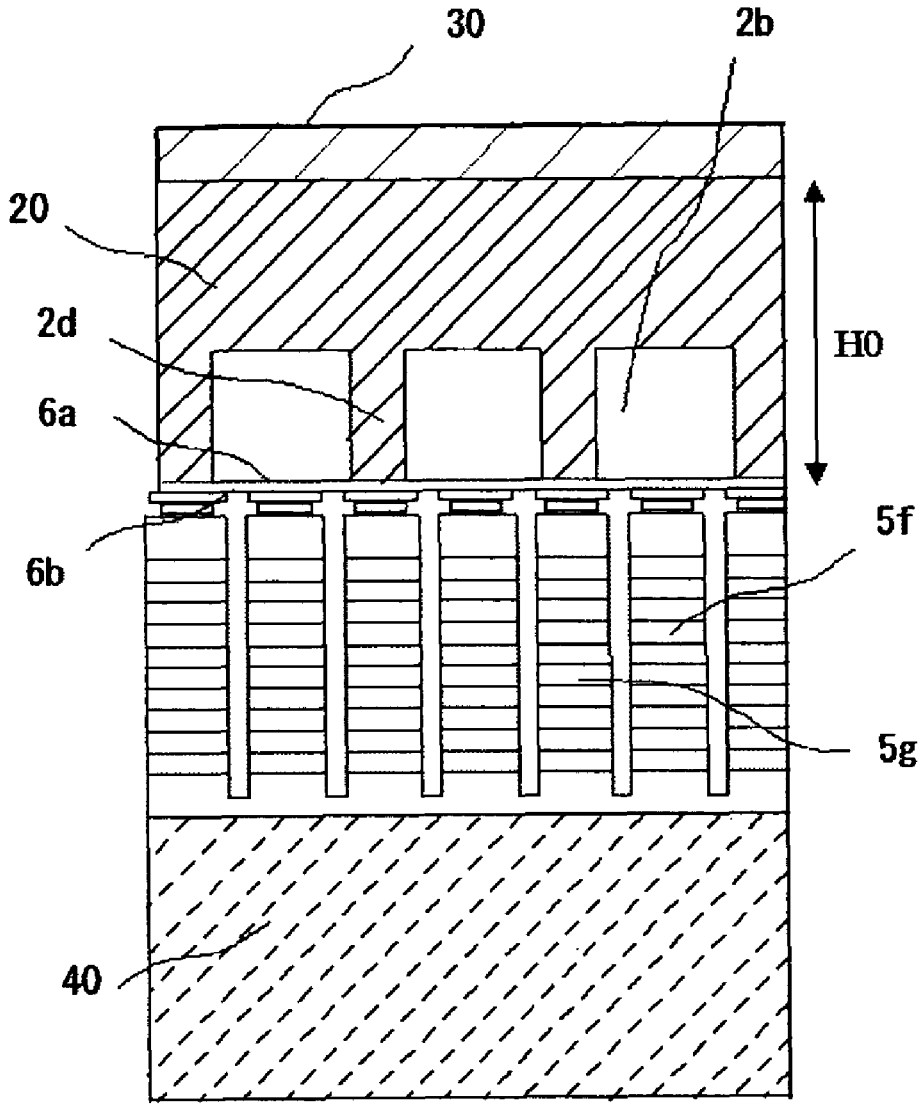
FIG. 12 is an elemental enlarged cross-sectional view illustrating an example of an ink jet head in the ink jet recording apparatus in accordance with the present invention.

FIG. 11 is an elemental enlarged view of an ink jet head relating to an embodiment of the present invention. FIG. 12 is an elemental enlarged cross-sectional view in the direction between the channels of the same head.

The ink jet head comprises a frame 10 having formed therein a cavity serving as an ink supply port (not shown in the figure) and a common liquid chamber 1*b*, a flow path 20 having formed therein a cavity serving as a resistance portion 2*a* and a pressurized liquid chamber 2*b* and a link port 2*c* linked to a nozzle 3*a*, a nozzle plate forming the nozzle 3*a*, an oscillation plate 60 having a convex portion 6*a*, a diaphragm portion 6*b*, and an ink inflow port 6*c*, a laminated piezoelectric element 50 joined with an adhesive layer 70 to the oscillation plate 60, and a base 40 that fixes the laminated piezoelectric element 50.

The base 40 is made from a barium titanate ceramic and has two laminated piezoelectric elements 50 disposed in row and joined thereto.

The laminated piezoelectric element 50 is obtained by alternately laminating piezoelectric layers of lead zirconium titanate (PZT), each having a thickness of 10 μM to 50 μm, and internal electrode layers composed of silver-palladium (AgPd), each layer having a thickness of several micrometers. The internal electrode layers are connected to the external electrodes at both ends.

The laminated piezoelectric element 50 is split in a comb-tooth manner by half-cut dicing, and each section is used as a drive portion 5*f* and a support portion 5*g* (non-drive portion). The external side of the external electrode is restricted in length by machining such as notching so that it can be split by half-cut dicing, and the sections obtained serve as a plurality of individual electrodes. The other side is conductive, without being split by dicing, and serves as a common electrode.

An FPC 8 is joined by soldering to individual electrodes of the drive portion. Further, in the common electrode, an electrode layer is provided at the end portion of the laminated piezoelectric element and bent to joint to the Gnd electrode of the FPC 8. A Driver IC (not shown in the figure) is mounted on the FPC 8, and drive voltage application to the drive portion 5*f* is controlled thereby.

The oscillation plate 60 is formed from the thin-film diaphragm portion 6*b*, the island-shaped convex portion (island portion) 6*a* that is formed in the central zone of the diaphragm portion 6*b*, joined to the laminated piezoelectric element 50 and serves as the drive portion 5*f*, a thick-film portion including a beam for connection to the support portion, and an opening serving as the ink inflow port 6*c*, by two-layer stacking a Ni plated film obtained by an electroforming method. The thickness of the diaphragm portion is 3 μm and the width is 35 μm (one side).

Joining of the island-shaped convex portion 6*a* of the oscillation plate 60 and the drive portion 5*f* of the laminated piezoelectric element 50, and of the oscillation plate 60 and the frame 10 is performed with the patterned adhesive layer 70 including a gap material.

A silicon single-crystal substrate is used for the flow path plate 20, and the plate is patterned by an etching method to form a cavity serving as the fluid resistance portion 2*a* and pressurized fluid chamber 2*b* and a through port serving as the link port 2*c* in a position corresponding to the nozzle 3*a*.

A portion remaining after etching serves as a partition wall 2*d* of the pressurized fluid chamber 2*b*. Further, a portion of decreased etching width is provided in the head, and this portion serves as the fluid resistance portion 2*a*.

The nozzle plate 30 is formed of a metal material, e.g., of a Ni plated film obtained by electroforming and has a large number of nozzles 3*a* serving as fine ejection ports for causing ink droplets to fly. The nozzles 3*a* are formed to have a hone-like inner (internal) shape (may also have an almost cylindrical rod-like or barrel-like shape). The diameter of the nozzle 3*a* is 20 μm to 35 μm, as a diameter on the ink droplet ejection port. The nozzle pitch in each row is 150 dpi.

The frame 10 that forms a cavity serving as the ink supply port and common fluid chamber 1*b* is produced by molding a resin.

In the ink jet recording head of the above-descried configuration, when a drive waveform (a pulsed voltage of 10 V to 50 V) is applied to the drive portion 5*f* according to a recording signal, a displacement in the lamination direction is induced in the drive portion 5*f*, the pressurized liquid chamber 2*b* is pressurized via the oscillation plate 60, the pressure therein is increased, and an ink droplet is ejected from the nozzle 3*a*.

As the ejection of ink droplet is competed, the ink pressure inside the pressurized liquid chamber 2*b* is reduced, a negative pressure is generated inside the pressurized liquid chamber 2*b* by the inertia of ink flow and discharge process of the drive pulse, and a transition is made to an ink filling step. At this time, the ink supplied from the ink tank flows into the common liquid chamber 1*b*, and the pressurized liquid chamber 2*b* is filled with the ink from the common liquid chamber 1*b* via the ink inflow port 6*c* and through the fluid resistance portion 2*a*.

The fluid resistance portion 2*a* effectively attenuates residual pressure oscillations after the ejection and also creates resistance to a refill by surface tension. By appropriately selecting the fluid resistance portion, it is possible to attain a balance between the attenuation of residual pressure and refill and to shorten time (drive period) to the next ink droplet ejection operation.

<Explanation of Relationship Between Nozzle Plate, Ink, and Recording Medium>

When ink having a comparatively low surface tension, such as the ink used in the image forming method of the present invention, is used, it is preferred that the nozzle plate have excellent water repellency and ink repellency. This is because by using a nozzle plate with excellent water repellency and ink repellency it is possible to form correctly an ink meniscus even with the ink having a low surface tension, thereby improving the formation of ink droplets. Where the meniscus is formed correctly, application of unidirectional tension to the ink when the ink is ejected is prevented, ink ejection curvature is decreased, and an image with a high dot position accuracy can be obtained.

Furthermore, when printing is performed on a medium with low absorptivity, as the recording medium in accordance with the present invention, accuracy of dot positioning greatly affects the image quality.

In other words, because the ink hardly spreads on the medium with low absorptivity, even slight decrease in dot position accuracy generates zones in which ink is not embedded in the medium, that is, white spots. These zones in which the ink is not embedded in the medium lead to uneven image density and decrease in image density, thereby degrading image quality.

However, with the ink jet head in accordance with the present invention, dot position accuracy is high even though the ink with a low surface tension is used, and the ink is embedded even in a medium with a low absorptivity. Therefore, uneven image density and decrease in image density are prevented and a print with a high image quality can be obtained.

<Ink Repellent Layer>

The surface roughness Ra of the ink repellent layer in the ink head used in accordance with the present invention is preferably 0.2 μm or less. By making the surface roughness Ra of 0.2 μm or less, it is possible to reduce the amount of wiping residues during wiping.

FIG. 15 and FIG. 16A to FIG. 16C are cross-sectional views of the nozzle plate of the ink jet head used in accordance with the present invention.

In the present embodiment, a nozzle plate 232 that is a plate base material of the ink jet head is produced by Ni electroforming, an ink repellent film 231 that is a silicone resin film with a thickness of 1 Å (0.1 nm) is formed on the surface thereof, and the surface roughness (Ra) of the ink repellent film is preferably 0.2 μm or less. The thickness of the ink repellent film 231 is preferably 0.1 μm or more, even more preferably 0.5 μm or more.

Figure 16A:
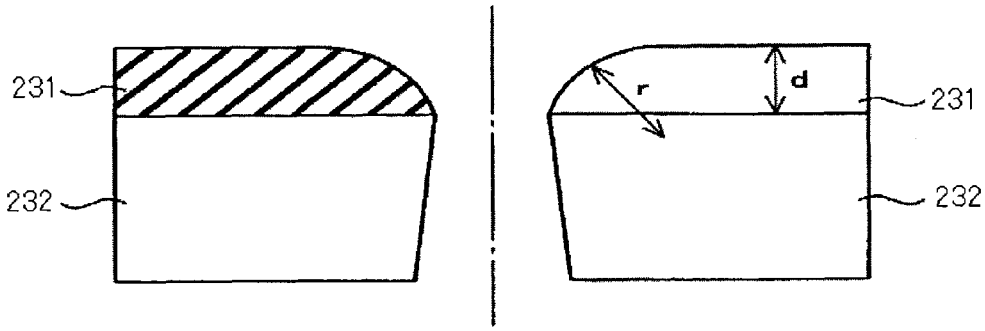
FIG. 16A is a schematic explanatory drawing illustrating a nozzle plate of an ink jet head in the ink jet recording apparatus in accordance with the present invention.
Figure 16B:
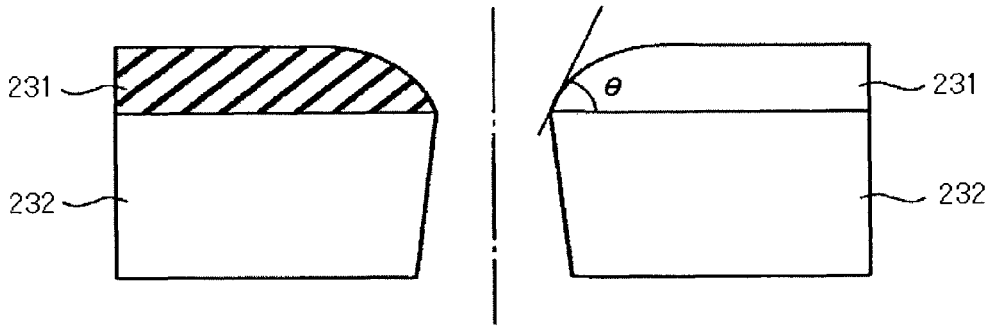
FIG. 16B is a schematic explanatory drawing illustrating a nozzle plate of an ink jet head in the ink jet recording apparatus in accordance with the present invention.
Figure 16C:
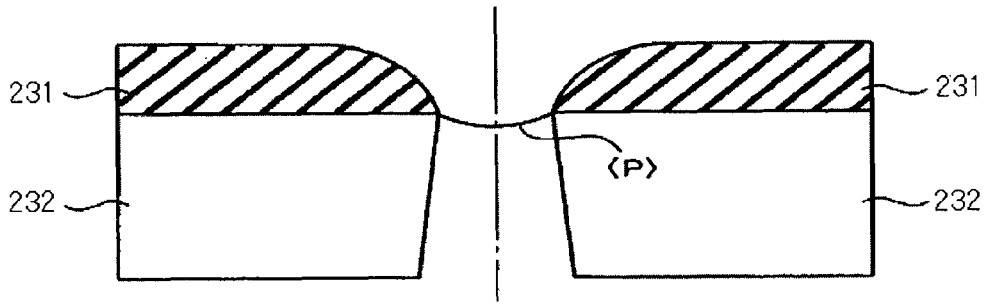
FIG. 16C is a schematic explanatory drawing illustrating a nozzle plate of an ink jet head in the ink jet recording apparatus in accordance with the present invention.

During ink filling, as shown in FIG. 16C, a meniscus (liquid surface) P is formed in a boundary portion of the ink repellent film 231 composed of a silicon resin film and the nozzle plate 232.

The ink repellent film is so formed that a cross section area in a plane perpendicular to a central line of an opening of the ink repellant film that is formed on the plate surface provided with openings (nozzles) for ink ejection in the ink jet head in the vicinity of the openings increases successively with the distance from the base material surface.

The ink repellent film preferably has a curved surface shape in the vicinity of the opening. Further, the curvature radius of the curve of the ink repellent film in the vicinity of the opening in the cross section in the plane including the central line of the opening is preferably equal to or more than the thickness of the ink repellent film.

Further, it is also preferred that the curve of the ink repellent film from the edge of the opening to the vicinity of the opening in the cross section in the plane including the central line of the opening be an almost circle-arc curve, and the curvature radius of the circular arc is preferably equal to or more than the thickness of the ink repellent film.

A tangent line to the ink repellent film passing through the edge of the opening in the plane including the central line of the opening preferably forms an angle of less than 90 degrees with the nozzle member surface including the end portion.

The opening of the nozzle plate 232 is so provided that the cross section formed by the plane perpendicular to the central line represented by a dot-dash line in FIG. 16A to FIG. 16C has an almost round shape with this central line as a center. Further, the ink repellent film 231 formed on the ink ejection surface in the nozzle plate 232 is formed such that the cross section area of the opening portion formed by the plane perpendicular to the central line increases successively with the distance from the nozzle plate 232.

More specifically, as shown in FIG. 16A, in the open portion of the ink repellent film 231, the curve from the opening edge of the nozzle plate 232 in the vicinity of the opening has a round shape with a curvature radius r. This curvature radius r is preferably equal to or more than the thickness d of the ink repellent film 231 outside the zone in the vicinity of the open portion.

The thickness d is a thickness of ink repellent film 231 outside the round portion that is the open portion and preferably is the maximum thickness of the ink repellent film.

Thus, the open portion of the ink repellent film 231 that is connected to the opening of the nozzle portion 232 has a shape without sharp edges (smooth curve without sharp portions) and is a curve having no protruding zones. Therefore, when it is wiped with a wiper formed from a material such as rubber, the ink repellent film 231 can be prevented from being separated from the nozzle plate 232 as a result of sharp portions being caught by the wiper.

Further, as shown in FIG. 16B a tangent line to the ink repellent film 231 passing through the edge of the opening in the cross section along the plane including the central line of the opening of the nozzle plate 232 preferably forms an angle θ of less than 90 degrees with the surface of the nozzle plate 232 including the opening edge of the nozzle plate 232 connected to the edge of the opening portion.

Where the angle θ between the tangent line to the ink repellent film 231 at the edge of the opening portion and the surface of the nozzle plate 232 is less than 90 degrees, as shown in FIG. 16C, a meniscus (liquid surface) P is formed with good stability in the boundary portion of the ink repellent film 231 and the nozzle plate 232, and the possibility of the meniscus P being formed in the portion can be greatly reduced. As a result, because the meniscus formation surface is stabilized, ink ejection stability during image formation in the image forming apparatus using the ink jet head including the nozzle plate 232 can be improved.

A liquid silicone resin curable at room temperature is preferably used as the silicone resin employed in the present embodiment and a resin of a type such that curing is accompanied by a hydrolysis reaction is even more preferred. In the below-described examples, SR2411 manufactured by Toray-Dow Corning Co., Ltd. is used.

Table A below shows the results obtained in evaluating the shape of the ink repellent film 231 from the opening edge of the nozzle plate 232 to the vicinity of the opening edge in the ink jet head of the present embodiment and the occurrence of ink residue around the nozzle, edge separation, and ejection stability.

TABLE A

| Edge shape | | Ink residue | Edge separation | Ejection stability |
|---|---|---|---|---|
| Sharp tip is present | | Some ink residue occurs | Occurs | Good |
| No sharp tip (round shape) | $\theta \leqq 90°$ | None | None | Good |
| | $\theta > 90°$ | None | None | Poor |
| | $r \leqq d$ | None | None | Good |
| | $r < d$ | None | Some edge separation occurs | Poor |

The results shown in Table A demonstrate that where almost sharp tip is contained in the edge portion (in the vicinity of the opening portion edge) of the ink repellent film 231, ink residue is observed around the nozzle and edge separation occurs due to wiping.

Figure 17A:
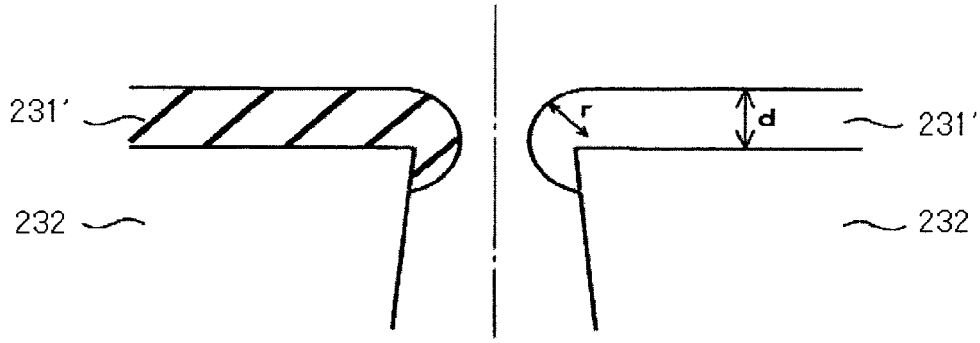
FIG. 17A is a schematic explanatory drawing illustrating a nozzle plate of a comparative ink jet head.
Figure 17B:
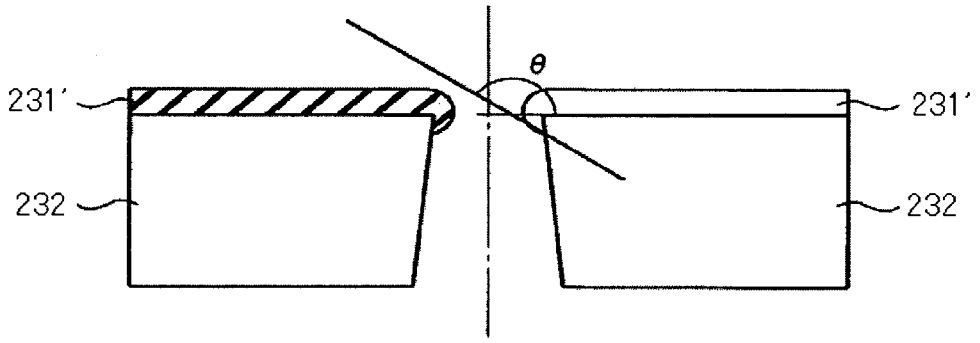
FIG. 17B is a schematic explanatory drawing illustrating a nozzle plate of a comparative ink jet head.

With the round shape, no ink residues occur, but in the configuration with r<d, such as shown by way of an example in FIG. 17A for the purpose of comparison, some edge separation is observed, and in the configuration with θ>90°, such as shown in FIG. 17B, ejection of ink droplets is unstable.

Figure 17C:
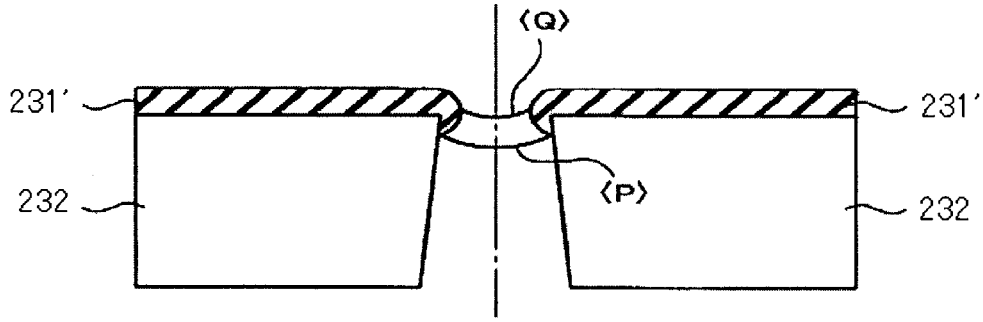
FIG. 17C is a schematic explanatory drawing illustrating a nozzle plate of a comparative ink jet head.

Further, when r<d and θ>90°, as shown in FIG. 17C, a meniscus (liquid level) P can be formed in the boundary portion of the ink repellent film 231 and nozzle plate 232 during ink filling and a meniscus Q can be formed in the convex portion (portion in which the area of the cross section perpendicular to the central line in the open portion is the smallest) facing the center of the open portion of the ink repellent film 231'. As a result, spread is sometimes observed in ink ejection stability during image recording in the ink jet recording apparatus using the ink jet head including the nozzle plate 232.

A method for manufacturing a nozzle member of the ink jet head of the above-described embodiment will be described below.

Figure 18:
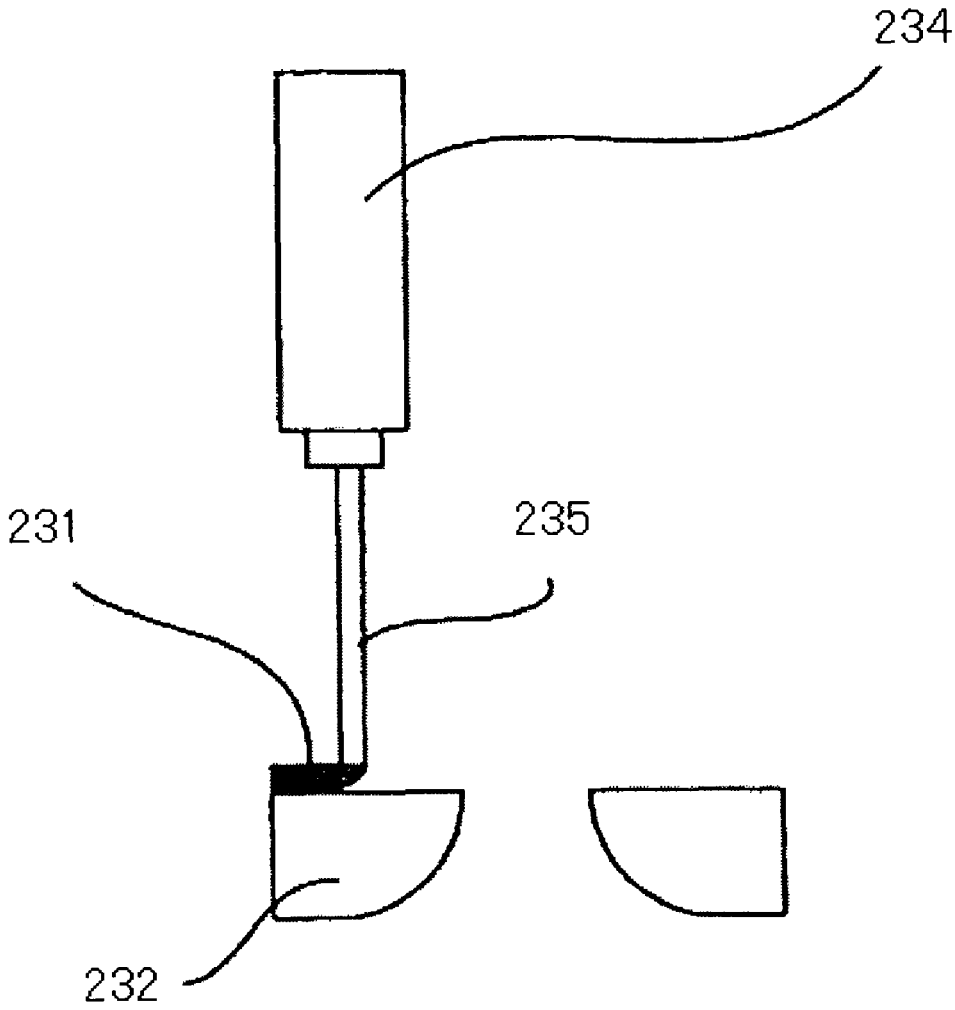
FIG. 18 illustrates a state in which a silicone resin is applied to form an ink repellant film by coating using a dispenser.

FIG. 18 shows a configuration in which the ink repellent film 231 is formed by coating a silicone resin with a dispenser 234 of the present embodiment.

The dispenser 234 is disposed for coating a silicone solution on the ink discharge surface side of the nozzle 232 produced by Ni electroforming, and a silicon resin film can be selectively formed on the ink ejection surface of the nozzle plate 232, as shown in the above-described FIG. 15 and FIG. 16A to FIG. 16C, by scanning the dispenser 234, while ejecting the silicone from the distal end of a needle 235 and maintaining a predetermined constant spacing between the nozzle plate 232 and the needle 235.

The silicone resin used in the present embodiment is silicone resin SR2411 curable at normal temperature (manufactured by Toray-Dow Corning Co., Ltd., viscosity 10 mPa·s). A certain accumulation of the silicone is observed in the nozzle hole and the rear surface of the nozzle plate. The thickness of the silicone resin film that is selectively formed in the above-described manner is 1.2 μm and the surface roughness (Ra) is 0.18 μm.

Figure 19A:
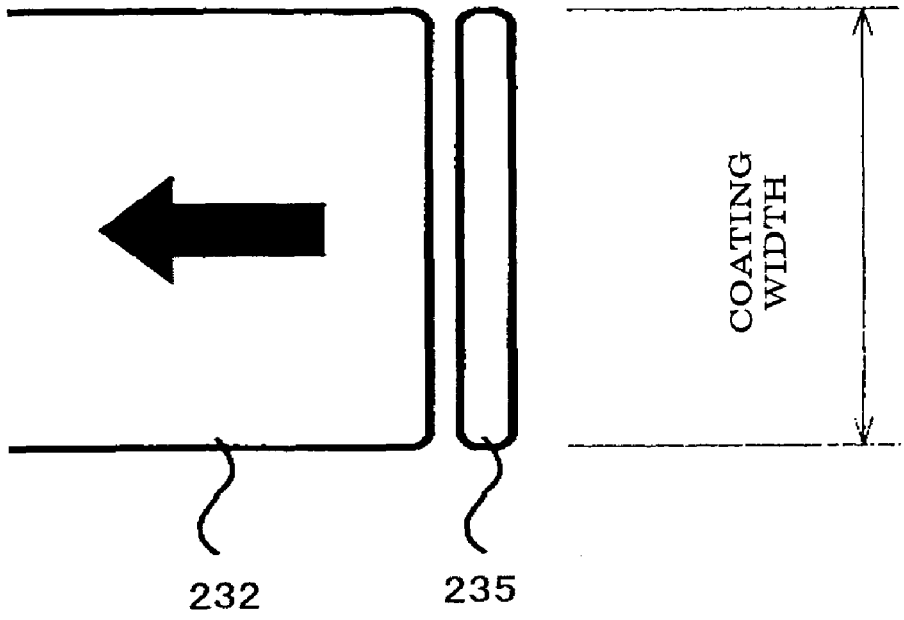
FIG. 19A illustrates the relationship between a coating port of a needle distal end and a coating width on a nozzle plate that is a coating object in the ink jet recording apparatus in accordance with the present invention.

The coating orifice at the distal end of the needle 235 of the present embodiment, as shown in FIG. 19A, is ensured to have a width equal to the coating width of the nozzle plate 232 that is the coating object. As a result, coating of the entire coating object can be completed by scanning the dispenser (not shown in the figure) once in the coating direction.

Figure 19B:
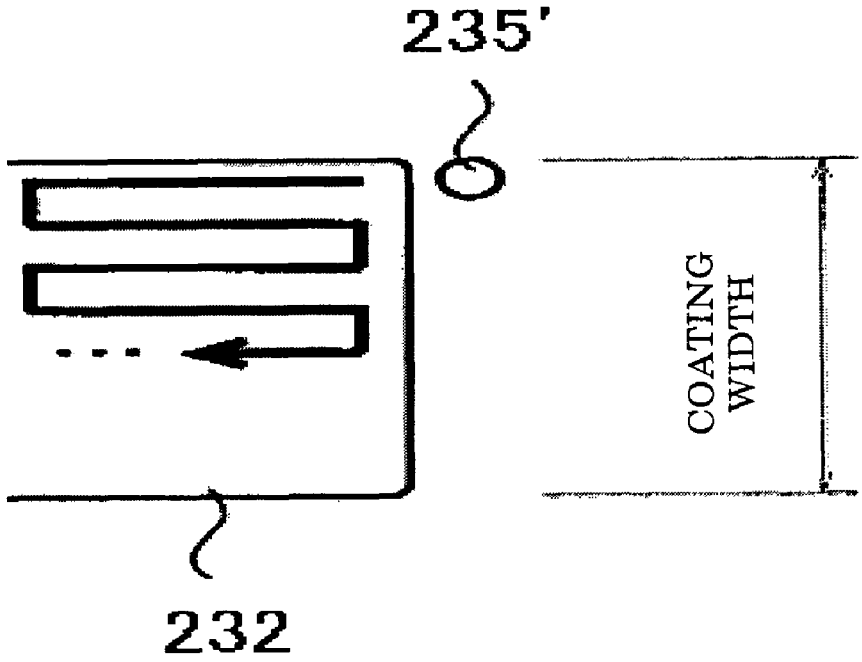
FIG. 19B illustrates the relationship between a distal end of a typical needle and a coating width on a nozzle plate that is a coating object.

Thus, the scanning direction for coating operation can be only one direction and the necessity of changing the direction, as shown in FIG. 19B, to perform scanning in the opposite direction can be eliminated.

Here, the distal end of the conventional needle 235 is much narrower, as shown in FIG. 19B, than the coating width on the nozzle plate 232 that is the coating object. Therefore, in order to complete scanning of the entire scanning object, it is necessary to perform scanning in a plurality of directions by changing the scanning direction for the coating operation by 90°, shifting the distal end of the needle, and performing scanning in the opposite direction. As a result, a coating film of a uniform thickness is difficult to obtain on the entire coating object.

With the present embodiment, the width of the coating orifice at the distal end of the needle 235 is ensured to be equal to the coating width on the nozzle plate 232 that is the coating object, whereby a uniform coating thickness can be obtained over the entire coating object and surface can be finished with good accuracy.

Figure 20:
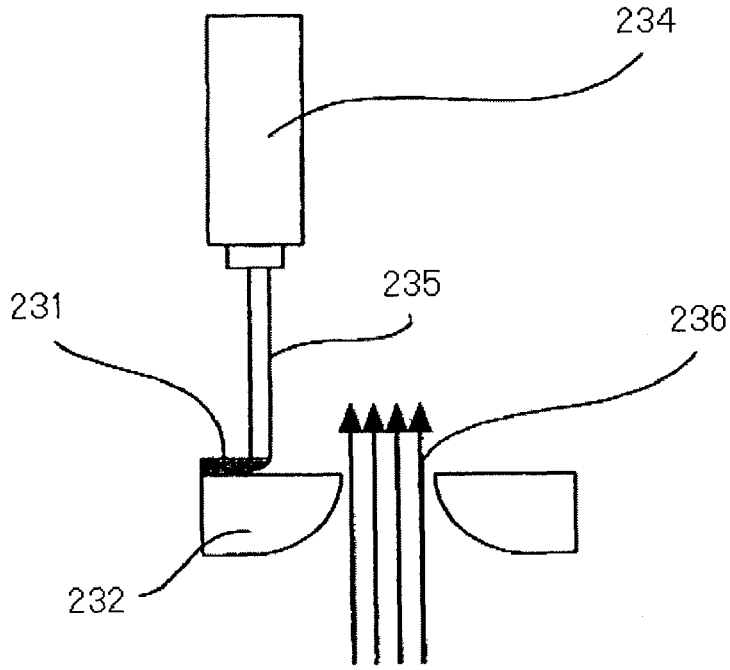
FIG. 20 illustrates a coating operation using a dispenser.

FIG. 20 illustrates a coating operation using the dispenser 234 of the present embodiment. The basic configuration is identical to that shown in FIG. 18, but silicone is coated, while spraying gas 236 from a nozzle hole (opening) of the nozzle plate 232. A variety of gases that do not easily participate in chemical reaction with silicone that will be coated may be used as the gas 236. For example, air can be used. By performing coating, while spraying gas 236 from the nozzle hole, it is possible to form a silicone resin film only on the nozzle surface, excluding the nozzle hole of the nozzle plate 232.

Figure 21:
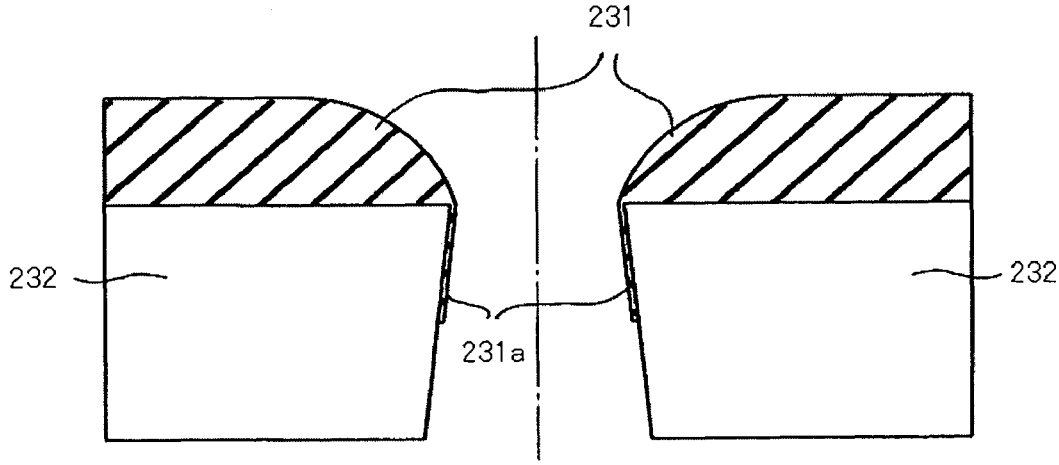
FIG. 21 illustrates a state in which an ink repellent layer from a silicon resin is formed to a desired depth on the inner wall of a nozzle.

Further, when coating is performed by using a similar silicone resin, but without spraying the gas 236 as described above, and then spraying the air 236 from the nozzle 232 after the silicone resin has penetrated to the predetermined depth, it is possible to form an ink repellent layer of the silicone resin to a desired depth (for example, about several μm) on the inner wall of the nozzle, as shown in FIG. 21. Thus, in addition to the above-described ink repellent film 231 on the ink ejection surface, a very thin ink repellent film 231*a* (ink repellent film on the inner wall of the opening) can be formed to the predetermined depth from the opening edge of the nozzle plate 232.

Wiping was performed using an EPDM rubber (rubber hardness 500 with respect to the ink repellent film 231 of the nozzle plate produced in the above-described manner. The results obtained demonstrated that the ink repellent film 231 of the nozzle plate can maintain good ink repellency with respect to 1000 cycles of wiping. The nozzle member having the ink repellent film formed thereof was immersed for 14 days into ink at 70° C. The results obtained demonstrated that unchanged ink repellency could be maintained even after the immersion.

Figure 22:
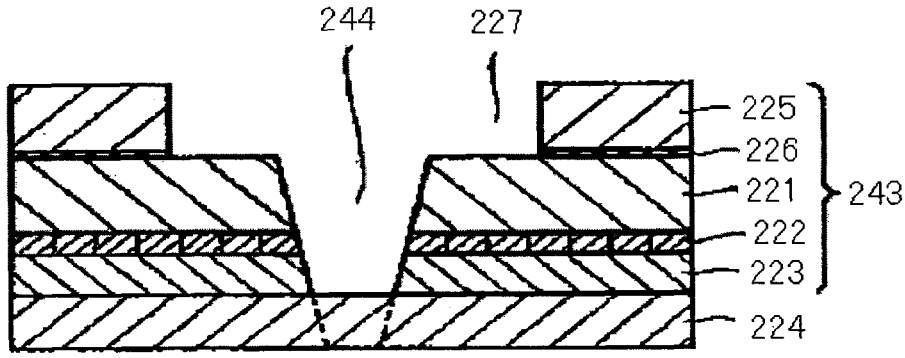
FIG. 22 illustrates a state in which nozzle holes are formed by excimer laser processing in an example of the ink jet head in the ink jet recording apparatus in accordance with the present invention.

FIG. 22 illustrates an example of the ink jet head in accordance with the present invention and shows a state in which a nozzle hole is formed by excimer laser processing. A nozzle plate 243 is obtained by joining a resin member 221 and a high-rigidity member 225 with a thermoplastic adhesive 226. A $SiO_2$ thin-film layer 222 and a fluorine-containing water-repellent layer 223 are successively laminated on the surface of the resin member 221, a nozzle hole 244 of a required diameter is formed in the resin member 221, and a nozzle linking orifice 227 that is linked to the nozzle hole 244 is formed in the high-rigidity member 225. The $SiO_2$ thin-film layer 222 is formed by a method that produces a relatively small amount of heat, that is, at a temperature within a range in which the resin member is not thermally affected. More specifically, the preferred methods include sputtering, ion-beam vapor deposition, ion plating, CVD (chemical vapor deposition), and P-CVD (plasma chemical vapor deposition).

From the standpoint of process time and material cost, it is preferred that the thickness of the $SiO_2$ thin-film layer 222 be the minimum required thickness within a range in which the adhesive strength is ensured. This is because if the thickness is too large, it sometimes hinders the formation of nozzle hole with the excimer laser. Thus, in some cases part of the $SiO_2$ thin-film layer 222 is not sufficiently processed and an unprocessed section remains even if a good nozzle hole shape is obtained in the resin member 221. Therefore, it can be said that the suitable thickness is within a range of 1 Å to 300 Å (0.1 nm to 30 nm) in which good adhesive strength can be ensured and no $SiO_2$ thin-film layer 222 remains during excimer laser processing. An even more preferred range is 10 Å to 100 Å (1 nm to 10 nm). Test results demonstrated that even at a $SiO_2$ film thickness of 30 Å (3 nm) sufficient adhesivity is obtained and no problems are associated with excimer laser processability. Further, extremely small processing residues are observed at a film thickness of 300 Å (30 nm), and rather large processing residues are generated when the thickness exceeds 300 Å (30 nm), these residues creating an abnormal nozzle shape that cannot be used.

Any material that repels ink can be used for the ink repellent layer, specific examples including fluorine-containing water repellent materials and silicone-based water repellent materials.

A variety of materials are known as fluorine-containing water repellant materials. Here, necessary water repellency is obtained by depositing a mixture of perfluoropolyoxetane and modified perfluoropolyoxetane (trade name Optool DSX, manufactured by Daikin Industries, Ltd.) to a thickness of 1 Å to 30 Å (0.1 nm to 3 nm). Test results demonstrated no difference in water repellency and wiping endurance between the Optool DSX films with a thickness of 10 Å, 20 Å, and 30 Å. Therefore, with consideration for the film cost, the preferred range is 1 Å to 20 Å (0.1 nm to 2 nm). However, for certain inks, from the standpoint of reliability, a thicker water repellent film will maintain performance for a longer time. Therefore, in such cases, a thickness range of 100 Å to 200 Å (10 nm to 20 nm) is preferred. Further, an adhesive tape 224 obtained by coating a pressure-sensitive adhesive on a resin film is bonded to the surface of the fluorine-containing water repellent film 223, thereby providing it with additional function during excimer laser processing. A silicone-based water repellent material also can be used.

Liquid silicone resins or elastomers curable at room temperature are known as silicone-based water-repellent materials, and an ink repellent film is preferably formed by coating them on the base material surface and allowing to stay in the air at room temperature to induce polymerization and curing.

Liquid silicone resins or elastomers curable by heating are also known as silicone-based water-repellent materials, and an ink repellent film is preferably formed by coating them on the base material surface and curing by heating.

Liquid silicone resins or elastomers curable by UV radiation are also known as silicone-based water-repellent materials, and an ink repellent film is preferably formed by coating them on the base material surface and curing by irradiation with UV radiation.

The viscosity of the silicone-based water repellent material is preferably 1,000 cps (centipoise) or less.

Figure 23:
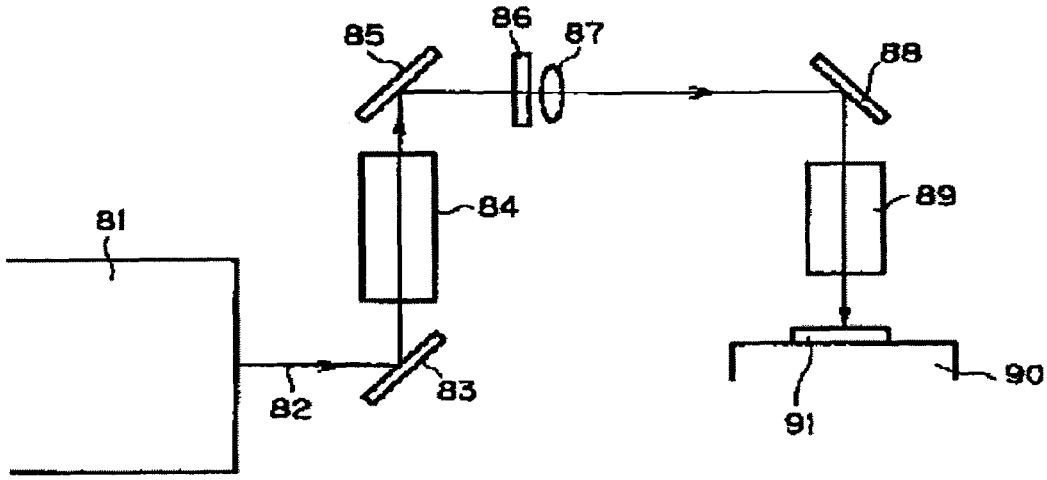
FIG. 23 illustrates a configuration of an excimer laser processing apparatus for use in processing nozzle holes.

FIG. 23 shows a configuration of an excimer laser processing apparatus for use in nozzle hole processing. An excimer laser beam 82 emitted from a laser generator 81 is reflected by mirrors 83, 85, 88 and guided to a processing table 90. A beam expander 84, a mask 86, a field lens 87, and an image-forming optical system 89 are provided in the predetermined positions of an optical path by which the laser beam 82 reaches the processing table 90 in order to obtain a laser beam optimal for a specific processing object. A processing object (nozzle plate) 91 is placed on the processing table 90 and receives the laser beam. The processing table 90 is a well-known XYZ table that is configured, if necessary, so that the processing object 91 can be moved to be irradiated with the laser beam in a desired position. The use of an excimer laser is explained herein, but a variety of lasers can be used, provided that they are short-wavelength UV lasers enabling the ablation processing.

FIG. 24A to FIG. 24F illustrate schematically a process for manufacturing a nozzle plate in the method for manufacturing the ink jet head in accordance with the present invention.

Figure 24A:
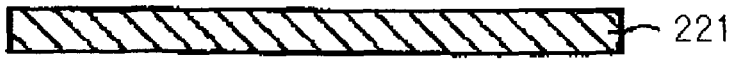
FIG. 24A illustrates a base material of a nozzle forming member in a nozzle plate manufacturing step in the method for manufacturing an ink jet head.

FIG. 24A shows a material serving as a base material for a nozzle forming member. Here, for example, a powder-free film of Kapton (trade name), which is a polyimide film manufactured by Du Pont Corp., is used as the resin film 221. In a typical polyimide film, particles such as $SiO_2$ (silica) are added to the film material to improve handleability (sliding ability) in a roll film handling apparatus. When a nozzle hole processing is carried out with an excimer laser, an abnormal nozzle shape is sometimes obtained because the $SiO_2$ (silica) particles are difficult to process with the excimer laser. Therefore, in the present invention, a film is used to which $SiO_2$ (silica) particles have not been added. Further, Upilex, which is a polyimide film manufactured by Ube Industries, Ltd., may be also used as the plate base material. Upilex can be used as is because it contains extremely fine particles that do not inhibit the processing.

Figure 24B:
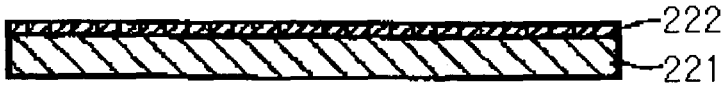
FIG. 24B illustrates a step of forming a $SiO_2$ thin-film layer on the surface of a resin film.

FIG. 24B illustrates a step in the $SiO_2$ thin-film layer 222 is formed on the surface of the resin film 221. A sputtering method performed in a vacuum chamber is suitable for forming the $SiO_2$ thin-film layer 222. The appropriate film thickness is about 1 Å to 300 Å (0.1 nm to 30 nm). Here, a film with a thickness of 10 Å to 100 Å (1 nm to 10 nm) is formed. Using a sputtering method in which Si is sputtered and then a $SiO_2$ film is formed by bombarding the Si surface with $O_2$ ions is effective in terms of improving the adhesive strength of the $SiO_2$ film to the resin film 221, obtaining a homogeneous dense film, and improving wiping endurance of the water repellent film.

Figure 24C:
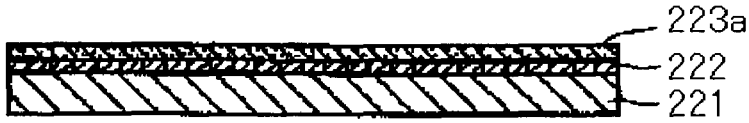
FIG. 24C illustrates a step of applying a fluorine-containing water repellent agent.

FIG. 24C illustrates a step in which a fluorine-containing water repellent agent 223*a* is coated. A method employing a spin coater, a roll coater, screen printing, or a spray coater can be used for coating the fluorine-containing water repellent agent, but a method for forming the film by vapor deposition is more effective because it improves adhesivity of the water-repellent film. An even better effect can be obtained with vacuum deposition by performing vacuum deposition in a vacuum chamber directly after forming the $SiO_2$ thin-film layer 222 as shown in FIG. 24B. In the conventional process, the work is removed from the vacuum chamber once the $SiO_2$ thin-film layer 222 has been formed. As a result, impurities or the like adhere to the work surface, thereby degrading adhesion. A variety of materials are known as fluorine-containing water repellent materials. Here, water repellency necessary with respect to the ink can be obtained by using perfluoropolyoxetane, modified perfluoropolyoxetane, a mixture of the two as a fluorine-containing amorphous compound. The aforementioned name Optool DSX, manufactured by Daikin Industries, Ltd. is called "an alkoxysilane-terminated modified perfluoropolyether."

Figure 24D:
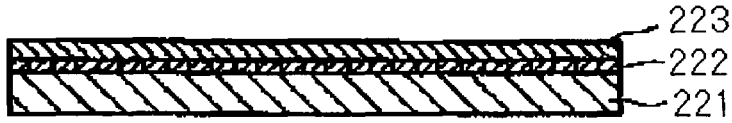
FIG. 24D illustrates a step in which a water-repellent film is allowed to stay in air after vapor deposition.

FIG. 24D illustrates a step of allowing the deposited water repellent film to stay in the air. With this process, the fluorine-containing water-repellent agent 223*a* and the $SiO_2$ thin-film layer 222 are chemically bonded via moisture present in the air and the fluorine-containing water-repellent layer 223 is formed.

Figure 24E:
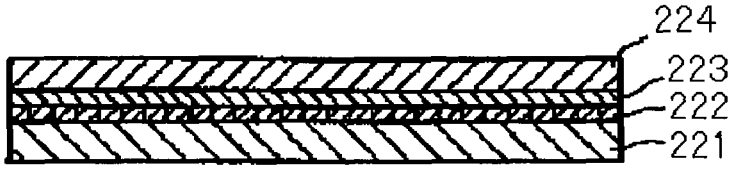
FIG. 24E illustrates a step of applying a pressure-sensitive adhesive tape.

FIG. 24E illustrates a step of pasting the adhesive tape 224. The adhesive tape 224 is pasted on the surface coated with the fluorine-containing water repellent layer 223. The adhesive tape 224 is pasted so that no gas bubbles are generated. Where gas bubbles are generated, quality of the nozzle hole opened in a location where a gas bubble is present is sometimes degraded by the adhesion of foreign matter during processing.

Figure 24F:
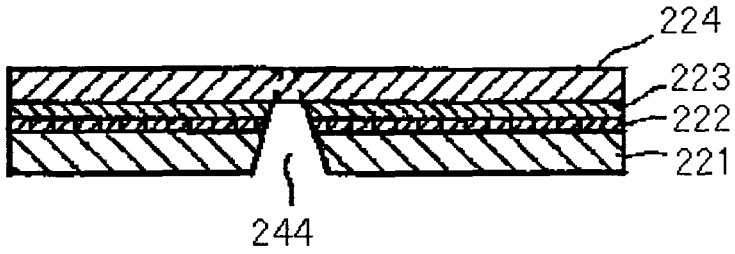
FIG. 24F illustrates a step of processing nozzle holes.

FIG. 24F illustrates a step of processing the nozzle hole 244. In this step the nozzle hole 244 is formed by irradiating with an excimer laser from the side of the polyimide film 221. After the nozzle hole 244 has been formed, the adhesive tape 224 is peeled off. Here, the explanation of the high-rigidity member 225 used to improve the rigidity of the nozzle plate 243 that is explained with reference to FIG. 22 is omitted, but where the high-rigidity member is applied, the respective step is implemented between the step shown in FIG. 24D and the step shown in FIG. 24E.

Figure 25:
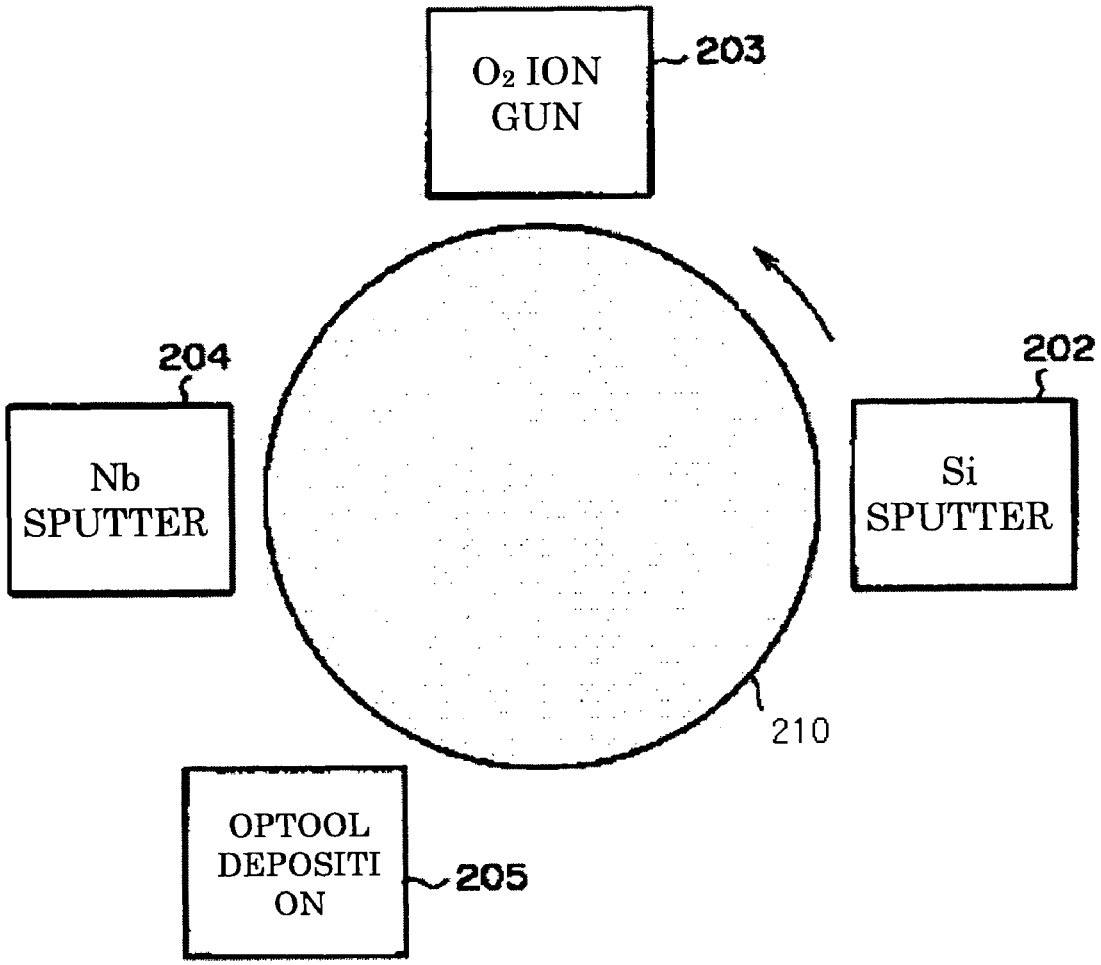
FIG. 25 illustrates schematically a device for use in manufacturing an ink jet head by a method for manufacturing an ink jet head.

FIG. 25 illustrates schematically an apparatus used in manufacturing an ink jet head by the method for manufacturing the ink jet head in accordance with the present invention.

This apparatus implements the so-called "metamode process" developed by OCLI (Optical Coating Laboratory Inc., USA) and used for producing antireflective films and contamination-preventing films for displays or the like. As shown in FIG. 25, a Si sputter 202, an $O_2$ ion gun 203, a Nb sputter 204, and an Optool deposition unit 205 are disposed as stations in four locations around a drum 210, and the entire configuration is disposed in an evacuated chamber. First, Si is sputtered with the Si sputter 202, and then $SiO_2$ is obtained by bombarding the Si with $O_2$ ions with the $O_2$ ion gun 203. Nb and Optool DSX are then appropriately vapor deposited with the Nb sputter 204 and Optool deposition unit 205. In the case of an antireflective film, vapor deposition is performed after Nb and $SiO_2$ are stacked to obtain the necessary number of layers of a predetermined thickness. In the case of the present invention, the function of antireflective film is not required. Therefore, Nb is not necessary, and $SiO_2$ and Optool DSX may be deposited by one layer each. With this apparatus, as described hereinabove, vapor deposition of Optool DSX can be implemented inside the vacuum chamber directly after the $SiO_2$ thin film 122 has been deposited.

The critical surface tension of the ink repellent layer is preferably 5 mN/m to 40 mN/m, more preferably 5 mN/m to 30 mN/m. Where the critical surface tension exceeds 30 mN/m, a phenomenon by which the nozzle plate is overwetted with the ink in long-term use is observed. As a result, curving of ink ejection trajectory or abnormal atomization sometimes occur in repeated printing. On the other hand, where the critical surface tension exceeds 40 mN/m, the overwetting of the nozzle plate occurs from the very beginning, whereby curving of ink ejection trajectory or abnormal atomization are sometimes caused from the very beginning.

In actual implementation, the ink repellent material shown in Table B was coated on an aluminum board and dried by heating to produce a nozzle plate provided with an ink repellent layer. Results obtained in measuring the critical surface tension of the ink repellent layer are shown in Table B.

Here, the critical surface tension can be found by a Zisman method. Thus, a liquid with known surface tension is dropped on the ink repellent layer, a contact angle θ is measured, and a line descending to the right (Zisman Plot) is obtained by plotting the surface tension of the liquid against the x axis and cos θ against the y axis. The surface tension at a point where the line is Y=1 (θ=0) can be calculated as the critical surface tension γc. Examples of other methods suitable for finding the critical surface tension include a Fowkes method, an Owens and Wendt method, and a Van Oss method.

Similarly to the above-described method for producing a printing head, an ink jet head was produced by using the nozzle plate provided with an ink repellent layer. Ink was sprayed thereonto by using the below-described cyan ink. The ink flying process was observed with a video camera. For all the nozzle plates used, accurate atomization and good ejection stability were confirmed. The results are shown in Table B.

<Cyan Ink>

An appropriate quantity of ion-exchange water was added to 20.0% by mass of polymer ultrafine particle dispersion containing a copper phthalocyanine pigment, 23.0% by mass of 3-methyl-1,3-butanediol, 8.0% by mass of glycerin, 2.0% by mass of 2-ethyl-1,3-hexanediol, 2.5% by mass of FS-300 (Du Pont Corp.) as a fluorine-containing surfactant, 0.2% by mass of Proxel LV (manufactured by Avecia Co., Ltd.) as a antiseptic/antifungal agent, 0.5% by mass of 2-amino-2-ethyl-1,3-propanediol, and ion-exchange water to obtain 100% by mass, and then filtration was performed with a membrane filter with a pore diameter of 0.8 μm. A cyan ink was thus prepared.

TABLE B

| | Name | Critical surface tension | Ejection stability |
|---|---|---|---|
| Toray - Dow Corning Co., Ltd. | SR2411 | 21.6 mN/m | Good |
| Shin-Etsu Chemical Co., Ltd. | KBM7803 | 16.9 mN/m | Good |
| Shin-Etsu Chemical Co., Ltd. | KP801M | 6.6 mN/m | Good |

<Image Formation Method>

No specific restriction is placed on the image processing method used in accordance with the present invention, except for the limitation of the total quantity, but it is preferred that an original image having high resolution be transferred and also recorded without loosing the resolution of the original image. In accordance with the present invention, a high transfer speed and resolution can be maintained by using a method by which image data are compressed with a control unit such as a computer and transferred at a high speed to a printer where a simple image restoration process is performed.

This procedure will be explained below in greater detail.

Where the resolution of the image that is wished to be recorded is high and the number of image gradations is high, the capacity of the inputted image is increased and image processing takes time in both the host that starts image transfer to the recording apparatus and the recording apparatus itself. Accordingly, in the present invention, for example, 2×2 pixels (4 pixels) of inputted image are considered as one pixel. As a result, the information volume of the inputted image is reduced by a factor of four, and the time required for recording is obviously shortened. Considering 2×2 pixels of the inputted image as a single pixel results in reduced resolution, and measures taken to prevent this reduction will be described below.

Figure 26:
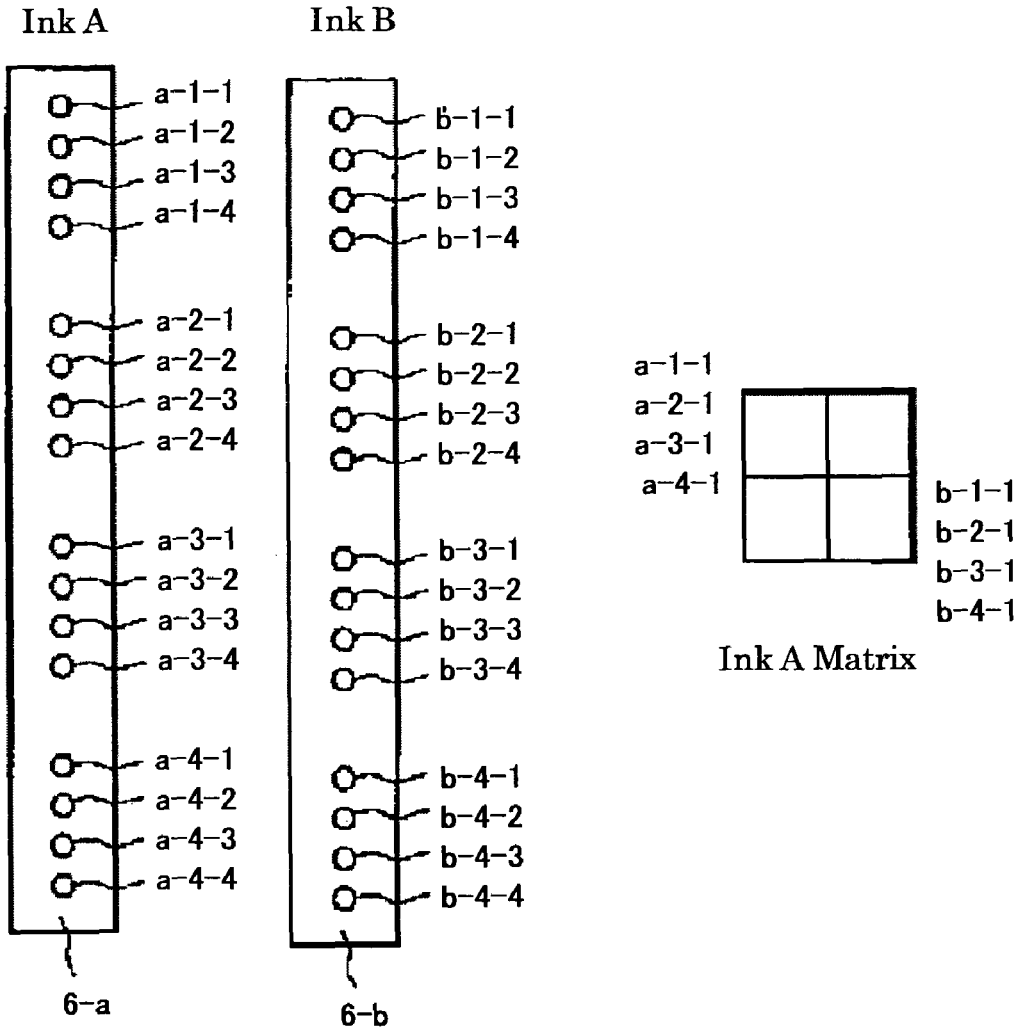
FIG. 26 illustrates a recording element row.

On the other hand, in the case of using a recording element row in which a plurality of recording elements are integrally arranged, for example, by performing recording based on a four multipass procedure using an ink jet recording element row in which 16 recording elements are disposed in the main scanning direction, as shown in FIG. 26, it is possible to select a recording element where the same pixels of the recording medium can be recorded from a total of four recording elements a-1-1, a-2-1, a-3-1, a-4-1, as can be explained with reference to one row (6-*a*) in the recording element rows shown in FIG. 26.

As described above, with the recording method by which a plurality of ink dots are formed in the same pixel, where the recording element row shown in FIG. 26 is taken as an example, ${}_4C_2=6$ combinations can be taken in the case where two ink dots are recorded in the same pixel.

Further, when a plurality of dark and light inks are used or when a recording element row ejects a plurality of inks of the same color density, the number of the aforementioned combinations increases where inks with different ink droplet volume, that is, large dots and small dots, are ejected from the recording elements. For example, the following results are obtained when using a combination of dark and light inks such that the optical density of a dark ink on a recording medium is substantially twice as high as that of the light ink, or a combination in which the volume of large dots is about twice as large as that of small dots.

Figure 27:
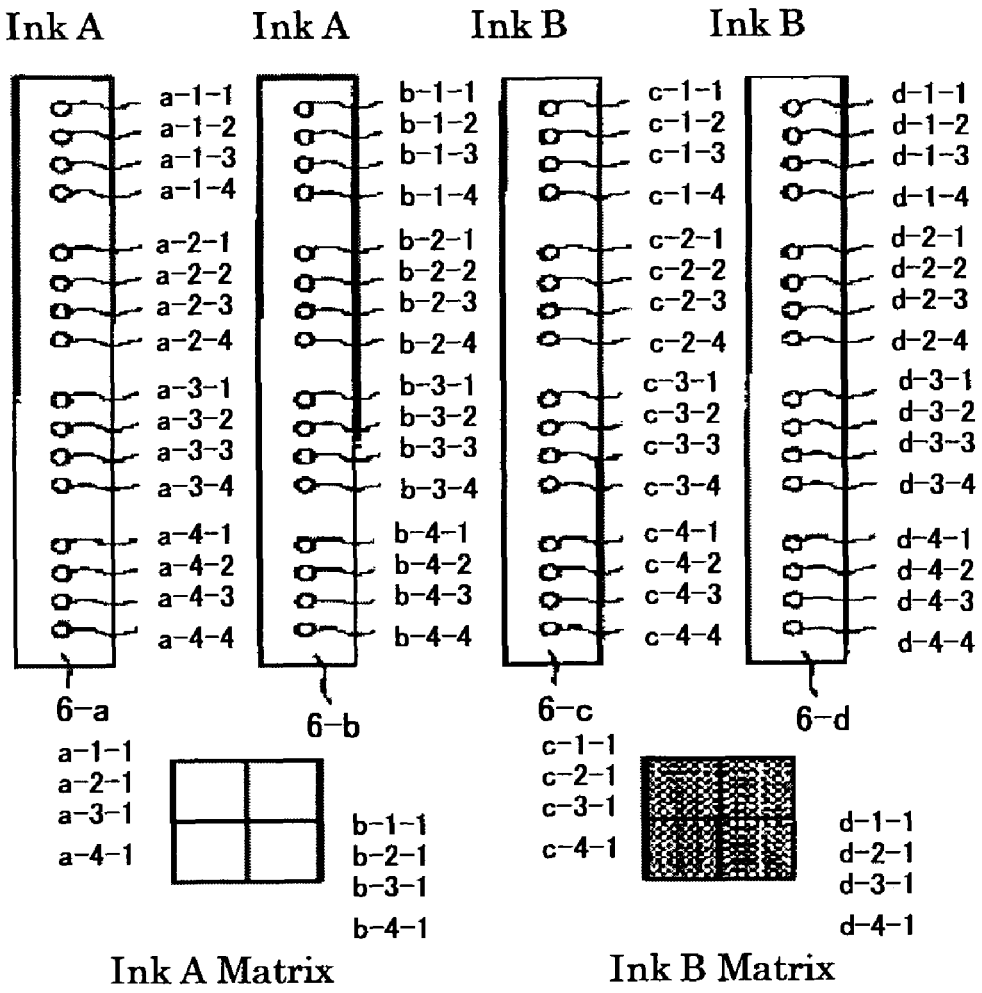
FIG. 27 illustrates a recording element row.

FIG. 27 shows ink jet recording element rows including recording element rows (6-*a*, 6-*b*) where large and small dots of a light ink (A ink) can be recorded and recording element rows (6-*c*, 6-*d*) where large and small dots of a dark ink (B ink) can be recorded. Here, when the limitation for a maximum number of ink droplets that are placed on substantially the same pixel is set to a maximum of two large droplets and two small droplets, a large variety of combinations of different types is obtained for the gradation values that can be realized.

Considering the combinations of recording elements that can be used for recording on the pixel, for example, where four recording element rows are assumed to pass above the recording pixel when a certain gradation value is reproduced, there are a large number of combinations that represent which ink dot is recorded and in which pass. Accordingly, in the present invention, a procedure is used by which combinations indicating which nozzle to drive are stored in a table (recording element combination table: second table) and the combinations are selected according to the input image.

Here, a sequence of recording element combinations that, will be actually used is selected from the aforementioned large number of recording element combination tables by managing in a unified manner the number of dots for recording dark and light inks and the recording elements to be used for recording.

In the recording element combination tables, the number of combinations that can be selected grows with the increase in the number of types of ink density, the number of types of ink droplet size, the number of recording elements, and the number of passes in the multipass system. Therefore, it is actually preferred that a certain limited number of combinations be stored. In such case a contribution is made to the increase in image recording speed. The number of combinations can be also limited so that the total quantity of ink satisfy the limitation of the present patent.

Figure 29:
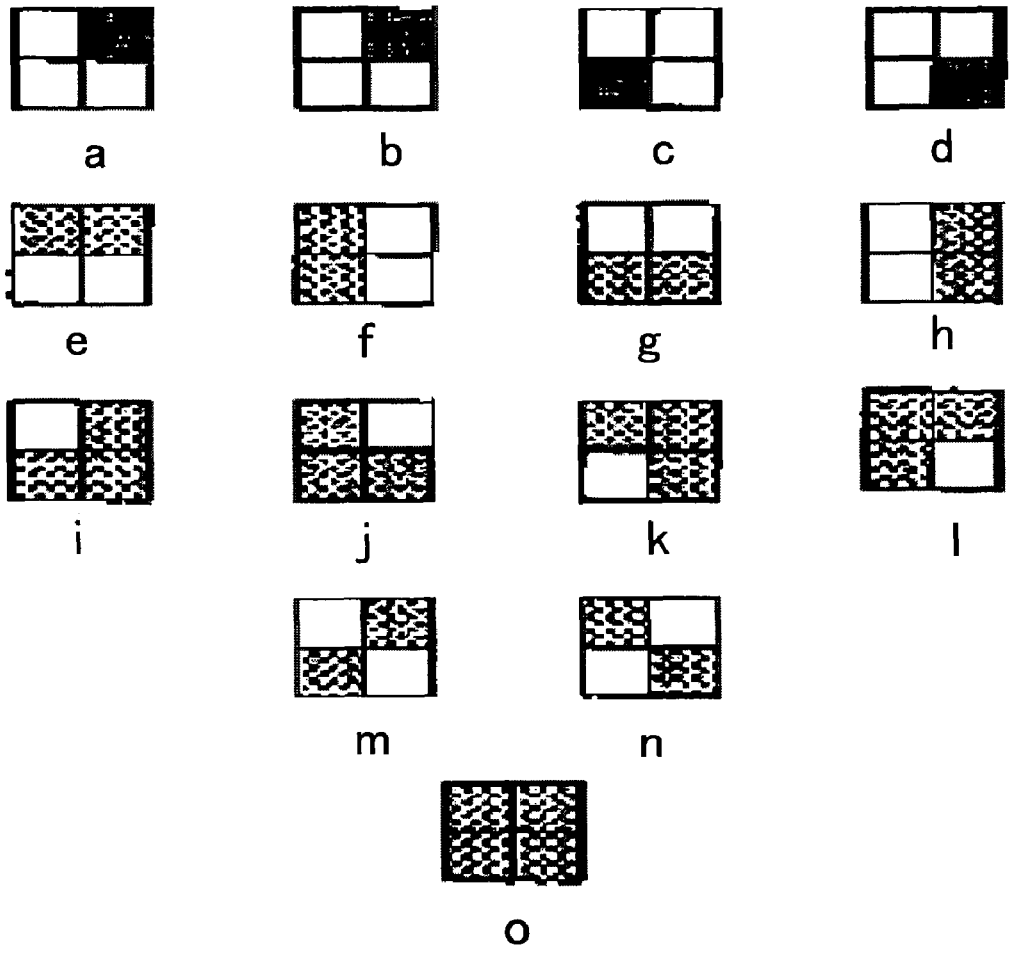
FIG. 29 is an example of a combination pattern of recording elements.

FIG. 29 illustrates an example of combination patterns of recording elements that are thus stored. According to the classification (a) to (o) shown in FIG. 29, even when identical gradation values are recorded in 2×2 pixels, the gradation value increases or decreased when considered for each unit pixel. This is called a density distribution in recording pixels (density distribution pattern of recording pixels).

The density distribution in the recording pixel is combined with the above-described recording ink combination table (first table), and stored in the recording ink combination table, for example, according to the classification (a) to (o) shown in FIG. 29. FIG. 30 is an example of the recording ink combination table (first table) that is thus produced. Here, five patterns (patterns 1 to 5) are shown for the sake of simplicity. The numerical values shown in FIG. 30 are the numbers of ink droplets recorded to a unit pixel that constitute each pattern in the case where a maximum of 16 ink droplets are recorded in 2×2 pixels.

In the case of selecting which recording ink combination table to use based on the pixel value of the inputted image, it is sometimes impossible to match the gradation value of unit pixels of the inputted image with the gradation value of unit pixels of the recorded image with the combination table. However, even if there are different gradations, the information volume of the inputted image can be reduced and image data can be expanded. Moreover, image recording is performed without sacrificing the resolution.

No specific limitation is placed on a method for selecting a pattern of the recording ink combination table from the gradation values of pixels of the inputted image. As example of suitable method is presented below.

Thus, a method can be used by which where a unit pixel of interest (for example, an upper left pixel of 2×2 pixels) is separated by more than a predetermined value from a sum total and an average value of gradation values of the 2×2 pixels of the inputted image, a pattern corresponding to the specific features of 2×2 pixels (4 pixels) is selected. However, where the pixel of interest is not separated by more than a predetermined value from the average value, other three pixels are also assumed not to be separated.

The gradation value and recording element combination that will be used are determined for each pixel based on the inputted image from a sequence of recording element combination patterns that were thus selected. Where there are a large number of combination patterns of gradation values of almost identical density and recording element combinations, more specifically, when combinations for three types, e.g. A, B, C, have almost identical gradation values, recording element combinations of three kinds are used as ABCABCABC . . . sequentially for each pixel when the gradation value is represented.

Alternatively, it is preferred that recording element combinations of three kinds are randomly used as ACBCBABBCAA . . . . No specific limitation is placed on the randomization method.

The configuration and operation of the ink jet recording apparatus of the present embodiment will be described below.

Here, the case will be explained in which a medical X ray transmission image of a high resolution of 600 dpi and 256 black-white gradation is obtained by using a black ink, allowing the placement of a maximum of four ink droplets on a single pixel, configuring one recording pixel of 2×2 unit pixels (4 pixels), and enabling the placement of a maximum of eight ink droplets in a recording pixel.

Figure 31:
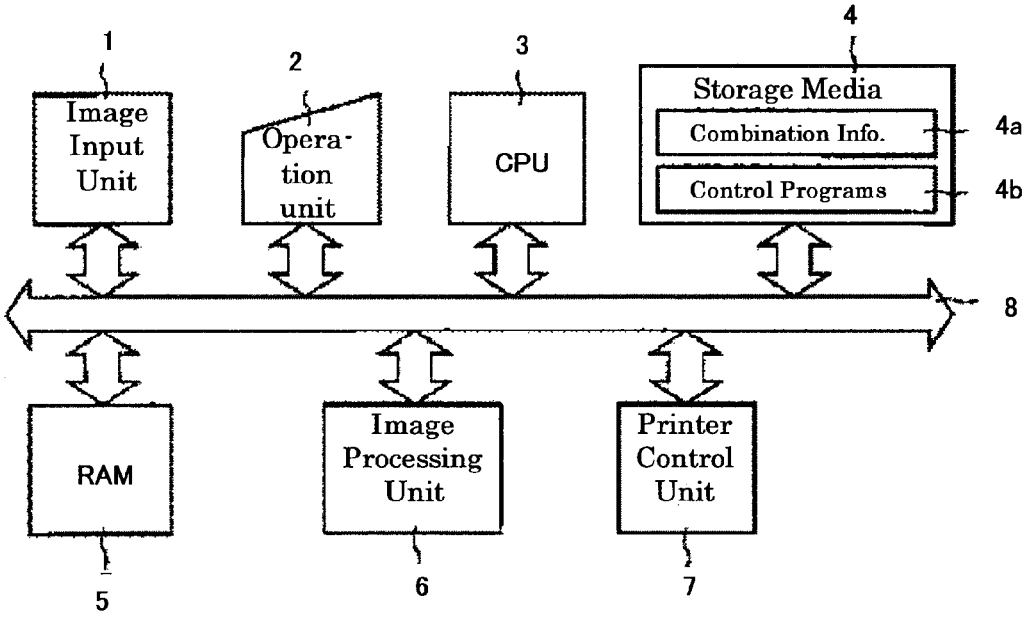
FIG. 31 is a block diagram illustrating an example of a configuration of the ink jet recording apparatus in accordance with the present invention.

FIG. 31 is a block-diagram illustrating the configuration of the ink jet recording apparatus of the present embodiment.

In the figure, the reference symbol 1 stands for an image input unit, 2—operation unit, 3—a central processing unit CPU for performing a variety of processing operations, 4—a storage medium that stores a variety of data. The storage medium 4 stores recording element combination information 4*a* in the table format and a group 4*b* of various control programs. The reference numeral 5 stands for a RAM, 6—an image processing unit, 7—a printer control unit that performs image output control, and 8—a bus unit (bus line) that connects various structural elements to each other for data transmission.

The image input unit 1 is composed, for example, of a scanner or a digital camera. The operation unit 2 comprises various keys for indicating settings of various parameters and recording start. The CPU 3 controls the entire ink jet recording apparatus according to programs located in the recording medium 4.

The recording medium 4 stores programs for operating the ink jet recording apparatus according to a control program or an error processing program. The entire operation of the ink jet recording apparatus is performed according to this program. For example, a ROM, a FD, a CD-ROM, a HD, a memory card, or a magneto-optical disk can be used as the recording medium 4 that stores the programs.

The RAM 5 is used as a work area for various programs located in the storage medium 4, a temporary stand-by area during error processing, and a work area during image processing. Further, the RAM 5 can copy various tables located in the recording medium 4 and then change the contents of the tables, and advance the predetermined image processing, while referring to the changed tables.

The image processing unit 6 produces an ejection pattern for realizing multiple gradation in the ink jet system based on the input image. The printer unit 7 forms a dot image based on the ejection pattern created in the image processing unit 6 during image recording. The bus line 8 transfers the address signal, data, and control signal in the ink jet recording apparatus.

The above-described recording element combination information 4*a* further accumulates data relating to the ink that will be used. Here, the ink that will be used is of one kind, but, as will be described below, light ink and dark ink may be employed with the object of printing ink dots of different density in the same color system, and such approach is suitable for reproducing multiple gradation values.

When one unit pixel is formed of a maximum of four ink dots by using these inks, for example, the number of recording ink combination table in which the unit pixel can be represented by recording elements comprising four unit elements that are a 2×2 arrangement of unit pixels becomes very large. Accordingly, in the present embodiment, a total of 144+1 recording ink combination tables with 8+1 values for recording pixel units are used for every 5 kinds of patterns, that is, patterns of 4 kinds in which the density of the upper left quadrant of the 2×2 matrix is biased high and that of the upper right quadrant is biased and also a pattern with a small bias, for each gradation value therefrom.

Figure 32:
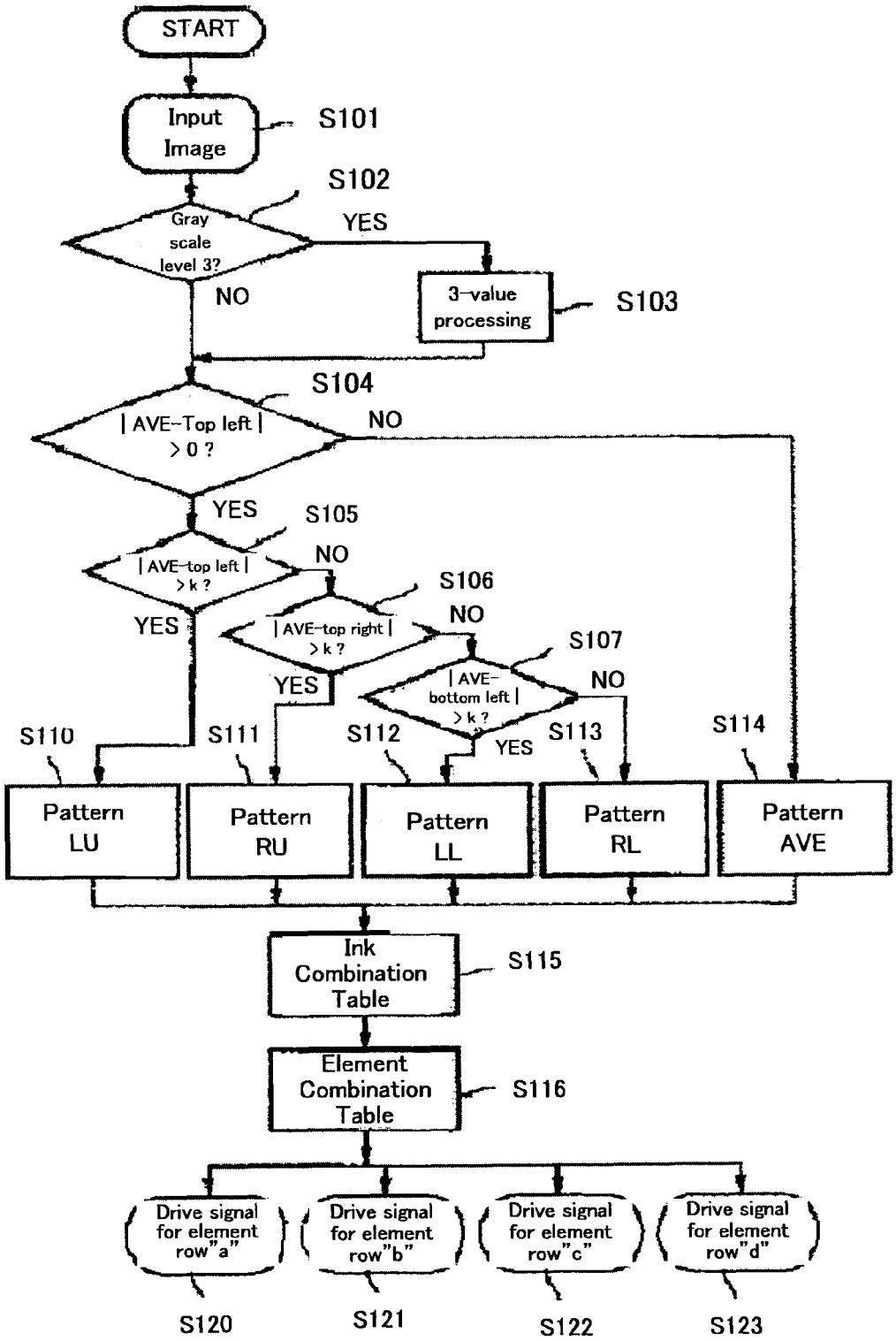
FIG. 32 is a flowchart illustrating a flow of image processing in the ink jet recording apparatus in accordance with the present invention.

FIG. 32 to FIG. 34 show recording ink combination tables (second tables) of the present embodiment.

Among the descriptive indexes in the figure, "1" means ejection of an ink droplet. For the sake of convenience, left-upper, right-upper, left-lower, and right-lower pixels are represented by LU, RU, LL, RL, correspondingly, as information relating to a position in the 2×2 matrix, and a group of ink combination tables in which the density of the unit pixel is biased high with respect to that of other unit pixels is described as a density pattern.

The density level is not entirely proportional to the number of inks ejected per one pixel or the total content of colorant in the ink, but generally such proportional relationship can be assumed without practical problems for a recording medium that is reflective in low-density portions or a transmitting recording medium.

FIG. 32 is a flow chart illustrating the flow of image processing in the ink jet recording apparatus of the present embodiment.

Image processing specific to the present embodiment will be explained below with reference to these FIG. 32 to FIG. 35.

When the recording element combination tables shown in FIG. 33 to FIG. 35 are used, the gradation number of an inputted image with a gradation of 256 that is inputted in step S101 of FIG. 33 has to be converted to a 2+1 value (/600 dpi). Accordingly, in the image processing unit 6 shown in FIG. 31, a 2+1-value multivalue error diffusion processing is performed (step S102, step S103). Here, the multivalue error diffusion processing is used, but this method is not limiting and, for example, an average density saving method, a dither matrix method, and a random intermediate gradation processing method can be used.

A major difference between the multivalue error diffusion method and a usual error diffusion method, is that there are multiple (here, 2) threshold values for binarization. These threshold values usually may be determined as central points of gradation values.

In the image processing unit 6, the data subjected to multivalue processing are distributed to Eject/Not Eject driving signals with respect to each recording element, while referring to recording element combination information 4*a* in the recording medium 4, more specifically, according to the recording ink combinations of FIG. 33 to FIG. 35. Here, because the original image data are 600 dpi, the data subjected to multivalue processing have 2+1 values, that is, three values "0", "1", "2" at 600 dpi (step S103 of FIG. 35).

Accordingly, in step S104, it is determined whether the average value of the recording pixel of interest is different from that of the upper left dot. For example, a case will be explained in which in 2×2 recording pixels of interest (represented by (I1, J1)), the gradation value of the upper left unit pixel (i1, j1) is 2, the gradation value of the upper right unit pixel (i1+1, j1) is 1, the gradation value of the lower left unit pixel (i1, j1+1) is 1, and the gradation value of the lower right unit pixel (i1+1, j1+1) is 0. In this case, the density gradient information indicates that the density of the upper left unit pixel is high. Therefore, a density pattern of "LU" that is equivalent to gradation "a" shown in FIG. 29 is selected (step S105, step S110).

Further, because the gradation value of the 2×2 recording pixels themselves is 4/8, data distribution is determined based on pattern information with "LU" density gradation information (that is, combinations No. 45 to 48) within the recording element combination information with density 4 (gradation value 4) shown in FIG. 34. Actually, selection is performed sequentially or randomly from these four combinations (step S115, step S116).

With the above-described processing, the processing of one pixel of the recording pixels of interest is completed. Similar processing is then performed with respect to subsequent 2×2 recording pixels (I2, J2).

Thus, when the gradation value of the upper left unit pixel (i2, j2) of the recording pixels is 2, the gradation value of the upper right unit pixel (i2+1, j2) is 2, the gradation value of the lower left unit pixel (i2, j2+1) is 2, and the gradation value of the lower right unit pixel (i2+1, j2+1) is 1, the density gradient information thereof corresponds to "1" of the gradation shown in FIG. 29. This pattern can hardly be determined to belong to any of the aforementioned LU, RU, LL, RL. Therefore, here, for the sake of simplicity, "AVE" is selected (step S114).

Further because the gradation value of the recording pixel is 8/8, data distribution can be determined (steps S115, S116) based on the pattern information for which the density gradient information is "AVE" (that is, based on the combination of No. 141 to 144) from the recording element combination information with density 8 (gradation value 8) shown in FIG. 35.

With respect to other recording pixels, binary drive signals of Eject/Not Eject for each pixel in each recording element row are similarly formed (step S120 to step S123) by repeating the aforementioned processing the number of times equal to the total number of pixels based on the density data of the image.

Figure 36:
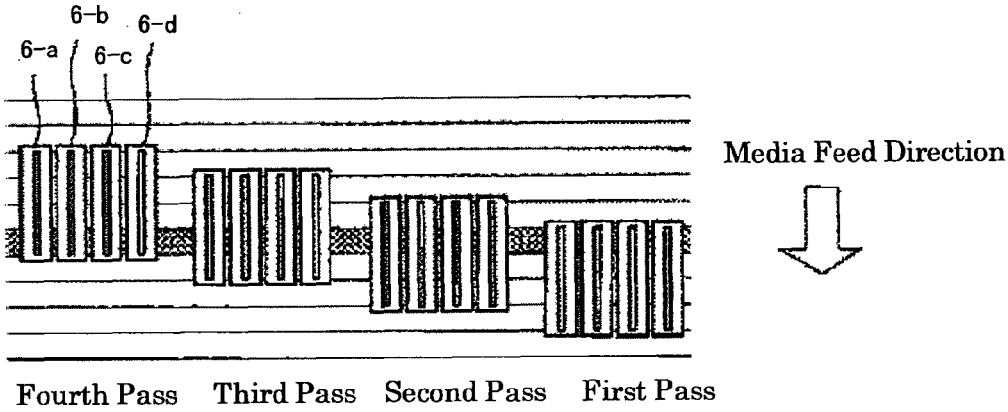
FIG. 36 illustrates a multi (4) pass recording system.

FIG. 36 illustrates a multi (4) pass recording system in which the recording of each pass is performed with a recording head 6-*a* having a recording element row ejecting the A ink, a recording head 6-*b* having a recording element row ejecting the A ink, a recording head 6-*c* having a recording element row ejecting the B ink, and a recording head 6-*d* having a recording element row ejecting the B ink.

Figure 28:
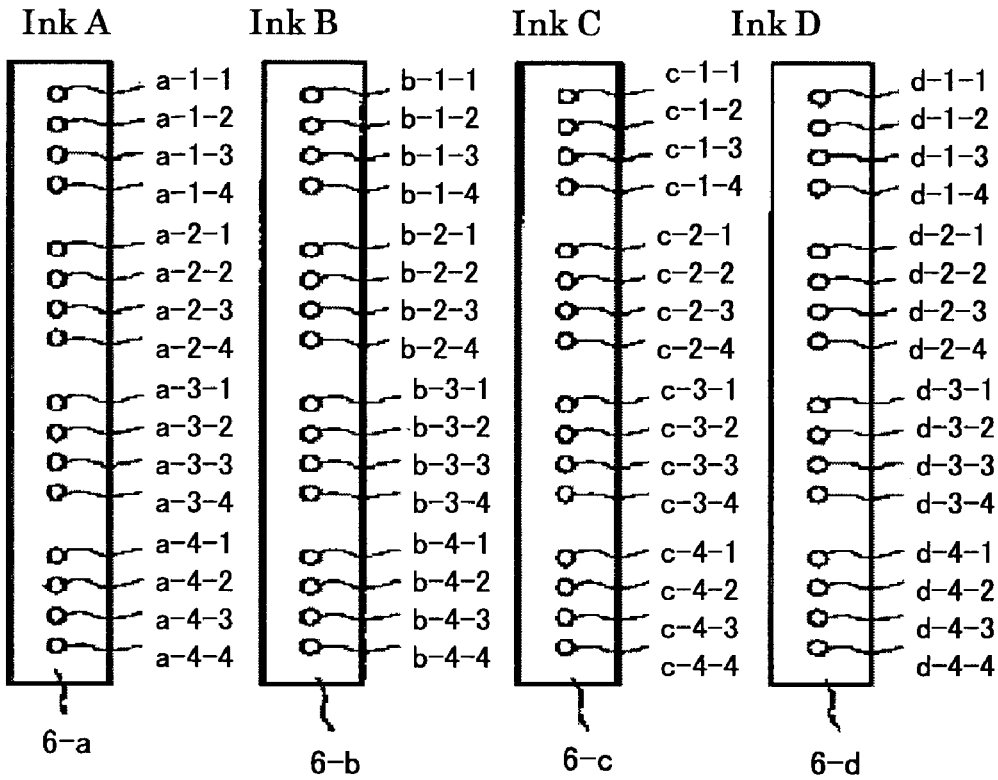
FIG. 28 illustrates a recording element row.

In the present embodiment, as described hereinabove, all the pixels are processed successively, and four-pass recording is performed with the ink jet recording apparatus having the recording element rows shown in FIG. 26, FIG. 27, and FIG. 28.

As described above, with the present embodiment, a region where the adjacent unit pixels of the inputted image are combined together is taken as a recording pixel, and a gradation value pattern corresponding to the input image and determined in advance is selected for each recording pixel, whereby the information volume of the image data can be reduced to about one fourth, image recording speed can be increased, and load on the control unit (CPU) can be reduced, without decreasing the resolution of the inputted image.

Further, with the image recording method by which recording is performed by ejecting a single ink droplet or a plurality of ink droplets, as necessary, on several unit pixels constituting the recording pixel, which is a structural unit of the recording image, such a method including recording with at least two ink droplets for identical unit pixels, recording with ink droplets of at least two different dot diameters, or recording with ink droplets of at least two darkness levels of the same color, effective recording can be performed because patterned control data of Eject and Not Eject drive signals are handled without performing complex image processing.

Further, by preparing a plurality of types of recording element combination information for the same gradation value and performing successive or random recording corresponding to different types of recording element combination information, it is possible to reduce the occurrence of cases in which the inks are not ejected for a long time from the same recording element and, at the same time, eliminate the occurrence of cases in which ink dots are formed from the same recording element in excess of a certain constant surface area, and also to inhibit variation of properties and effectively and actively adapt to a spread in properties of recording elements when the recording head is replaced.

In addition, by performing faster and easier processing with a simple signal processing algorithm, it is possible to obtain an image with a low level of deterioration caused by "kink" and to obtain image with good gradation even in recording using low-resolution data as information.

<Ink Prints>

Ink prints for use in accordance with the present invention have images formed by the ink in accordance with the present invention on a recording medium.

The ink prints have high quality, no oozing, and excellent stability over time and can be advantageously used for a variety of applications as materials having recorded thereon symbols and images of various kinds.

EXAMPLES

Examples of the present invention will be explained below, but the present invention is not limited in scope to these Examples.

Production Example 1

Preparation of Fine Polymer Particle Dispersion Containing Copper Phthalocyanine Pigment A 1 L flask equipped with a mechanical stirrer, a thermometer, a nitrogen gas introducing pipe, a reflux pipe, and a dropping funnel was sufficiently purged with nitrogen, then 11.2 g of styrene, 2.8 g of acrylic acid, 12.0 g of lauryl methacrylate, 4.0 g of polyethylene glycol methacrylate, 4.0 g of styrene macromer (trade name AS-6; produced by Toa Gosei Co., Ltd.), and 0.4 g of mercaptoethanol were charged into the flask and the temperature was raised to 65° C.

Then, a mixed solution containing 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (trade name AS-6; produced by Toa Gosei Co., Ltd.), 3.6 g of mercaptoethanol, 2.4 g of azobisdimethyl valeronitrile, and 18 g of methyl ethyl ketone were dropwise added to the flask within 2.5 h.

Upon completion of the dropwise addition, a mixed solution of 0.8 g of azobisdimethyl valeronitrile and 18 g of methyl ethyl ketone was dropwise added to the flask within 0.5 h. Upon maturing for 1 h at 65° C., 0.8 g of azobisdimethyl valeronitrile was added and maturing was continued for 1 h. Upon completion of reaction, 364 g of methyl ethyl ketone was added to the flask to obtain 800 g of polymer solution with a concentration of 50% by mass.

Part of the polymer solution obtained was dried and analyzed by gel permeation chromatography (standard: polystyrene, solvent: tetrahydrofuran). The weight-average molecular weight was 15,000.

Then, 28 g of the polymer solution obtained, 26 g of copper phthalocyanine pigment, 13.6 g of 1 mol/L aqueous solution of potassium hydroxide, 20 g of methyl ethyl ketone, and 30 g of ion-exchange water were stirred thoroughly. A total of 20 cycles of kneading were then performed using a three-roll mill (trade name: NR-84A, manufactured by Noritake Co.). The paste obtained was charged into 200 g of ion-exchange water and stirred thoroughly. Then, methyl ethyl ketone and water were distilled off with an evaporator to obtain 160 g of blue fine polymer particle dispersion with a content of solids of 20.0% by mass.

The average particle size (D50%) of the obtained fine polymer particles was measured with a particle size distribution meter (Microtrack UPA, manufactured by Nikkiso Corp.). The result was 93 nm.

Production Example 2

Preparation of Fine Polymer Particle Dispersion Containing Dimethylquinacridone Pigment A fine polymer particle dispersion of red-violet color was prepared in the same manner as in Production Example 1, except that copper phthalocyanine of Production Example 1 was changed to C. I. Pigment Red 122.

The average particle size (D50%) of the obtained fine polymer particles was measured with a particle size distribution meter (Microtrack UPA, manufactured by Nikkiso Corp.). The result was 127 nm.

Production Example 3

Preparation of Fine Polymer Particle Dispersion Containing Monoazo Yellow Pigment A fine polymer particle dispersion of yellow color was prepared in the same manner as in Production Example 1, except that copper phthalocyanine of Production Example 1 was changed to C. I. Pigment Yellow 74.

The average particle size (D50%) of the obtained fine polymer particles was measured with a particle size distribution meter (Microtrack UPA, manufactured by Nikkiso Corp.). The result was 76 nm.

Production Example 4

Preparation of Carbon Black Dispersion

A total of 300 g of commercial acidic carbon black with pH 2.5 (trade name: Monarch 1300, manufactured by Cabot Corp.) was mixed thoroughly with 1000 mL of water. Then, 450 g of sodium hypochlorite (effective chlorine concentration: 12%) was dropwise added and stirring was performed for 8 h at 100° C. to 105° C. Then 100 g of sodium hypochlorite (effective chlorine concentration 12%) was further added to the liquid and dispersing was performed for 3 h with a vertical dispersing machine. The slurry obtained was diluted by a factor of 10 with water and pH was adjusted by the addition of lithium hydroxide. Desalting and concentrating were performed by ultrafiltration to an electric conductivity of 0.2 mS/cm and a carbon black dispersion with a pigment concentration of 15% by mass was obtained. Coarse particles were removed by centrifugal separation and filtration was performed with a 1 μm Nylon filter to obtain a carbon black dispersion.

The average particle size (D50%) of the obtained fine polymer particles was measured with a particle size distribution meter (Microtrack UPA, manufactured by Nikkiso Corp.). The result was 95 nm.

Production Example 5

Preparation of Fine Polymer Particle Dispersion of Carbon Black

A black fine polymer particle dispersion was prepared in the same manner as in Production Example 1, except that copper phthalocyanine of Production Example 1 was changed to carbon black (FW100 manufactured by Degussa Co.).

The average particle size (D50%) of the obtained fine polymer particles was measured with a particle size distribution meter (Microtrack UPA, manufactured by Nikkiso Corp.). The result was 104 nm.

Production Example 6

Preparation of Carbon Black Dispersion Treated with Diazo Compound

A total of 100 g of carbon black with a surface area of 230 $m^2/g$ and a DBP oil absorption quantity of 70 mL/100 g and 34 g of p-amino-N-benzoic acid were mixed and dispersed in 750 g of water, followed by dropwise addition of 16 g of nitric acid and stirring at 70° C. After 5 min, a solution prepared by dissolving 11 g of sodium nitrite in 50 g of water was added and stirring was further conducted for 1 h. The slurry obtained was diluted by a factor of 10, coarse particles were removed by centrifugal separation, pH was adjusted with diethanolamine to pH 8 to pH 9, and desalting and concentrating were carried out with an ultrafiltration membrane to obtain a carbon black dispersion with a pigment concentration of 15% by mass. Then, filtration was performed with a 0.5 μm polypropylene filter to obtain a carbon black dispersion. The average particle size (D50%) of the obtained carbon black dispersion was measured with a particle size distribution meter (Microtrack UPA, manufactured by Nikkiso Corp.). The result was 99 nm.

Production Example 7

Preparation of Carbon Black Dispersion Treated with Sulfonating Agent

A total of 150 g of a commercial carbon black pigment (Printex #85, manufactured by Degussa Co.) was thoroughly mixed with 400 mL of sulfolan and finely dispersed in a bead mill. Then, 15 g of amidosulfuric acid was added and stirring was performed for 10 h at a temperature of 140° C. to 150° C. The slurry obtained was charged into 1000 mL of ion-exchange water and treated with a centrifugal separator at 12,000 rpm to obtain a wet cake of surface-treated carbon black. The wet cake of carbon black was re-dispersed in 2,000 mL of ion-exchange water, pH was adjusted with lithium hydroxide, desalting and concentrating were performed with an ultrafiltration membrane, and a carbon black dispersion with a pigment concentration of 10% by mass was obtained. It was then filtered with a 1 μm Nylon filter to obtain a carbon black dispersion. The average particle size of the obtained carbon black dispersion was measured with a particle size distribution meter (Microtrack UPA, manufactured by Nikkiso Corp.). The result was 80 nm.

The following inks were prepared using the fine polymer particle dispersions and carbon black dispersions obtained in Production Examples 1 to 7.

Production Example 8

Preparation of Cyan Ink 1

An appropriate quantity of ion-exchange water was added to 20.0% by mass of fine polymer particle dispersion containing copper phthalocyanine that was prepared in Production Example 1, 23.0% by mass of 3-methyl-1,3-butanediol, 8.0% by mass of glycerin, 2.0% by mass of 2-ethyl-1,3-hexanediol, 2.5% by mass of FS-300 (manufactured by Du Pont Corp.), 0.2% by mass of Proxel LV (Avecia KK), and 0.5% by mass of 2-amino-2-ethyl-1,3-propanediol to obtain 100% by mass. Then, filtration was performed with a membrane filter with an average pore size of 0.8 μm. The content of solids was then adjusted to 12% by mass by using ion-exchange water. Cyan ink 1 was thus prepared.

The viscosity at 25° C. of the cyan ink 1 obtained was 9 mPa·s and the surface tension was 25 mN/m. The viscosity was measured with a viscometer (R500 Rotary Viscometer, manufactured by Toki Sangyo Co., ltd) at 25° C.

Production Example 9

Preparation of Magenta Ink 1

An appropriate quantity of ion-exchange water was added to 20.0% by mass of fine polymer particle dispersion containing dimethylquinacridone that was prepared in Production Example 2, 22.5% by mass of 3-methyl-1,3-butanediol, 9.0% by mass of glycerin, 2.0% by mass of 2-ethyl-1,3-hexanediol, 2.5% by mass of FS-300 (manufactured by Du Pont Corp.), 0.2% by mass of Proxel LV (Avecia KK), and 0.5% by mass of 2-amino-2-ethyl-1,3-propanediol to obtain 100% by mass. Then, filtration was performed with a membrane filter with an average pore size of 0.8 μm. The content of solids was then adjusted to 12% by mass by using ion-exchange water. Magenta ink 1 was thus prepared.

The viscosity at 25° C. of the magenta ink 1 obtained was 9 mPa·s and the surface tension was 25 mN/m.

Production Example 10

Preparation of Yellow Ink 1

An appropriate quantity of ion-exchange water was added to 20.0% by mass of fine polymer particle dispersion containing mono azo yellow that was prepared in Production Example 3, 24.5% by mass of 3-methyl-1,3-butanediol, 8.0% by mass of glycerin, 2.0% by mass of 2-ethyl-1,3-hexanediol, 2.5% by mass of FS-300 (manufactured by Du Pont Corp.), 0.2% by mass of Proxel LV (Avecia KK), and 0.5% by mass of 2-amino-2-ethyl-1,3-propanediol to obtain 100% by mass. Then, filtration was performed with a membrane filter with an average pore size of 0.8 μm. The content of solids was then adjusted to 12% by mass by using ion-exchange water. Yellow ink 1 was thus prepared.

The viscosity at 25° C. of the yellow ink 1 obtained was 9 mPa·s and the surface tension was 25 mN/m.

Production Example 11

Preparation of Black Ink 1

An appropriate quantity of ion-exchange water was added to 20.0% by mass of carbon black dispersion that was prepared in Production Example 7, 22.5% by mass of 3-methyl-1,3-butanediol, 7.5% by mass of glycerin, 2.0% by mass of 2-pyrrolidone, 2.0% by mass of 2-ethyl-1,3-hexanediol, 2.0% by mass of $R—(OCH_2CH_2)_nOH$ (in this formula, R is an alkyl group having 12 carbon atoms, n=9), 0.2% by mass of Proxel LV (Avecia KK), and 0.5% by mass of 2-amino-2-ethyl-1,3-propanediol to obtain 100% by mass. Then, filtration was performed with a membrane filter with an average pore size of 0.8 μm. The content of solids was then adjusted to 12% by mass by using ion-exchange water. Black ink 1 was thus prepared.

The viscosity at 25° C. of the black ink 1 obtained was 9 mPa·s and the surface tension was 25 mN/m.

Production Example 12

Preparation of Dye Ink Set

A dye ink set was prepared by mixing the below-described components, thoroughly stirring and dissolving, and then pressure filtering using Fluoropore Filter (trade name, manufactured by Sumitomo Denko KK) with a pore size 0.45 μm.

Dye Ink Composition

Dyes

Yellow: C. I. Direct Yellow 86

Cyan: C. I. Direct Blue 199

Magenta: C. I. Acid Red 285

Black: C. I. Direct Black 154

Formulation

| | |
|---|---|
| Dye | 4 parts |
| Glycerin | 7 parts |
| Thiodiglycol | 7 parts |
| Urea | 7 parts |
| Acetylene glycol | 1.5 parts |
| Water | 73.5 parts |

The viscosity at 25° C. of the dye inks obtained was 4 mPa·s and the surface tension was 35 dyne/cm.

Production Example 13

Fabrication of Substrate 1

| | |
|---|---|
| LBKP | 80 parts |
| NBKP | 20 parts |
| Soft calcium carbonate (trade name: TP-121, manufactured by Okutama Kogyo Co., Ltd.) | 10 parts |
| Aluminum sulfate | 1.0 part |
| Amphoteric starch (trade name: Cato 3210, manufactured by Nippon NSC KK) | 1.0 part |
| Neutral rosin sizing agent (trade name: NeuSize M-10, manufactured by Harima Kasei KK) | 0.3 parts |
| Throughput improving agent (trade name: NR-11LS, manufactured by Haimo KK) | 0.02 parts |

0.3% by mass of slurry of the above-described composition was formed into a paper in a long-mesh papermaking machine, and machine calender finished to obtain a substrate 1 with a weight of 79 g/m$^2$. In the size pressing step of the papermaking process, an aqueous solution of oxidized starch was coated so as to obtain the adhered quantity of solids of 1.0 g/m$^2$ per one side.

Example 1

A coating liquid with a concentration of solids of 60% by mass was prepared by adding 70 parts of kaolin with a proportion of particles with a size of 2 μm or less of 97% by mass, 30 parts of calcium bicarbonate with an average particle size of 1.1 μm as a pigment, 8 parts of a styrene-butadiene copolymer emulsion with a glass transition temperature (Tg) of −5° C. as a binder, 1 part of starch esterified with phosphoric acid, and 0.5 parts of calcium stearate as an additive were added together, and then adding water thereto.

The coating solution thus obtained was coated with a blade coated on both sides of the substrate 1 so as to obtain a coating layer thickness of 5 μm on one side. The coated solution was then hot-flow dried and a super-calender treatment was performed to produce a recording medium 1.

An ink set 1 composed of the black ink, yellow ink, magenta ink, and cyan ink manufactured in the Production Examples 8 to 11 was then prepared.

Recording at an image resolution of 600 dpi was then performed with a drop-on-demand ink jet printer test machine having 384 nozzles with a nozzle resolution of 300 dpi by using the obtained ink set 1 and recording medium 1. A large drop size was 20 pL, a medium drop size was 10 pL, and a small drop size was 2 pL. The adhesion quantity regulation was performed by setting the total quantity regulation of secondary colors to 140%. During solid recording, solid image and text were printed so that the total ink quantity in a 300 dot rectangular did not exceed 15 g/m$^2$. After recording, the print was allowed to stay (image surface facing up) for 15 sec at 23° C. in a 50% RH environment. Then, the print was transferred to the fixing device shown in FIG. 14 and nip processing was performed for 0.8 sec at a temperature of 150° C.

A silicone resin film (silicone resin curable room temperature SR2411, manufactured by Toray-Dow Corning Co., Ltd.) on the nozzle plate surface of the ink jet printer. The film thickness was 1.2 μm, the surface roughness (Ra) was 0.18 μm, and the critical surface tension was 21.6 mN/m. Ink ejection was performed onto the film by using the cyan ink of Production Example 8. The ink flying process was observed with a video camera. Ink droplets were found to form normally and good ejection stability was confirmed.

Example 2

Recording was carried out in the same manner as in Example 1, except that the recording medium 1 of Example 1 was changed to OK Top Coat+(manufactured by Oji Paper Co., Ltd.) that is commercial-grade paper.

Example 3

Recording was carried out in the same manner as in Example 2, except that hot air flow at 120° C. was used during dry-to-touch drying in Example 2.

Example 4

Recording was carried out in the same manner as in Example 2, except that fixing temperature was changed to 180° C. in Example 2.

Example 5

Recording was carried out in the same manner as in Example 2, except that fixing temperature was changed to 90° C. in Example 2.

Example 6

Recording was carried out in the same manner as in Example 2, except that ink adhesion quantity was changed to 15 g/m$^2$ in Example 2.

Example 7

Recording was carried out in the same manner as in Example 1, except that the recording medium 1 of Example 1 was changed to OK Kanefuji+127 g/m$^2$ (manufactured by Oji Paper Co., Ltd.) that is commercial-grade paper.

Example 8

Recording was carried out in the same manner as in Example 1, except that the recording medium 1 of Example 1 was changed to SA Kanefuji+127 g/m$^2$ (manufactured by Oji Paper Co., Ltd.) that is commercial-grade paper.

Example 9

Recording was carried out in the same manner as in Example 1, except that the recording medium 1 of Example 1 was changed to Super MI Dull 70 g/m$^2$ (manufactured by Nippon Paper Industries Co., Ltd.) that is commercial-grade paper.

Example 10

Recording was carried out in the same manner as in Example 1, except that the recording medium 1 of Example 1 was changed to Aurora Coat 100 g/m$^2$ (manufactured by Nippon Paper Industries Co., Ltd.) that is commercial-grade paper.

Example 11

Recording was carried out in the same manner as in Example 1, except that the recording medium 1 of Example 1 was changed to Alpha Matt 80 g/m$^2$ (manufactured by Hokuetsu Paper Co., Ltd.) that is commercial-grade paper.

Example 12

Recording was carried out in the same manner as in Example 1, except that the recording medium 1 of Example 1 was changed to Ricoh Business Gloss 100 100 g/m$^2$ (manufactured by Ricoh, Inc.) that is paper gel-jet printing.

Comparative Example 1

Recording was carried out in the same manner as in Example 2, except that dry-to-touch drying of Example 2 was not performed.

Comparative Example 2

Recording was carried out in the same manner as in Example 2, except that the fixing device of Example 2 was changed from a heat roller to an infrared heater (manufactured by Ushio Denki KK).

Comparative Example 3

Recording was carried out in the same manner as in Example 2, except that the ink adhesion quantity of Example 2 was changed to 20 g/m$^2$.

Comparative Example 4

Recording was carried out in the same manner as in Example 1, except that the recording medium 1 of Example 1 was changed to Crispia Paper (manufactured by Epson Co., Ltd.) that is paper for ink jet printing.

Comparative Example 5

Recording was carried out in the same manner as in Example 1, except that the recording medium 1 of Example 1 was changed to SuperFine Paper (manufactured by Epson Co., Ltd.) that is paper for ink jet printing.

Comparative Example 6

Recording was carried out in the same manner as in Example 1, except that the recording medium 1 of Example 1 was changed to Mirror Coat Platinum 127 g/m$^2$ (manufactured by Oji Paper Co., Ltd.) that is commercial-grade paper.

Comparative Example 7

The printer of Example 2 was changed to Pixus iP4200 (manufactured by Canon Inc.), recording was performed in a Gloss Paper Fine Mode, and then after-processing identical to that of Example 2 was performed.

Comparative Example 8

Recording was performed in the same manner as in Comparative Example 7, except that the recording medium of Comparative Example 7 was changed to OK Kanefuji+ (manufactured by Oji Paper Co., Ltd.).

Comparative Example 9

Recording was performed in the same manner as in Comparative Example 7, except that the recording medium of Comparative Example 7 was changed to SA Kanefuji+127 g/m$^2$ (manufactured by Oji Paper Co., Ltd.).

Comparative Example 10

Recording was carried out in the same manner as in Comparative Example 7, except that the recording medium of Comparative Example 7 was changed to Super MI Dull 70 g/m$^2$ (manufactured by Nippon Paper Industries Co., Ltd.) that is commercial-grade paper.

Comparative Example 11

Recording was carried out in the same manner as in Comparative Example 7, except that the recording medium of Comparative Example 7 was changed to Aurora Coat 100 g/m$^2$ (manufactured by Nippon Paper Industries Co., Ltd.) that is commercial-grade paper.

Comparative Example 12

Recording was carried out in the same manner as in Comparative Example 7, except that the recording medium of Comparative Example 7 was changed to Alpha Matt 80 g/m$^2$ (manufactured by Hokuetsu Paper Co., Ltd.) that is commercial-grade paper.

Comparative Example 13

Recording was carried out in the same manner as in Comparative Example 7, except that the recording medium of Comparative Example 7 was changed to Ricoh Business Gloss 100 100 g/m$^2$ (manufactured by Ricoh, Inc.) that is paper gel-jet printing.

Comparative Example 14

Recording was carried out in the same manner as in Comparative Example 7, except that the recording medium of Comparative Example 7 was changed to Crispia (manufactured by Epson Co., Ltd.) that is paper for ink jet printing.

Comparative Example 15

Recording was carried out in the same manner as in Comparative Example 7, except that the recording medium of Comparative Example 7 was changed to SuperFine Paper (manufactured by Epson Co., Ltd.) that is paper for ink jet printing.

Comparative Example 16

Recording was carried out in the same manner as in Comparative Example 7, except that the recording medium of Comparative Example 7 was changed to Mirror Coat Platinum 127 g/m$^2$ (manufactured by Oji Paper Co., Ltd.) that is commercial-grade paper.

A pure water transfer quantity was then measured in the below-described manner with respect to recording media used in Examples 1 to 12 and Comparative Examples 1 to 16. The results obtained are shown in Table 1.

<Measurement of Pure Water Transfer Quantity with Dynamic Scanning Absorptometer>

A transfer quantity of pure water was measured at 25° C. and 50% RH with respect to each recording media by using a dynamic scanning absorptometer (K350 Series D, manufactured by Kyowa Seiko KK). The transfer quantity at a contact time of 100 ms and a contact time of 400 ms was found by interpolation from the measured transfer quantities relating to contact times close to these contact times.

Image quality and image reliability were evaluated as described hereinbelow with respect to images obtained in Examples 1 to 12 and Comparative Examples 1 to 16. The results obtained are shown in Table 1. Symbol x relates to evaluation results that are inadequate as ink jet images.

<Image Density>

An optical density of a magenta solid image portion of Examples and Comparative Examples was measured with X-Rite 932 (X-Rite Co., Ltd.) and evaluated according to the following criteria.

[Evaluation Criteria]

A: magenta image density 1.6 or higher.

B: magenta image density 1.3 or higher.

C: magenta image density 1.0 or higher.

D: magenta image density less than 1.0.

<Image Bleeding>

Beading of the green solid image portion of each image print and a degree of bleeding of black symbols against the yellow background were visually observed and evaluated according to the following criteria.

[Evaluation Criteria]

A: no beading or bleeding, uniform printing.

B: slight beading and bleeding are observed.

C: clear beading and bleeding are observed.

D: significant beading and bleeding are observed.

<Evaluation of Glossiness>

A degree of glossiness of image portions of image prints was visually observed and evaluated according to the following criteria.

[Evaluation Criteria]

A: high glossiness.

B: glossiness.

C: no glossiness.

<Droplet Bonding>

A gray half-tone solid image was recorded using droplets and the occurrence of banding (streaks) was evaluated.

[Evaluation Criteria]

A: banding is absent or practically invisible, uniform image.

B: banding is visible and uniformity is poor.

<Image Disturbance>

Ejected paper sheets with image fixed by means of the fixing rollers were visually evaluated for the occurrence of smearing of fine-scale lines and/or image blur; those with no such features were ranked A, while those with such features were ranked B.

<Image Offset>

The generation of offset images—an image with colorant which is derived from a colorant that has been offset to the fixing roller from another portion of that image upon heat treatment—was visually investigated; those with no offset colorant were rank A, while those with offset colorant were ranked B.

Images subjected to fixing treatment were rubbed by a finger tip in such a manner as to move the finger back and forth over the image 10 times, and the images were evaluated visually for the occurrence of colorant separation and/or image blur; those with none of such features were ranked A, those with low level of image blur were ranked B, and those with severe level of colorant separation and image blur were ranked C.

Printed sheets subjected to fixing treatment were evaluated visually for the occurrence of blister; those with no blister were ranked A, those with a minute blister on a small portion thereof were ranked B, and those with a distinct blister were ranked C.

TABLE 1

| | | Paper | Maker | Application | Grade | Paper quality: Water transfer quantity (100 | Paper quality: Water transfer quantity (400 | Image formation unit: Ink | Image formation unit: Ink adhesion quantity (BK) | Banding | Image bleeding | Gloss of fixed |
|---|---|---|---|---|---|---|---|---|---|---|---|---|
| Ex. | 1 | Recording Paper 1 | Ricoh | Gel-jet printing | A3 | 6 | 9 | Pigment | 10 | A | A | B |
| Ex. | 2 | OK Top Coat + | Oji Paper | Offset printing | A2 | 3 | 3.4 | Pigment | 10 | A | B | B |
| Ex. | 3 | OK Top Coat + | Oji Paper | Offset printing | A2 | 3 | 3.4 | Pigment | 10 | A | B | B |
| Ex. | 4 | OK Top Coat + | Oji Paper | Offset printing | A2 | 3 | 3.4 | Pigment | 10 | A | B | B |
| Ex. | 5 | OK Top Coat + | Oji Paper | Offset printing | A2 | 3 | 3.4 | Pigment | 10 | A | B | B |
| Ex. | 6 | OK Top Coat + | Oji Paper | Offset printing | A2 | 3 | 3.4 | Pigment | 15 | A | C | B |
| Ex. | 7 | OK Kanefuji + | Oji Paper | Offset printing | A1 | 1.9 | 2.5 | Pigment | 10 | A | A | B |
| Ex. | 8 | SA Kanefuji + | Oji Paper | Offset printing | A0 | 1.9 | 2.2 | Pigment | 10 | A | A | B |
| Ex. | 9 | Super MI Dull | Nippon Paper | Offset printing | A2 | 7 | 9.3 | Pigment | 10 | A | A | B |
| Ex. | 10 | Aurora Coat | Nippon Paper | Offset printing | A2 | 2.8 | 3.4 | Pigment | 10 | A | A | B |
| Ex. | 11 | Alpha Matt | Kitaetsu Paper | Offset printing | A3 | 6 | 6.6 | Pigment | 10 | A | A | B |
| Ex. | 12 | Ricoh Business Coat Gloss | Ricoh | Gel jet printing | A2 | 5.8 | 9 | Pigment | 10 | A | A | B |
| Comp. Ex. | 1 | OK Top Coat + | Oji Paper | Offset printing | A2 | 3 | 3.4 | Pigment | 10 | — | — | — |
| Comp. Ex. | 2 | OK Top Coat + | Oji Paper | Offset printing | A2 | 3 | 3.4 | Pigment | 10 | A | A | B |
| Comp. Ex. | 3 | OK Top Coat + | Oji Paper | Offset printing | A2 | 3 | 3.4 | Pigment | 20 | A | D | B |
| Comp. Ex. | 4 | Crisper | Epson | Ink jet printing | — | 45.7 | 45.8 | Pigment | 10 | x | A | B |
| Comp. Ex. | 5 | SuperFine Paper | Epson | Ink jet printing | — | 33.5 | 35.4 | Pigment | 10 | A | C | C |
| Comp. Ex. | 6 | Mirror Coat Platinum | Oji Paper | Offset printing | Cast coat paper | 0.2 | 0.3 | Pigment | 10 | A | D | B |
| Comp. Ex. | 7 | OK Top Coat + | Oji Paper | Offset printing | A2 | 3 | 3.4 | Dye | 18 | A | D | C |
| Comp. Ex. | 8 | OK Kanefuji + | Oji Paper | Offset printing | A1 | 2 | 2.5 | Dye | 18 | A | D | C |
| Comp. Ex. | 9 | SA Kanefuji + | Oji Paper | Offset printing | A0 | 2 | 2.2 | Dye | 18 | A | D | C |
| Comp. Ex. | 10 | Super MI Dull | Nippon Paper | Offset printing | A2 | 7 | 9.3 | Dye | 18 | A | D | C |
| Comp. Ex. | 11 | Aurora Coat | Nippon Paper | Offset printing | A2 | 2.8 | 3.4 | Dye | 18 | A | D | C |
| Comp. Ex. | 12 | Alpha Matt | Kitaetsu Paper | Offset printing | A3 | 6 | 6.6 | Dye | 18 | A | D | C |
| Comp. Ex. | 13 | Ricoh Business Coat Gloss 100 | Ricoh | Gel jet printing | A2 | 5.8 | 9 | Dye | 18 | A | D | C |
| Comp. Ex. | 14 | Crisper | Epson | Ink jet printing | — | 45.7 | 45.8 | Dye | 18 | A | B | A |
| Comp. Ex. | 15 | SuperFine Paper | Epson | Ink jet printing | — | 33.5 | 35.4 | Dye | 18 | A | C | C |
| Comp. Ex. | 16 | Mirror Coat Platinum | Oji Paper | Offset printing | Cast coat paper | 0.2 | 0.3 | Dye | 18 | A | D | C |

| | | Fixing unit: Preliminary drying method | Fixing unit: Preliminary drying time | Fixing method | Fixing temp. (paper surface temp.) | Time | Image distortion | Image offset | Fixing | Blister |
|---|---|---|---|---|---|---|---|---|---|---|
| Ex. | 1 | Stay in air | 15 sec | Heat roller | 150 | 0.8 | A | A | A | A |
| Ex. | 2 | Stay in air | 15 sec | Heat roller | 150 | 0.8 | A | A | A | A |
| Ex. | 3 | Hot flow | 5 sec | Heat roller | 150 | 0.8 | A | A | A | A |
| Ex. | 4 | Stay in air | 15 sec | Heat roller | 180 | 0.8 | A | A | A | B |
| Ex. | 5 | Stay in air | 15 sec | Heat roller | 90 | 0.8 | A | A | B | A |
| Ex. | 6 | Stay in air | 15 sec | Heat roller | 150 | 0.8 | A | A | A | A |
| Ex. | 7 | Stay in air | 15 sec | Heat roller | 150 | 0.8 | A | A | A | A |
| Ex. | 8 | Stay in air | 15 sec | Heat roller | 150 | 0.8 | A | A | A | A |
| Ex. | 9 | Stay in air | 15 sec | Heat roller | 150 | 0.8 | A | A | A | A |
| Ex. | 10 | Stay in air | 15 sec | Heat roller | 150 | 0.8 | A | A | A | A |
| Ex. | 11 | Stay in air | 15 sec | Heat roller | 150 | 0.8 | A | A | A | A |
| Ex. | 12 | Stay in air | 15 sec | Heat roller | 150 | 0.8 | A | A | A | A |
| Comp. Ex. | 1 | None | 0 sec | Heat roller | 150 | 0.8 | B | B | C | A |
| Comp. Ex. | 2 | Stay in air | 15 sec | IR heater | 70 | 0.8 | A | A | C | A |
| Comp. Ex. | 3 | Stay in air | 15 sec | Heat roller | 150 | 0.8 | B | B | A | A |
| Comp. Ex. | 4 | Stay in air | 15 sec | Heat roller | 150 | 0.8 | A | A | A | A |
| Comp. Ex. | 5 | Stay in air | 15 sec | Heat roller | 150 | 0.8 | A | A | A | A |
| Comp. Ex. | 6 | Stay in air | 15 sec | Heat roller | 150 | 0.8 | A | A | A | A |
| Comp. Ex. | 7 | Stay in air | 15 sec | Heat roller | 150 | 0.8 | A | A | A | A |
| Comp. Ex. | 8 | Stay in air | 15 sec | Heat roller | 150 | 0.8 | A | A | A | A |
| Comp. Ex. | 9 | Stay in air | 15 sec | Heat roller | 150 | 0.8 | A | A | A | A |
| Comp. Ex. | 10 | Stay in air | 15 sec | Heat roller | 150 | 0.8 | A | A | A | A |

TABLE 1-continued

| | | | | | | | | | | |
|---|---|---|---|---|---|---|---|---|---|---|
| Comp. Ex. | 11 | Stay in air | 15 sec | Heat roller | 150 | 0.8 | A | A | A | A |
| Comp. Ex. | 12 | Stay in air | 15 sec | Heat roller | 150 | 0.8 | A | A | A | A |
| Comp. Ex. | 13 | Stay in air | 15 sec | Heat roller | 150 | 0.8 | A | A | A | A |
| Comp. Ex. | 14 | Stay in air | 15 sec | Heat roller | 150 | 0.8 | A | A | A | A |
| Comp. Ex. | 15 | Stay in air | 15 sec | Heat roller | 150 | 0.8 | A | A | A | A |
| Comp. Ex. | 16 | Stay in air | 15 sec | Heat roller | 150 | 0.8 | A | A | A | A |

Industrial Applicability

The ink jet recording method of the present invention can provide recorded images at a high speed, those images having glossiness and excellent recording quality with no blurring, feathering, or bleeding in the peripheral portions of text or image and a good contour, by using recording media close in appearance to general paper for commercial printing, or commercial-grade and publication-grade paper that satisfies certain conditions, and such method can be advantageously used in an ink jet recording apparatus and for ink jet recording. In addition, the ink prints thus obtained have excellent abrasion resistance of images and do not inhibit the handling immediately after recording.

The ink jet recording method of the present invention can be applied to recording of various types based on ink jet recording principle and can be especially advantageously applied to printers for ink jet recording, facsimile machines, copiers, printer-fax-copier all-in-one machines, and printing machines.

The invention claimed is:

1. An ink jet recording method comprising:

performing image recording on a recording medium to obtain an ink adhesion quantity of 15 g/m$^2$ or less of an ink containing at least a colorant, the recording medium having at least one coating layer on at least one surface of a substrate including cellulose pulp; and dry-to-touch drying the recorded image and bringing a heat source into direct contact with the recording medium for image fixing, wherein the recording medium is formed such that a transfer quantity of pure water into the recording medium in a contact interval of 100 ms that is measured with a dynamic scanning liquid absorptometer is 1 mL/m$^2$ or more to 30 mL/m$^2$ or less and a transfer quantity of pure water into the recording medium in a contact interval of 400 ms is 2 mL/m$^2$ or more to 35 mL/m$^2$ or less, and wherein the ink further includes water and a wetting agent.

2. The ink jet recording method according to claim 1, wherein the heat source is a heat roller.

3. The ink jet recording method according to claim 1, wherein image recording is performed with an ink with a content of solids of 3% by mass or more on a recording medium such that a transfer quantity of pure water into the recording medium in a contact interval of 100 ms that is measured with a dynamic scanning liquid absorptometer is 1 mL/m$^2$ or more to 10 mL/m$^2$ or less and a transfer quantity of pure water into the recording medium in a contact interval of 400 ms is 2 mL/m$^2$ or more to 11 mL/m$^2$ or less.

4. The ink jet recording method according to claim 1, wherein a fixing temperature is 100° C. or higher.

5. The ink jet recording method according to claim 1, wherein a nip time of a fixing roller is 0.3 sec or longer.

6. The ink jet recording method according to claim 1, wherein the dry-to-touch drying is performed using a contactless drying unit.

7. The ink jet recording method according to claim 1, comprising:

performing image recording by spraying ink droplets onto a recording medium surface by use of an ink head having nozzles for spraying colored inks for performing color printing onto the recording medium surface; and controlling the ink adhesion quantity to within a regulation value by total quantity regulation processing.

8. The ink jet recording method according to claim 1, wherein the recording medium has a substrate and a coating layer on the substrate, and the adhesion quantity of solids of the coating layer is 0.5 g/m$^2$ to 20 g/m$^2$.

9. The ink jet recording method according to claim 1, wherein a basis weight of the recording medium is 50 g/m$^2$ to 250 g/m$^2$.

10. The ink jet recording method according to claim 1, wherein the coating layer of the recording medium comprises a pigment, and the pigment is kaolin.

11. The ink jet recording method according to claim 1, wherein the coating layer of the recording medium comprises a pigment, and the pigment is calcium bicarbonate.

12. The ink jet recording method according to claim 1, wherein the coating layer of the recording medium comprises an aqueous resin.

13. The ink jet recording method according to claim 12, wherein the aqueous resin is a water-soluble resin or a water-dispersible resin.

* * * * *